US012767471B2

(12) United States Patent
Lancaster, III

(10) Patent No.: US 12,767,471 B2
(45) Date of Patent: Oct. 20, 2026

(54) STRETCH FILM SUPPLY ROLL FOR REUSE APPLICATIONS

(71) Applicant: Lantech.com, LLC, Louisville, KY (US)

(72) Inventor: Patrick R. Lancaster, III, Louisville, KY (US)

(73) Assignee: Lantech.com, LLC, Louisville, KY (US)

( * ) Notice: Subject to any disclaimer, the term of this patent is extended or adjusted under 35 U.S.C. 154(b) by 0 days.

(21) Appl. No.: 19/335,611

(22) Filed: Sep. 22, 2025

(65) Prior Publication Data

US 2026/0015195 A1 Jan. 15, 2026

Related U.S. Application Data

(63) Continuation of application No. 19/219,259, filed on May 27, 2025, now Pat. No. 12,434,933, which is a (Continued)

(51) Int. Cl.
*B65H 18/28* (2006.01)
*B65B 69/00* (2006.01)
(Continued)

(52) U.S. Cl.
CPC ..... *B65H 18/28* (2013.01); *B65B 69/00* (2013.01); *B65B 69/0025* (2013.01);
(Continued)

(58) Field of Classification Search
CPC ..... B65B 69/00; B65B 69/0025; B65H 18/08; B65H 18/28; B65H 23/0204; B65H 2701/1944; B65H 2801/81; B65D 71/0088
See application file for complete search history.

(56) References Cited

U.S. PATENT DOCUMENTS 3,889,442 A 6/1975 Grahn
4,934,123 A 6/1990 Salzsauler
(Continued)

FOREIGN PATENT DOCUMENTS

CN 109229673 B 1/2019
CN 116674829 A 9/2023
(Continued)

OTHER PUBLICATIONS

E2 Pack, Robotic unwrapper and destrapper, [retrieved Dec. 26, 2024]. Retrieved from internet, https://e2pack.com/en/robotic-unwrapping-systems/ Dec. 26, 2024.
(Continued)

*Primary Examiner* — Eyamindae C Jallow
(74) *Attorney, Agent, or Firm* — Gray Ice Higdon

(57) ABSTRACT

A stretch film supply roll used in stretch wrapping palletized loads includes a plurality of lengths of stretch film wound into a roll form and joined to one another using a plurality of lap seals that forms a continuous web of stretch film on the roll form. Such a stretch film supply roll may be useful, for example, in reuse applications where stretch film is reused multiple times to wrap different loads. In some instances, the lengths of stretch film may have been used to previously wrap different loads, and in some instances, the lengths of stretch film may have differing characteristics such as materials and/or thicknesses.

27 Claims, 29 Drawing Sheets

Related U.S. Application Data continuation of application No. 19/218,517, filed on May 26, 2025.

(60) Provisional application No. 63/652,333, filed on May 28, 2024.

(51) Int. Cl.
*B65H 18/08* (2006.01)
*B65H 23/02* (2006.01)
*B65D 71/00* (2006.01)

(52) U.S. Cl.
CPC ..... *B65H 18/08* (2013.01); *B65H 23/0204* (2013.01); *B65D 71/0088* (2013.01); *B65H 2701/1944* (2013.01); *B65H 2801/81* (2013.01)

(56) References Cited

U.S. PATENT DOCUMENTS

| | | | | |
|---|---|---|---|---|
| 5,148,651 | A * | 9/1992 | Masuda | B65B 69/0033 53/381.1 |
| 5,282,346 | A * | 2/1994 | Masuda | B65B 69/0033 53/381.1 |
| 5,463,841 | A * | 11/1995 | Hayakawa | B65B 69/0033 53/381.2 |
| 5,727,747 | A | 3/1998 | Hannen | |
| 5,802,810 | A | 9/1998 | Wojcik | |
| 5,911,666 | A | 6/1999 | Lancaster, III | |
| 6,766,630 | B2 | 7/2004 | Rutten | |
| 7,174,695 | B2 | 2/2007 | Porter | |
| 7,343,722 | B1 | 3/2008 | Rutten | |
| 10,696,506 | B2 | 6/2020 | Hannen | |
| 10,889,400 | B2 | 1/2021 | Gibert Guasch | |
| 10,899,488 | B2 | 1/2021 | Kivelä | |
| 12,434,933 | B1 | 10/2025 | Lancaster, III | |
| 2003/0177740 | A1 | 9/2003 | Rutten | |
| 2004/0099110 | A1 | 5/2004 | Cere | |
| 2005/0196266 | A1 | 9/2005 | Kropp | |
| 2016/0031579 | A1 | 2/2016 | Redford | |
| 2018/0111774 | A1 | 4/2018 | Hannen | |
| 2023/0159208 | A1 | 5/2023 | Bjerring | |
| 2025/0368373 | A1 | 12/2025 | Lancaster, III | |
| 2025/0368374 | A1 | 12/2025 | Lancaster, III | |

FOREIGN PATENT DOCUMENTS

| | | | |
|---|---|---|---|
| EP | 0142846 | A1 | 5/1985 |
| EP | 0625465 | B1 | 11/1994 |
| EP | 1175829 | A2 | 1/2002 |
| EP | 1521707 | A1 | 4/2005 |
| EP | 2459450 | B1 | 6/2012 |
| EP | 3312113 | A1 | 4/2018 |
| ES | 2527540 | A2 | 1/2015 |
| IT | 201800005133 | A1 | 8/2018 |
| JP | H08175510 | A | 7/1996 |
| JP | H08324524 | A | 12/1996 |
| JP | 3589490 | B2 | 11/2004 |
| KR | 20220133025 | A | 10/2022 |
| KR | 102519694 | B1 | 4/2023 |
| WO | 9803417 | A1 | 1/1998 |
| WO | 2009106655 | A1 | 9/2009 |
| WO | 2025250489 | A1 | 12/2025 |

OTHER PUBLICATIONS

Glass International, EMS develops automatic unwrapping system, [retrieved Dec. 26, 2024]. Retrieved from internet, https://www.glass-international.com/news/ems-develops-automatic-unwrapping-system.

(YouTube) Screen capture from YouTube video clip entitled 'Fully automated unwrapping machine for pallets—MSK Defotech,' 1 page, https://www.youtube.com/watch?v=XlzZEzNiwj4, uploaded on Aug. 10, 2021 by user 'MSK Covertech'. Retrieved from Internet: May 26, 2025.

(YouTube) Screen capture from YouTube video clip entitled 'Robotic Unwrapper Compilation, Various Products—BW Integrated Systems,' 1 page, https://www.youtube.com/watch?v=jSvOnT8y6-E, uploaded on Mar. 30, 2020 by user 'BW Integrated Systems'. Retrieved from Internet: May 26, 2025.

(YouTube) Screen capture from YouTube video clip entitled 'Automatic Unwrapping of Shipping Pallets | VARO Unwrapper,' 1 page, https://www.youtube.com/watch?v=2LSmyczkFCw, uploaded on Aug. 11, 2023 by user 'VARO Group'. Retrieved from Internet: May 26. 2025.

(YouTube) Screen capture from YouTube video clip entitled 'MSK Defotech—Fully automated unwrapping of champagne bottles,' 1 page, https://www.youtube.com/watch?v=aGgqalBwpmk, uploaded on Aug. 2, 2021 by user 'MSK Covertech'. Retrieved from Internet: May 26, 2025.

(YouTube) Screen capture from YouTube video clip entitled 'Automatic Unwrapping of unstable shipping pallets | VARO Unwrapper—Control Version,' 1 page, https://www.youtube.com/watch?v=moz15MWam0, uploaded on Jun. 7, 2021 by user 'VARO Group'. Retrieved from Internet: May 26, 2025.

United States Patent & Trademark Office; Non-Final Office Action issued in U.S. Appl. No. 19/219,272; 37 pages; dated Aug. 12, 2025.

Patent Cooperation Treaty; International Search Report and Written Opinion Issued in PCT Application No. PCT/US2025/030941; 10 pages; dated Sep. 29, 2025.

United States Patent & Trademark Office; Final Office Action issued in U.S. Appl. No. 19/219,272; 31 pages; dated Dec. 1, 2025.

* cited by examiner

STRETCH FILM SUPPLY ROLL FOR REUSE APPLICATIONS

BACKGROUND OF THE INVENTION

Various packaging techniques have been used to build a load of unit products and subsequently wrap them for transportation, storage, containment and stabilization, protection, and waterproofing of goods in commerce. One system uses stretch wrapping machines, also referred to herein as stretch wrappers or stretch wrapping apparatuses, to stretch, dispense, and wrap a polymer-based packaging material, e.g., stretch film, around a load. The polymer-based packaging material may also be pre-stretched before it is applied to the load. Wrapping can be performed as an inline, automated packaging technique that dispenses and wraps packaging material in a stretched condition around a load on a pallet to cover and contain the load. Stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

Worldwide sensitivity to sustainability has increased interest in reducing or eliminating the single use and disposal of polymer packaging materials. Non-polymer alternatives such as paper have been considered; however, the stretchability of these non-polymer alternatives is generally less than that provided by polymer-based packaging materials, and wrapping a load with materials exhibiting limited stretchability presents a number of concerns with respect to puckering and tears. In addition, polymer-based packaging materials incorporating recycled content have also been considered, although it has been found that the incorporation of recycled content can significantly reduce the performance of a packaging material as compared to virgin polymer packaging material. Moreover, regardless of the technology, all of these different alternative materials are still typically disposed of once the load is unwrapped at its ultimate destination.

While improvements in stretch wrapping technology over the decades have substantially reduced the costs and environmental impacts of stretch wrapping, there is a continuing desire to further improve sustainability. Various jurisdictions around the world, for example, are focusing regulatory efforts on reusability and limiting the use of single-use materials, including single-use materials utilized for the transportation of goods.

A need therefore exists in the art for systems and methods capable of securing and transporting palletized loads with reduced usage of single-use materials.

In addition, regardless of the type of material used to wrap a load, whenever it is time to access the individual unit products in the load, the material wrapped around the load generally must be removed. Conventionally, the material is removed by manually cutting through the material on one side of the load and then removing the material as a single bundle. Efforts have been made to develop machinery for automating the process; however, such efforts have generally utilized robotics to mimic the manual process, and have generally been complex, expensive, and slow.

Therefore, a need also continues to exist in the art for systems and methods capable of efficiently removing the material used to wrap a load.

SUMMARY OF THE INVENTION

The invention addresses these and other problems associated with the prior art by providing a stretch film supply roll used in stretch wrapping palletized loads that includes a plurality of lengths of stretch film wound into a roll form and joined to one another using a plurality of lap seals that forms a continuous web of stretch film on the roll form. Such a stretch film supply roll may be useful, for example, in reuse applications where stretch film is reused multiple times to wrap different loads. In some instances, the lengths of stretch film may have been used to previously wrap different loads, and in some instances, the lengths of stretch film may have differing characteristics such as materials and/or thicknesses.

Therefore, consistent with one aspect of the invention, a stretch film supply roll may include a plurality of lengths of stretch film wound into a roll form, and a plurality of lap seals joining together adjacent lengths of stretch film from the plurality of lengths of stretch film to form a continuous web of stretch film on the roll form.

In some embodiments, first and second lengths of the plurality of lengths are formed of different film material. In some embodiments, first and second lengths of the plurality of lengths are manufactured by different manufacturers. Moreover, in some embodiments, first and second lengths of the plurality of lengths have different thicknesses.

In some embodiments, each of the plurality of lengths of stretch film is a used length of stretch film that has previously been used to wrap a load. Also, in some embodiments, each of the plurality of lengths of stretch film has been used to wrap a different load. Moreover, in some embodiments, each of the plurality of lengths of stretch film has previously been controllably elongated when wrapping a load. In some embodiments, each of the plurality of lengths of stretch film has previously been controllably elongated substantially below a yield point of such length of stretch film.

Further, in some embodiments, a first length of stretch film of the plurality of lengths of stretch film includes a cumulative elongation gauge disposed on a surface thereof. Moreover, in some embodiments, the cumulative elongation gauge is formed on the first length of stretch film with a predetermined dimension along an elongation direction of the stretch film supply roll such that a current elongation of the first length of stretch film is determinable based on a measurement of a current dimension of the cumulative elongation gauge along the elongation direction of the stretch film supply roll. Further, in some embodiments, the cumulative elongation gauge is formed on the first length of stretch film prior to first use of the first length of stretch film to wrap a load. Also, in some embodiments, the cumulative elongation gauge is formed on the first length of stretch film during manufacture of the first length of stretch film. In addition, in some embodiments, the cumulative elongation gauge includes a plurality of marks separated from one another along the elongation direction of the stretch film supply roll by the predetermined dimension. Also, in some embodiments, the cumulative elongation gauge includes a plurality of shapes having the predetermined dimension along the elongation direction of the stretch film supply roll.

Some embodiments may also include a core about which the plurality of lengths of stretch film are wound, where the roll form is defined by the core. Also, in some embodiments, the core is cylindrical. In some embodiments, the stretch film supply roll is a coreless roll. Also, in some embodiments, a first length of stretch film of the plurality of lengths of stretch film is a used length of stretch film that has previously been used to wrap a load and includes a tail mark formed thereon during wrapping the load to indicate a tail location.

Moreover, in some embodiments, a first lap seal of the plurality of lap seals is a pressed, clamped, rolled, wiped, or heated lap seal. In some embodiments, a first lap seal of the plurality of lap seals includes an adhesive. In addition, in some embodiments, a first lap seal of the plurality of lap seals overlaps an underlying layer of stretch film on the stretch film supply roll, and the first lap seal and/or the overlapped layer includes a treated surface that reduces adherence between the first lap seal and the overlapped layer. In some embodiments, the treated surface is an abraded surface. Moreover, in some embodiments, the treated surface is a powder treated surface. In addition, in some embodiments, the treated surface is a liquid treated surface.

Consistent with another aspect of the invention, a stretch film supply roll may include a plurality of lengths of stretch film wound into a roll form, each of the plurality of lengths of stretch film collected from a respective load of a plurality of loads, and at least two of the plurality of lengths of stretch film having different thicknesses and/or formed of different film material, and a plurality of lap seals joining together adjacent lengths of stretch film from the plurality of lengths of stretch film to form a continuous web of stretch film on the roll form.

Consistent with another aspect of the invention, a stretch film supply roll may include a plurality of lengths of stretch film wound into a roll form, and a plurality of lap seals joining together adjacent lengths of stretch film from the plurality of lengths of stretch film to form a continuous web of stretch film on the roll form, where for a first lap seal of the plurality of lap seals, adherence of the first lap seal to a first length of stretch film among the plurality of lengths of stretch film that is at least partially overlapped by the first lap seal is reduced.

Other aspects of the invention may be directed to a method of using making or using any of the aforementioned stretch film supply rolls.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention.

DETAILED DESCRIPTION

Figure 1:
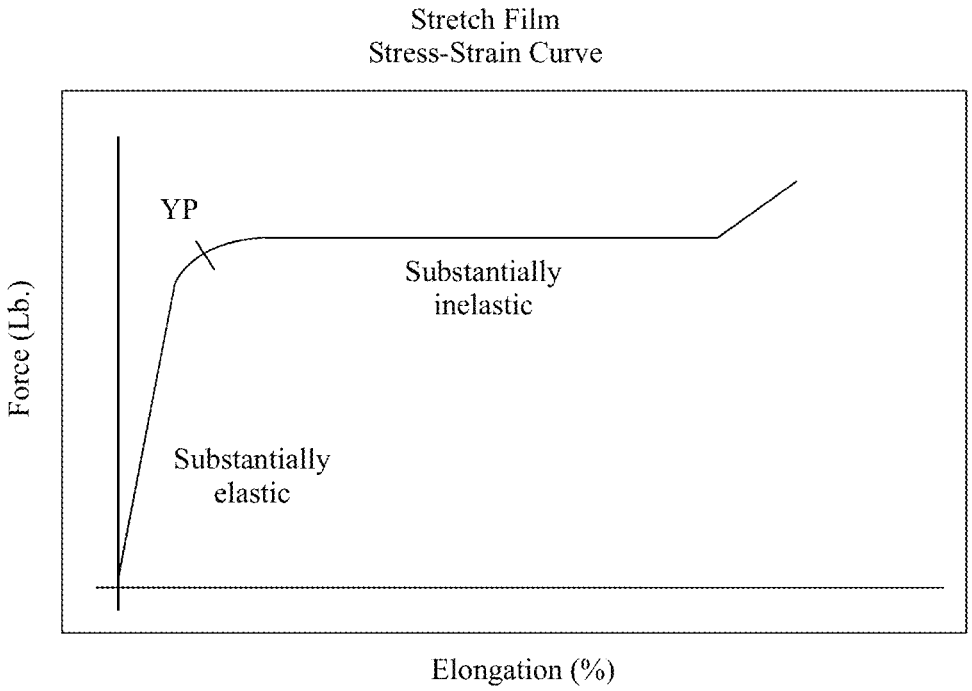
FIG. 1 is a graph illustrating a stress-strain curve of an example stretch film for use in a reusable stretch film system consistent with the invention.

Consumer concerns and legislative demands on the environmental, sustainability and waste impacts of stretch wrapping are encouraging producers and receivers of products to prioritize recycling as well as to consider alternate materials and returnable container systems as reuse strategies for wrapping and shipping loads. It has been estimated that about 6 billion pounds of stretch film was consumed globally in 2024, and up to 12 billion loads were wrapped and shipped using stretch wrap for containment. An increasing portion of used stretch film is now collected as Post Consumer Recycle (PCR) material and sold to recyclers to be included in downstream polyethylene products such as hand wrap, shrink film and construction film where the physical properties of the film are less critical than stretch film. In addition, additional consumer and legislative demands have encouraged the addition of PCR to stretch film, which places a much stronger requirement that film removed from loads be kept clean and isolated from other non-stretch materials to ensure that it remains usable in the production of stretch film. To reduce freight, it is also desirable that the used stretch film intended for recycling be very densely compacted, and both issues have proven to be significant impediments that have limited the supply of used stretch film available for the production of stretch films incorporating PCR materials.

Additional legislative demands have recently encouraged the use of reusable stretch film alternatives such as large rigid containers and reusable heavy mesh materials with hook and loop straps for containing loads for shipment. These alternate materials, however, are relatively heavy and expensive, and may require hundreds of uses to become comparatively sustainable. Replacement of these reusable materials that have been lost or "non-recovered" can also add significantly to the shipping cost and carbon footprint as new units are required to enter the process. Furthermore, a large inventory of reusable materials would be required to support large brand owner shippers, and there are very few options for automating the packing process associated with such alternatives.

The herein-described embodiments, on the other hand, utilize various techniques to address the environmental, sustainability and waste impacts of stretch wrapping. In some embodiments, for example, various wrapping and/or unwrapping techniques are utilized to implement a reusable stretch film system that utilizes a reusable packaging material such as reusable stretch film for securing and transporting palletized loads in a manner that enables stretch film to be reused on multiple loads. A reusable stretch film system, for example, may in various embodiments include one or both of a stretch wrapping apparatus for wrapping a palletized load with reusable film and an unwrapping apparatus for unwrapping the reusable film from the palletized load. Further, in some embodiments, a reusable stretch film system may also include various constructions suitable for storing and/or transporting reusable film once unwrapped from a palletized load so that it can be later used to wrap another palletized load.

In other embodiments, various unwrapping techniques may be utilized to facilitate the recovery of used stretch film for recycling purposes. In some instances, the recovery of such used stretch film may also be for the purpose of incorporation of the recovered material into stretch films incorporating PCR materials, or alternatively, for incorporation into other post-consumer products.

Reusable Stretch Film System

As noted above, it would be desirable in some instances for the stretch film to be used for wrapping palletized loads to be reusable, e.g., to reduce waste and improve sustainability in the transport of goods. While current stretch wrappers are capable of securing palletized loads in a reliable and cost effective manner, current stretch wrappers utilize films that are generally not reusable after wrapping for several reasons.

Stretch film used for stretch wrapping is typically extruded from polyethylene in single and multi-layers with complex structures for enhancing strength, stretchability, tear, and tackiness. Premium brands add polypropylene into one or more layers, and a majority of stretch film is cast or blown and co-extruded into multiple layers. Stretch film derives much of its value from its relative elasticity, i.e., its ability to resume its normal shape after being stretched. Elasticity provides a "rubber band" effect that permits stretching the film firmly around the load shape to achieve the required containment force for successful shipment while retaining the ability to absorb the shocks and dimensional changes that occur during transit.

Many stretch wrappers also incorporate pre-stretch assemblies that apply a controlled stretch to a stretch film to elongate the stretch film and reduce the amount of film required to wrap a load, thereby providing both cost and waste reduction benefits. Many conventional pre-stretch assemblies, for example, stretch a stretch film between about 150% and about 300% (where 100% pre-stretch represents an effective doubling of the original length of the stretch film) prior to dispensing the stretch film to a load. Pre-stretching a stretch film in this manner, however, results in the stretch film being stretched well beyond its yield point, which causes plastic deformation of the stretch film, and which leaves the stretch film in such a state that, were the stretch film reused for a second load using the same amount of pre-stretch, the stretch film would inevitably break. As illustrated in FIG. 1, for example, for many stretch films, the yield point (YP) is generally identifiable on a stress strain curve (where elongation is on the x-axis and stretch force is on the y-axis) proximate where the curve transitions from primarily vertical to primarily horizontal, and by polyethylene film industry convention is defined at approximately the mid-point of the curved transition.

In addition, beyond the use of pre-stretch, conventional stretch wrappers, as well as manual stretch wrapping devices, can still stretch a stretch film to a sufficient extent to cause substantial plastic deformation and loss of elasticity in the stretch film. As a result, even without the use of pre-stretch, stretch film used to wrap loads using such techniques is typically not in a suitable condition for reuse in wrapping other loads.

It has been found, for example, that with some stretch films, significant strain hardening can occur after about 50-90% elongation, which can significantly impact the reusability of the stretch film. As noted above, many current stretch film processes use pre-stretch settings of 150-300% or more, rendering the stretch film substantially inelastic even after a single use, and reuse of such film at similar elongations would likely result in film breaks due to the high force and high cumulative elongation (i.e., 300-600%) that would most likely exceed the elongation limit of the stretch film.

In addition, the films used in current stretch wrappers are relatively thin (e.g., about 35-100 gauge), which reduces the amount of material required, as well as costs. At least in some applications, however, such relatively thin films have been found to be relatively hard to remove from shipped pallet loads in reusable condition since the films tear relatively easily when unwrapping, especially around any abrasions or punctures of the films on sharp corners or pallets. Nonetheless, this is not the case for all stretch films.

Moreover, stretch films used in stretch wrapping are typically removed from loads by cutting or otherwise forming a vertical slit on the side of a load and removing the film as a multilayered sleeve before being discarded, often by placing the film in a compactor for baling. The used stretch film may be shipped for grinding, cleaning, and extruding into pellets for use in stretch film with recycled content, or for other post-consumer uses. Thus, removed stretch film is generally not in a condition suitable for reuse using current processes.

Some embodiments consistent with the invention, on the other hand, may provide a reusable stretch film system that utilizes a packaging material, e.g., a stretch film, that is capable of being used to secure multiple palletized loads for storage and/or transport over its lifetime. In such embodiments, the amount of elongation applied to the stretch film is specifically controlled to maintain sufficient elasticity in the film for subsequent wrapping cycles. In some embodiments, a reusable stretch film system may use stretch film that is specifically designed for reuse; however, in other embodiments, a reusable stretch film system may use stretch film that is also used in non-reuse applications and/or that otherwise is not specifically designed for reuse, but that retains sufficient elasticity after wrapping for use in subsequent wrapping cycles.

In some embodiments, the reusable stretch film system may also operate as a closed loop system whereby reusable stretch film is wrapped onto a palletized load at a first or source location (e.g., using a stretch wrapping apparatus) to secure the palletized load for storage and/or transport, unwrapped from the palletized load at a second or destination location (e.g., using an unwrapping apparatus), and then transported back to the first location, or alternatively a third location, for use in wrapping a different palletized load. In some embodiments, for example, the unwrapped reusable stretch film may be wound into a roll suitable for installation on a stretch wrapping apparatus, and transported in roll form to a source location.

Figure 2:
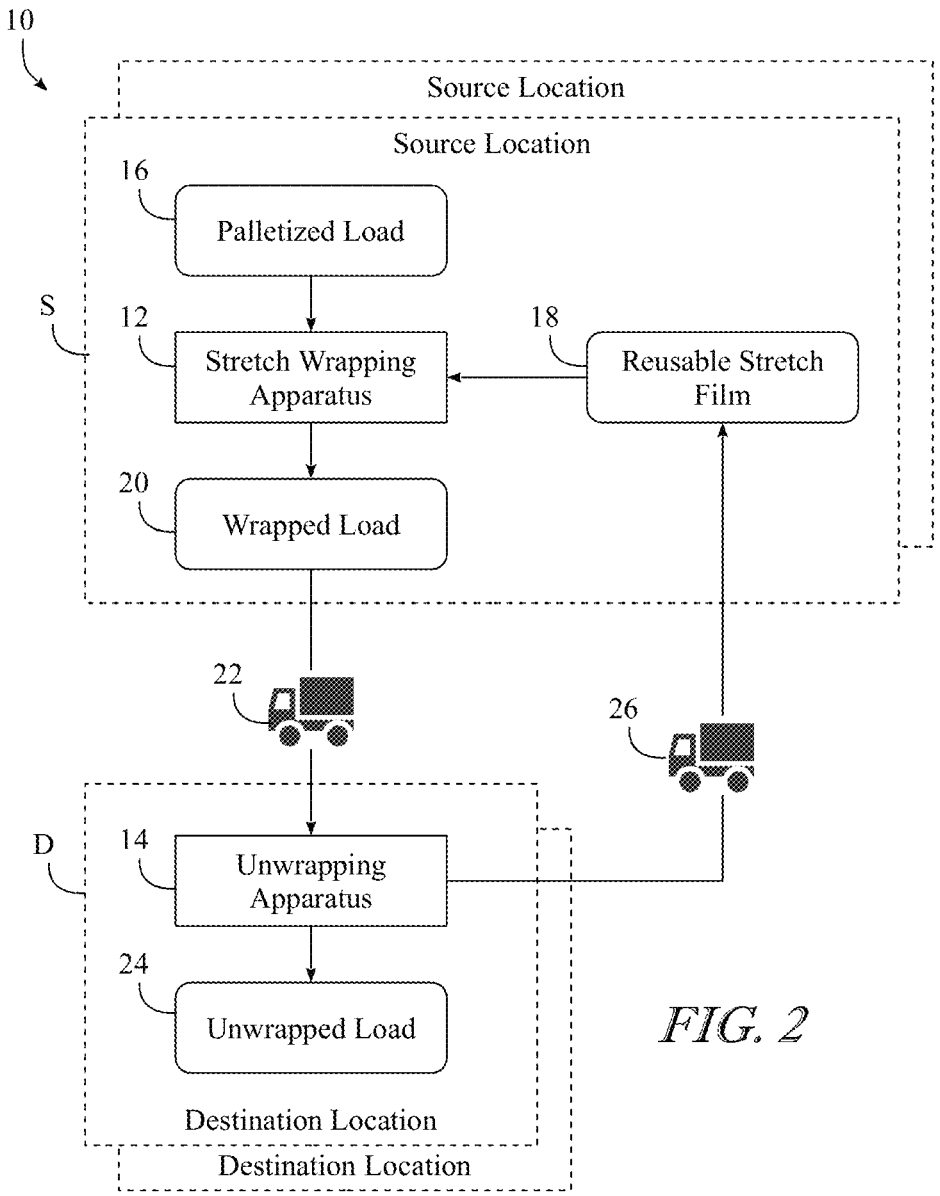
FIG. 2 is a block diagram of a reusable stretch film system consistent with the invention.

FIG. 2, for example, illustrates a reusable stretch film system 10 that includes a stretch wrapping apparatus 12 disposed at a source location S and an unwrapping apparatus 14 disposed at a destination location D. Stretch wrapping apparatus 12 is used to wrap an unwrapped palletized load 16 using a reusable stretch film 18 and thereby generate a wrapped load 20. The wrapped load may then be transported to a destination location D, e.g., via a truck 22, or any other suitable mode of shipping (e.g., plane, train, ship, etc.), whereupon the wrapped load is unwrapped using unwrapping apparatus 14 to generate an unwrapped load 24. The reusable stretch film unwrapped by unwrapping apparatus 14 is likewise transported back to source location S, e.g., via a truck 26, or any other suitable mode of shipping, and used in subsequent wrapping operations.

It will be appreciated that, as illustrated in FIG. 2, reusable stretch film system 10 may incorporate multiple source locations and/or multiple destination locations, as well as multiple stretch wrapping apparatuses and/or multiple unwrapping apparatuses at each location. Moreover, reusable stretch film 18 may be transported between different source and/or destination locations each reuse cycle such that over its lifetime, the reusable stretch film may be wrapped and/or unwrapped by multiple stretch wrapping and/or unwrapping apparatuses distributed at multiple source and/or destination locations. Furthermore, in some embodiments, and as will become more apparent below, reusable stretch film 18 may be cut to different lengths during wrapping and attached during unwrapping to other lengths of reusable stretch film from different rolls, or even from different source locations, such that, for example, a given length of reusable stretch film used to wrap a particular load may include multiple lengths of reusable stretch film originally produced on completely different rolls and from completely different source locations.

In addition, in some embodiments, the reusable stretch film may be incorporated into a stretch film supply roll including multiple lengths of stretch film joined together by lap seals, and may be capable of being utilized to supply stretch film when wrapping subsequent loads in a stretch wrapping apparatus. It will be appreciated that in various embodiments, at least some of the lengths of stretch film incorporated into such a roll may have previously been used to wrap different loads, and that at least some of the lengths of stretch film on such a roll may be formed of different film materials, thicknesses, compositions, and/or constructions, be formed by different manufacturing processes, be manufactured by different manufacturers, and/or have different model numbers or other identifiers. Given, in particular, the distributed nature of a reusable stretch film system, and the potential that different entities may wrap, transport, store, and unwrap loads within such a system, as well as the fact that the loads themselves may be of differing sizes and shapes, a stretch film supply roll utilized in such a system may be expected to incorporate numerous heterogeneous lengths of stretch film in some embodiments. In other embodiments, however, e.g., where fewer entities are participants in a reusable stretch film system, the lengths of stretch film incorporated into a stretch film supply roll may be substantially more homogenous in nature.

Some embodiments consistent with the invention may provide a reusable stretch film usable in a reusable stretch film system as described above. The reusable stretch film in some embodiments may utilize a higher gauge or thickness than current stretch film to provide tougher tear resistance, and desirably may have a stress stain curve shape configured to allow a stretch of at least about 25% without incurring forces higher than a palletized load can tolerate without twisting or crushing. In other embodiments, however, various current stretch films commonly used in non-reuse applications may also be used a reusable stretch film system, in part through wrapping the stretch film in a manner that controls the amount of elongation applied to the stretch film to maintain sufficient elasticity in the film for subsequent wrapping cycles. As such, it will be appreciated that the term "reusable stretch film" may be considered to include stretch films that are specifically configured for reuse applications, as well as stretch films that are not specifically configured for reuse applications and/or that may otherwise be suitable for use in non-reuse applications in addition to reuse applications.

A stretch wrapping apparatus utilized in such a system and with such a film may be configured to controllably elongate the reusable stretch film well below the yield point of the film during wrapping to allow the film to retain elasticity for multiple reuse cycles. Additionally, in some embodiments, the wrapping may be performed without any pre-stretch to minimize strain hardening and thereby extend the number of reuse cycles for the reusable stretch film. In other embodiments, the wrapping may be performed with a relatively low level of pre-stretch that allows for a controlled elongation of the film at the load that is well below the yield point of the film during wrapping.

An unwrapping apparatus utilized in such a system and with such a film may be configured to both unwrap or remove the reusable stretch film from a load and wind the reusable stretch film into a roll form, or otherwise in a condition suitable for reuse on a stretch wrapping apparatus. As will become more apparent below, the reusable stretch film unwrapped from multiple loads may be attached together to form a continuous web of reusable stretch film capable of being used by a stretch wrapping apparatus to wrap multiple loads. In addition, specialized shipping containers, e.g., reusable pallets, may be used in some embodiments to return reusable stretch film to a source location, e.g., to allow for multiple rolls of reusable stretch film to be shipped together and protected from damage during shipping.

Thus, in some embodiments, a reusable stretch film system may include a stretch wrapping apparatus configured to wrap a first load with a stretch film through relative rotation between the first load and a film dispenser about an axis of rotation while generating a controlled elongation of the stretch film at the first load that is substantially below a yield point of the stretch film, and an unwrapping apparatus configured to unwrap the stretch film from the first load for reuse in wrapping a second load. In addition, the stretch wrapping apparatus and unwrapping apparatus may be disposed at different, and geographically separate locations, although the invention is not so limited.

In addition, in some embodiments, a reusable stretch film system may include an unwrapping apparatus including a take up device and configured to unwrap a first load having a stretch film spirally wrapped around the first load by collecting the stretch film with the take up device over a plurality of relative rotations between the first load and the take up device, e.g., by unwrapping the stretch film as a continuous web over the plurality of relative rotations between the first load and the take up device, and a stretch wrapping apparatus configured to wrap a second load with at least a portion of the stretch film unwrapped by the unwrapping apparatus. Further, in some embodiments, a reusable stretch film system may include an unwrapping apparatus including a take up device and configured to unwrap a first load having a first stretch film spirally wrapped around the first load by unwrapping the first stretch film as a first continuous web over a first plurality of relative rotations between the first load and the take up device and wind the first stretch film onto a roll, and to unwrap a second load having a second stretch film spirally wrapped around the second load by unwrapping the second stretch film as a second continuous web over a second plurality of relative rotations between the second load and the take up device and wind the second stretch film onto the roll with the first and second stretch films joined by a lap seal on the roll, and a stretch wrapping apparatus configured to wrap a third load with at least respective first and second portions of the first and second stretch films unwrapped by the unwrapping apparatus.

Further details regarding the various components capable of being used in a reusable stretch film system consistent with the invention are provided below.

Stretch Wrapping Apparatus Configurations

Figure 3:
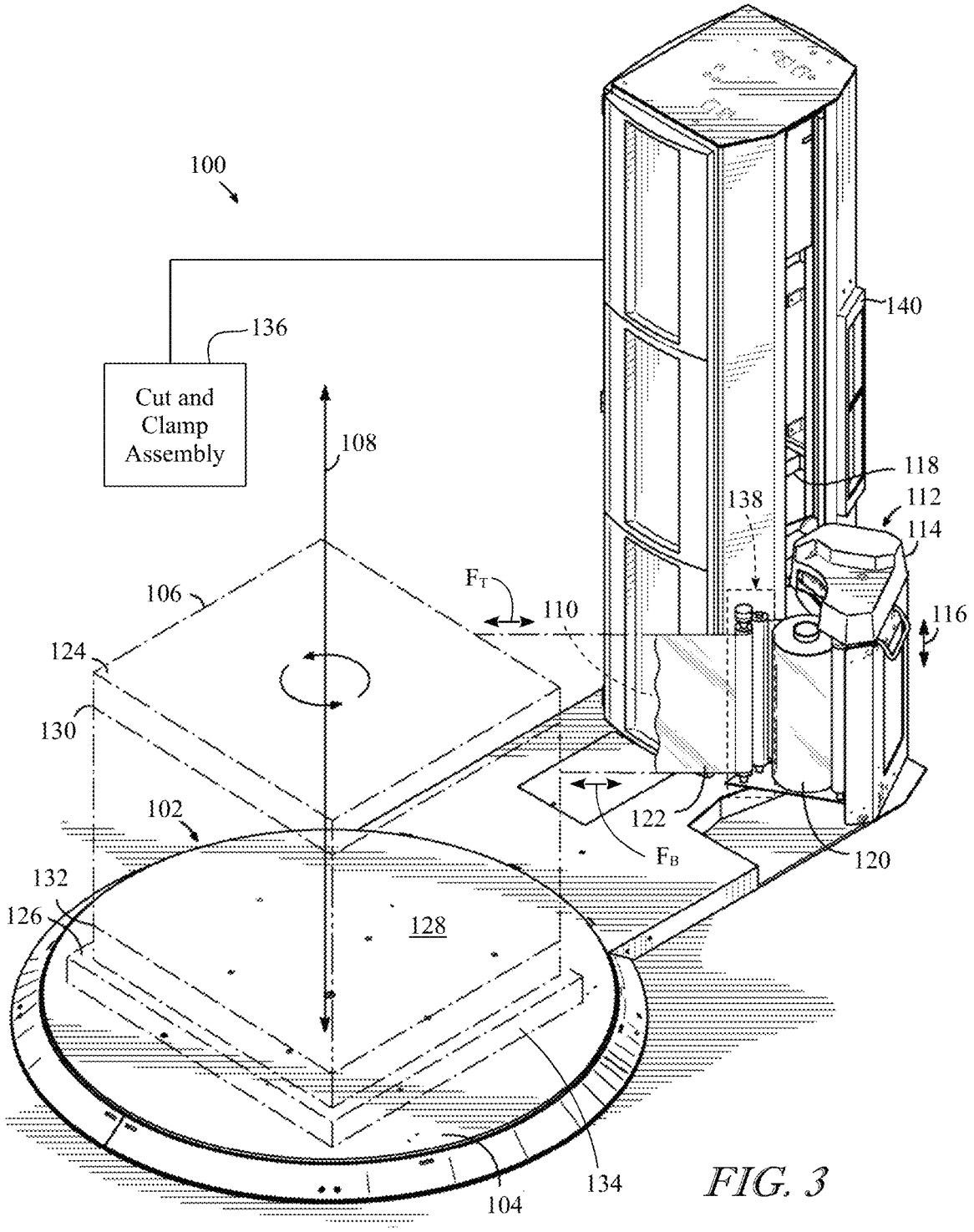
FIG. 3 shows a perspective view of a turntable-type stretch wrapping apparatus suitable for use in a reusable stretch film system consistent with the invention.

Various stretch wrapping apparatus configurations may be used in various embodiments of the invention. For example, FIG. 3 illustrates a turntable-type stretch wrapping apparatus 100 including a load support 102 configured as a rotating turntable 104 for supporting a load 106. Turntable 104 rotates about an axis of rotation 108, e.g., in a counter-clockwise direction as shown in FIG. 3, using a rotational drive 110 including, for example, an electric motor. It will be appreciated that the principles of the invention may be applicable to other types of stretch wrapping apparatus configurations, e.g., rotating arm-type and ring-type configurations, as well as both vertical and horizontal orientations (i.e., where the axis of rotation is substantially vertical or horizontal), so the invention is not limited to a turntable-type stretch wrapping apparatus as illustrated herein.

A packaging material or film dispenser 112, including a roll carriage 114, is configured for movement along a direction 116 by a lift drive 118 which may, for example, include an electric motor. Roll carriage 114 supports a roll 120 of stretch film (which may be usable for reuse and/or non-reuse applications), which during a wrapping operation includes a web 122 extending between dispenser 112 and load 106, with the stretch film moving in a generally downstream direction towards the load. The terms "upstream" and "downstream," as used in this application, are intended to define positions and movement relative to the direction of flow of stretch film as it moves from dispenser 112 to load 106. Movement of an object toward dispenser 112, away from load 106, and thus, against the direction of flow of stretch film, may be defined as "upstream." Similarly, movement of an object away from dispenser 112, toward load 106, and thus, with the flow of the stretch film, may be defined as "downstream."

Direction 116 is generally parallel to an axis about which stretch film is wrapped around load 106, e.g., axis 108, and movement of roll carriage 114, and thus web 122, along direction 116 during a wrapping operation enables stretch film to be wrapped spirally around the load, e.g., within a contiguous region between a top 124 and bottom 126 of load 106, e.g., region 128 between positions 130, 132 as illustrated in FIG. 3. In some instances, the load 106 may also be considered to include a pallet 134 upon which the load is disposed, so the contiguous region may therefore optionally include at least a portion of the pallet in some embodiments. Spiral wrapping may be considered to be any form of stretch film wrapping in which the stretch film is wrapped spirally or helically around the load over multiple relative rotations between a film dispenser and a load, where during at least a portion of the wrapping process, the position of the stretch film along a direction substantially parallel to the axis of rotation changes, thereby enabling a stretch film having a width that is less than the dimension of the load along the axis of rotation to cover an region of the load that is greater than the width of the stretch film.

Stretch wrapping apparatus 100 may also include a cut and clamp assembly 136, which may be used to attach a leading edge of web 122 to load 106 at the beginning of a wrapping cycle, and at the end of the wrapping cycle, cut web 122, position a tail of stretch film extending from the load and formed by the cut against the side of the load, and hold the leading edge of web 122 to prepare stretch wrapping apparatus 100 for a next wrapping cycle. Assembly 136 may be omitted in some embodiments, and in some embodiments various operations may be performed to treat the tail to improve the appearance and/or improve the adhesion of the tail against the side of the load, e.g., through the use of mechanical wipers, forced air, etc. Cutting may also be performed in some embodiments via a mechanical or via hot wire cutter. The components of assembly 136 may also be designed to accommodate heavier gauges of stretch film if so desired.

In addition, in some embodiments cut and clamp assembly 136 may also be configured to treat, print, mark, and/or fold the tail to facilitate identification of the tail during unwrapping and/or to facilitate separation of the tail from the load during unwrapping.

Within the context of wrapping reusable stretch film, stretch wrapping apparatus 100 may also incorporate a number of different modifications as compared to a stretch wrapping apparatus used for non-reuse applications. For example, the film roll unwind shaft of dispenser 112 may be adapted for rotation of a larger film roll and may be further adapted for a coreless film roll of returned stretch film in some embodiments. In addition, no pre-stretch assembly may be used in dispenser 112, or alternatively, if a pre-stretch assembly is used (optionally illustrated at 138), a substantially lower level of pre-stretch may be used. A torque/braking system or a drive motor utilizing at least one coated roller may be used in dispenser 112 for tensioning and/or tracking, and the control of the dispense rate of dispenser 112 may be configured to maintain elongation while wrapping below the yield point of the stretch film to ensure multiple reuse cycles for the stretch film, e.g., by maintaining an overall elongation at the load of below about 25 percent in some embodiments, and below about 10 percent or even about 5 percent in some embodiments.

Control of the position of roll carriage 114 by lift drive 118, as well as of the other drives in stretch wrapping apparatus 100 such as rotational drive 110, is provided by a controller 140, which in the embodiment illustrated in FIG. 3 is a local controller that is physically co-located with rotational drive 110 and lift drive 118. Controller 140 may include hardware components and/or software program code that allow it to receive, process, and transmit data. It is contemplated that controller 140 may be implemented as a programmable logic controller (PLC), or may otherwise operate similar to a processor in a computer system. Controller 140 may communicate with an operator interface, e.g., a display or screen and controls that provide an operator with a way to monitor, program, and operate stretch wrapping apparatus 100. Controller 140 may also communicate with one or more sensors to allow controller 140 to receive feedback and/or performance-related data during wrapping, such as roller and/or drive rotation speeds, load dimensional data, etc.

For the purposes of the invention, controller 140 may represent practically any type of computer, computer system, controller, logic controller, or other programmable electronic device, and may in some embodiments be implemented using one or more networked computers or other electronic devices, whether located locally or remotely with respect to the various drives 110, 118 of stretch wrapping apparatus 100. Controller 140 typically includes a central processing unit including at least one microprocessor coupled to a memory, which may represent the random access memory (RAM) devices comprising the main storage of controller 140, as well as any supplemental levels of memory, e.g., cache memories, non-volatile or backup memories (e.g., programmable or flash memories), read-only memories, etc. In addition, the memory may be considered to include memory storage physically located elsewhere in controller 140, e.g., any cache memory in a processor, as well as any storage capacity used as a virtual memory, e.g., as stored on a mass storage device or on another computer or electronic device coupled to controller 140. Controller 140 may also include one or more mass storage devices, e.g., a floppy or other removable disk drive, a hard disk drive, a direct access storage device (DASD), an optical drive (e.g., a CD drive, a DVD drive, etc.), and/or a tape drive, among others. Furthermore, controller 140 may include an interface with one or more networks (e.g., a LAN, a WAN, a wireless network, and/or the Internet, among others) to permit the communication of information to the components in stretch wrapping apparatus 100 as well as with other computers and electronic devices, e.g. computers such as a desktop computer or laptop computer, mobile devices such as a mobile phone or tablet, multi-user computers such as servers or cloud resources, etc. Controller 140 operates under the control of an operating system, kernel and/or firmware and executes or otherwise relies upon various computer software applications, components, programs, objects, modules, data structures, etc. Moreover, various applications, components, programs, objects, modules, etc. may also execute on one or more processors in another computer coupled to controller 140, e.g., in a distributed or client-server computing environment, whereby the processing required to implement the functions of a computer program may be allocated to multiple computers over a network.

In general, the routines executed to implement the embodiments of the invention, whether implemented as part of an operating system or a specific application, component, program, object, module, or sequence of instructions, or even a subset thereof, will be referred to herein as "computer program code," or simply "program code." Program code typically comprises one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning controllers, computers and computer systems, those skilled in the art will appreciate that the various embodiments of the invention are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by controller 140. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

Various program code described hereinafter may be identified based upon the application within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

In the discussion hereinafter, the hardware and software used to control stretch wrapping apparatus 100 is assumed to be incorporated wholly within components that are local to stretch wrapping apparatus 100 illustrated in FIG. 3. It will be appreciated, however, that in other embodiments, at least a portion of the functionality incorporated into a stretch wrapping apparatus may be implemented in hardware and/or software that is external to the aforementioned components. For example, in some embodiments, some user interaction may be performed using an external device such as a networked computer or mobile device, with the external device converting user or other input into control variables that are used to control a wrapping operation. In other embodiments, user interaction may be implemented using a web-type interface, and the conversion of user input may be performed by a server or a local controller for the stretch wrapping apparatus, and thus external to a networked computer or mobile device. In still other embodiments, a central server may be coupled to multiple wrapping stations to control the wrapping of loads at the different stations. As such, the operations of receiving user or other input, converting the input into control variables for controlling a wrapping operation, initiating and implementing a wrapping operation based upon the control variables, providing feedback to a user, etc., may be implemented by various local and/or remote components and combinations thereof in different embodiments. In some embodiments, for example, an external device such as a mobile device, a networked computer, a server, a cloud service, etc. may generate a wrap model that defines the control variables for controlling a wrapping operation for a particular load, and that wrap model may then be communicated to a stretch wrapping apparatus and used by a controller therefor to control a dispense rate during a wrapping operation. As such, the invention is not limited to the particular allocation of functionality described herein.

It will be appreciated that the variations described above for controller 140 may also apply to other types of controllers discussed herein, e.g., controllers used for other stretch wrapping apparatuses, for the various unwrapping apparatuses discussed herein, etc.

Figure 4:
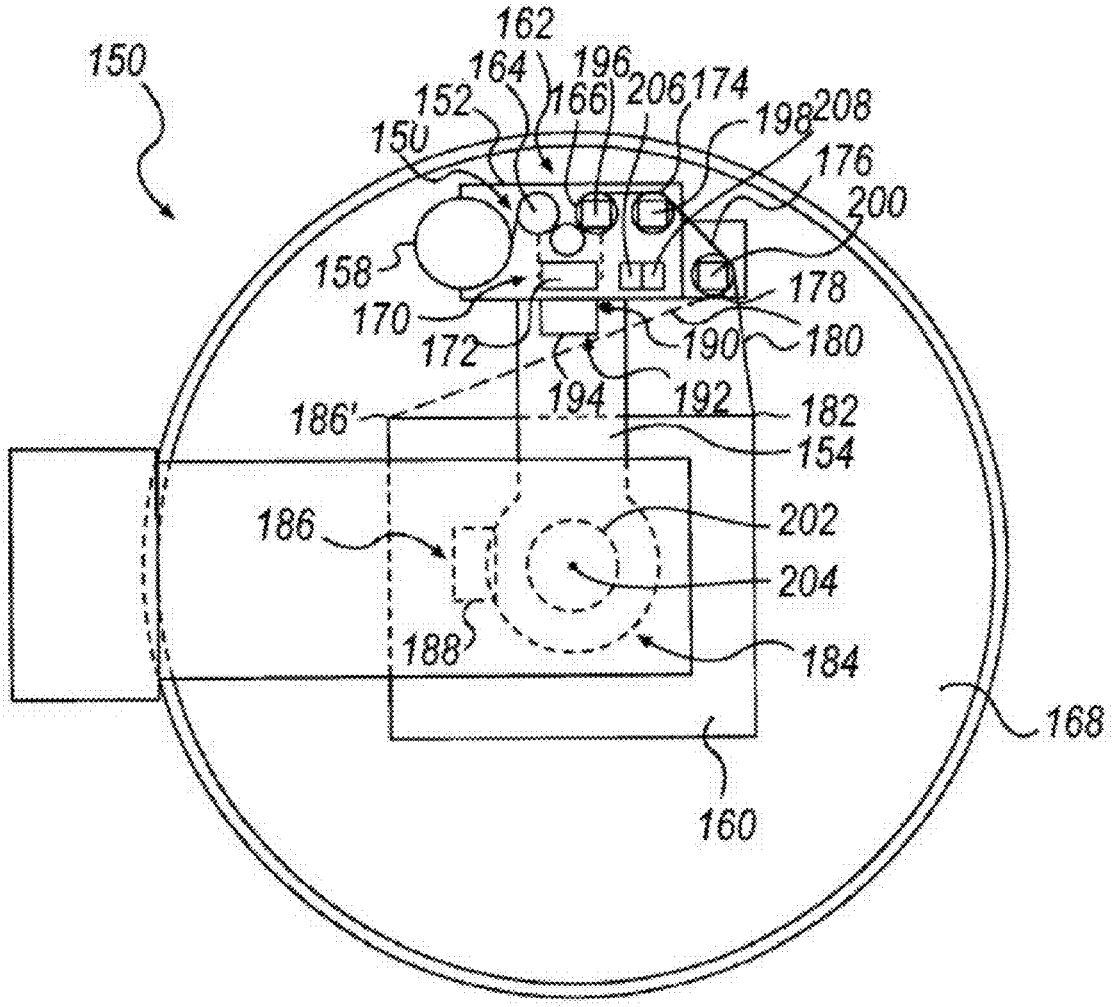
FIG. 4 shows a top view of a rotating arm-type wrapping apparatus suitable for use in a reusable stretch film system consistent with the invention.

Other stretch wrapping apparatus configurations may be used in other embodiments, so the invention is not limited to the specific configurations discussed herein. As noted above, for example, other types of stretch wrapping apparatus configurations may be used. FIG. 4, for example, illustrates a rotating arm-type stretch wrapping apparatus 150, which includes a roll carriage or elevator 152 mounted on a rotating arm 154. Roll carriage 152 may include a packaging material or film dispenser 156 configured to dispense stretch film 158 as rotating arm 154 rotates relative to a load 160 to be wrapped. Film dispenser 156 may include a pre-stretch assembly 162 configured to pre-stretch stretch film before it is applied to load 160 if pre-stretching is desired, or to dispense stretch film to load 160 without pre-stretching. Pre-stretch assembly 162 may include at least one stretch film dispensing roller, including, for example, an upstream dispensing roller 164 and a downstream dispensing roller 166. It is contemplated that pre-stretch assembly 162 may include various configurations and numbers of pre-stretch rollers, drive or driven roller and idle rollers without departing from the spirit and scope of the invention.

A film drive system 170, including, for example, an electric motor 172, may be used to drive dispensing rollers 164 and 166 of pre-stretch assembly 162. For example, electric motor 172 may rotate downstream dispensing roller 166. Downstream dispensing roller 166 may be operatively coupled to upstream dispensing roller 164 by a chain and sprocket assembly, such that upstream dispensing roller 164 may be driven in rotation by downstream dispensing roller 166. Other connections may be used to drive upstream roller 164 or, alternatively, a separate drive (not shown) may be provided to drive upstream roller 164. Moreover, in some embodiments the roll of stretch film 158 may be undriven and may rotate freely, while in other embodiments the roll may be driven, e.g., by biasing a surface of the roll against upstream dispensing roller 164 or another driven roller, or by driving the roll directly. In various embodiments therefore, the amount of pre-stretch applied to the film by pre-stretch assembly 162 may be controlled and/or varied in a number of different manners, and that in some embodiments, a pre-stretch assembly may be configured to supply a fixed amount of pre-stretch for all loads.

Downstream of downstream dispensing roller 166 may be provided one or more idle rollers 174, 176 that redirect the web of stretch film, with the most downstream idle roller 176 effectively providing an exit point 178 from film dispenser 152, such that a portion 180 of stretch film 158 extends between exit point 178 and a contact point 182 where the stretch film engages load 160 (or alternatively contact point 182' if load 160 is rotated in a counter-clockwise direction) while load 160 is supported on a support surface 168.

Wrapping apparatus 150 also includes a relative rotation assembly 184 configured to rotate rotating arm 154, and thus, film dispenser 156 mounted thereon, relative to load 160 as load 160 is supported on load support surface 168. Relative rotation assembly 184 may include a rotational drive system 186, including, for example, an electric motor 188. It is contemplated that rotational drive system 186 and film drive system 170 may run independently of one another. Thus, rotation of dispensing rollers 164 and 166 may be independent of the relative rotation of film dispenser 156 relative to load 160. This independence allows a length of stretch film 158 to be dispensed per a portion of relative rotation that is neither predetermined nor constant. Rather, the length may be adjusted periodically or continuously based on changing conditions. In other embodiments, however, film dispenser 156 may be driven proportionally to the relative rotation, or alternatively, tension in the stretch film extending between the film dispenser and the load may be used to drive the film dispenser.

Wrapping apparatus 150 may further include a lift assembly 190. Lift assembly 190 may be powered by a lift drive system 192, including, for example, an electric motor 194, that may be configured to move roll carriage 152 vertically relative to load 160. Lift drive system 192 may drive roll carriage 152, and thus film dispenser 156, generally in a direction parallel to an axis of rotation between the film dispenser 156 and load 160 and load support surface 168. For example, for wrapping apparatus 150, lift drive system 192 may drive roll carriage 152 and film dispenser 156 upwards and downwards vertically on rotating arm 154 while roll carriage 152 and film dispenser 156 are rotated about load 160 by rotational drive system 186, to wrap stretch film spirally about load 160.

One or more of downstream dispensing roller 166, idle roller 174 and idle roller 176 may include a corresponding sensor 196, 198, 200 to monitor rotation of the respective roller. In particular, rollers 166, 174 and/or 176, and/or stretch film 158 dispensed thereby, may be used to monitor a dispense rate of film dispenser 156, e.g., by monitoring the rotational speed of rollers 166, 174 and/or 176, the number of rotations undergone by such rollers, the amount and/or speed of stretch film dispensed by such rollers, and/or one or more performance parameters indicative of the operating state of film drive system 170, including, for example, a speed of stretch film drive system 170. The monitored characteristics may also provide an indication of the amount of stretch film 158 being dispensed and wrapped onto load 160. In addition, in some embodiments a sensor, e.g., sensor 198 or 200, may be used to detect a break in the stretch film.

Wrapping apparatus may also include an angle sensor 202 for determining an angular relationship between load 160 and film dispenser 156 about an axis of rotation 204. Angle sensor 202 may be implemented, for example, as a rotary encoder, or alternatively, using any number of alternate sensors or sensor arrays capable of providing an indication of the angular relationship and distinguishing from among multiple angles throughout the relative rotation, e.g., an array of proximity switches, optical encoders, magnetic encoders, electrical sensors, mechanical sensors, photodetectors, motion sensors, etc. The angular relationship may be represented in some embodiments in terms of degrees or fractions of degrees, while in other embodiments a lower resolution may be adequate. It will also be appreciated that an angle sensor consistent with the invention may also be disposed in other locations on wrapping apparatus 150, e.g., about the periphery or mounted on arm 154 or roll carriage 152. In addition, in some embodiments angular relationship may be represented and/or measured in units of time, based upon a known rotational speed of the load relative to the film dispenser, from which a time to complete a full revolution may be derived such that segments of the revolution time would correspond to particular angular relationships. Other sensors may also be used to determine the height and/or other dimensions of a load, among other information.

Additional sensors, such as a load distance sensor 206 and/or a film angle sensor 208, may also be provided on wrapping apparatus 150. Load distance sensor 206 may be used to measure a distance from a reference point to a surface of load 160 as the load rotates relative to film dispenser 156 and thereby determine a cross-sectional dimension of the load at a predetermined angular position relative to the film dispenser. In one embodiment, load distance sensor 206 measures distance along a radial from axis of rotation 204, and based on the known, fixed distance between the sensor and the axis of rotation, the dimension of the load may be determined by subtracting the sensed distance from this fixed distance. Sensor 206 may be implemented using various types of distance sensors, e.g., a photoeye, proximity detector, laser distance measurer, ultrasonic distance measurer, electronic rangefinder, and/or any other suitable distance measuring device.

Film angle sensor 208 may be used to determine a film angle for portion 180 of stretch film 158, which may be relative, for example, to a radial (not shown in FIG. 4) extending from axis of rotation 204 to exit point 178 (although other reference lines may be used in the alternative). In one embodiment, film angle sensor 208 may be implemented using a distance sensor, e.g., a photoeye, proximity detector, laser distance measurer, ultrasonic distance measurer, electronic rangefinder, and/or any other suitable distance measuring device. In other embodiments, film angle sensor 208 may be implemented mechanically, e.g., using a cantilevered or rockered follower arm having a free end that rides along the surface of portion 180 of stretch film 158 such that movement of the follower arm tracks movement of the stretch film. In still other embodiments, a film angle sensor may be implemented by a force sensor that senses force changes resulting from movement of portion 180 through a range of film angles, or a sensor array (e.g., an image sensor) that is positioned above or below the plane of portion 180 to sense an edge of the stretch film. In other embodiments, some or all of sensors 196, 198, 200, 202, 206, 208 may be omitted.

Control over the dispense rate of stretch film may be controlled using various techniques, including various metered film delivery techniques. Such techniques may be based on a tension or force feedback, monitoring of a dispense rate, e.g., via the speed of an idle roller, based on dispensing a predetermined length of film over a predetermined portion of relative rotation, based on the geometric relationship between the film dispenser and the load and/or the corners thereof during relative rotation, or using various combinations thereof. Other film dispense rate control techniques may be used in the alternative, as will be appreciated by those of ordinary skill in the art having the benefit of the instant disclosure.

Wrapping of Stretch Film for Reuse

In some embodiments consistent with the invention, a load may be wrapped with stretch film in a manner that allows for reuse of the stretch film for wrapping other loads, and to do so in a manner that in some embodiments may additionally provide cost and/or environmental benefits over conventional stretch wrapping approaches. In particular, in some embodiments, a controlled elongation of a stretch film may be generated during a wrapping operation that is well below the yield point of the stretch film, thereby enabling the stretch film to retain a substantial portion of its elasticity once unwound later from a load. As will become more apparent below, this controlled elongation may be implemented using controlled pre-stretch, controlled payout or dispense rate, or a combination of both. Moreover, it will be appreciated that controlled elongation incorporates at least some elongation of the stretch film, such that a controlled elongation of the stretch film well below the yield point of the stretch film still requires some degree of elongation to be performed.

It will be appreciated that conventional stretch wrapping has traditionally focused on directly or indirectly controlling the wrap force used to wrap a load with stretch film, which generally refers to a metric or parameter that may be used to control how tight the stretch film is pulled around a load at a given instant. Wrap force, as such, may be based on the amount of tension induced in a web of stretch film extending between the film dispenser and the load, which in some instances may be measured and controlled directly, e.g., through the use of an electronic load cell coupled to a roller over which the film passes, a spring-loaded dancer interconnected with a sensor, a torque control device, or any other suitable sensor capable of measuring force or tension in a web of stretch film.

On the other hand, because the amount of tension that is induced in a web of stretch film is fundamentally based upon the relationship between the dispense rate of the stretch film and the rate of relative rotation of the load (i.e., the demand rate of the load), wrap force may also refer to various metrics or parameters related to the rate at which the packaging material is dispensed by a film dispenser, which in combination with the relative rate of rotation between the film dispenser and the load, effectively controls the amount of tension in the web of stretch film extending between the film dispenser and the load.

For example, a payout percentage, which relates the rate at which the stretch film is dispensed by the film dispenser to the rate at which the load is rotated relative to the film dispenser, may be a suitable wrap force parameter. In some instances, for example, payout percentage may be represented using a percentage value that compares the amount of stretch film dispensed during one relative rotation around a load vs. the girth of the load, with 100% representing a dispense rate that provides a length of stretch film that is equal to the girth of the load. A value less than 100% means that less stretch film is dispensed during a relative rotation, resulting in higher wrap force and tighter wrap, and a value greater than 100% means that more stretch film is dispensed during a relative rotation, resulting in lower wrap force and looser wrap.

Alternatively, a dispense rate, e.g., in terms of the absolute or relative linear rate at which stretch film exits a film dispenser, or the absolute or relative rotational rate at which an idle or driven roller in the film dispenser or otherwise engaging the stretch film rotates, may also be a suitable wrap force parameter. As another example, the effective circumference or other geometric characteristics of a load may be used to dynamically control the rate at which stretch film is dispensed to a load.

In some embodiments consistent with the invention, however, control over the amount of elongation applied to a stretch film may be used in lieu of or in addition to control over wrap force in order to wrap the load in a manner that preserves a substantial portion of the elasticity of the stretch film for use in wrapping subsequent loads. Specifically, by controlling the elongation, or amount of stretch, applied to a stretch film to be well below the yield point of the stretch film, a substantial portion of the elasticity is retained by the stretch film after wrapping a load, as well as after unwrapping the load and winding the used stretch film onto a roll or core, such that the stretch film is suitable for reuse in connection with wrapping one or more subsequent loads.

It will be appreciated that stretch films initially deform elastically in response to an elongation force; however, as the elongation force increases, the deformation transitions to plastic deformation in which permanent deformation or elongation occurs. The point at which deformation or elongation transitions from elastic to plastic is generally referred to as the yield point. Nonetheless, the relationship between elasticity and plasticity in stretch films is not purely binary, and elongation of a stretch film below its yield point can still induce some degree of permanent elongation in the stretch film. For the purposes of this disclosure, the term "elasticity recovery" may be considered in some instances to represent the amount of the recovered length of a stretch film when a force is released after stretching, over its incremental length stretched.

It has been found, in particular, that as stretch film experiences elongation within a stretch wrapper it follows a particular stress strain curve, which can be somewhat different within the pre-stretch zone between the pre-stretch rollers compared to between the film delivery system and the load. As illustrated in FIG. 1, these curves generally have in common a relatively straight vertical portion, followed by a curve from vertical to horizontal, and then followed by a relatively horizontal curve to a final upturn before film break. When the force on the film is released, it experiences differing degrees of recovery. If released during most of the initial relatively straight vertical portion, the film remains substantially elastic and a majority of the elongation is recovered; however, as the stretch level is increased into the curved portion and towards the yield point (YP), a substantial but lesser amount of elongation is recovered. Further elongation into the relatively horizontal curve renders the film substantially inelastic, with little or no recovery of the elongation. Recovery in this zone retains some elasticity for the purposes of load containment, but generally does not provide sufficient elasticity for subsequent reuse in wrapping a different load. In addition, many plastics such as polyethylene can experience a second change when stretched repeatedly, which is generally referred as "strain hardening," and which typically results in an increase film modulus and a resulting increase in the force required to further stretch the film.

Thus, as the stress moves up the stress strain curve to the yield point, the elasticity is generally reduced and there is some amount of strain hardening even before the technical yield point. With some films, for example, it has been found that after about 50-90% elongation (i.e., stretching the film about 50-90% beyond its original length), the film becomes predominately inelastic, while still retaining some substantial elasticity.

Figure 5:
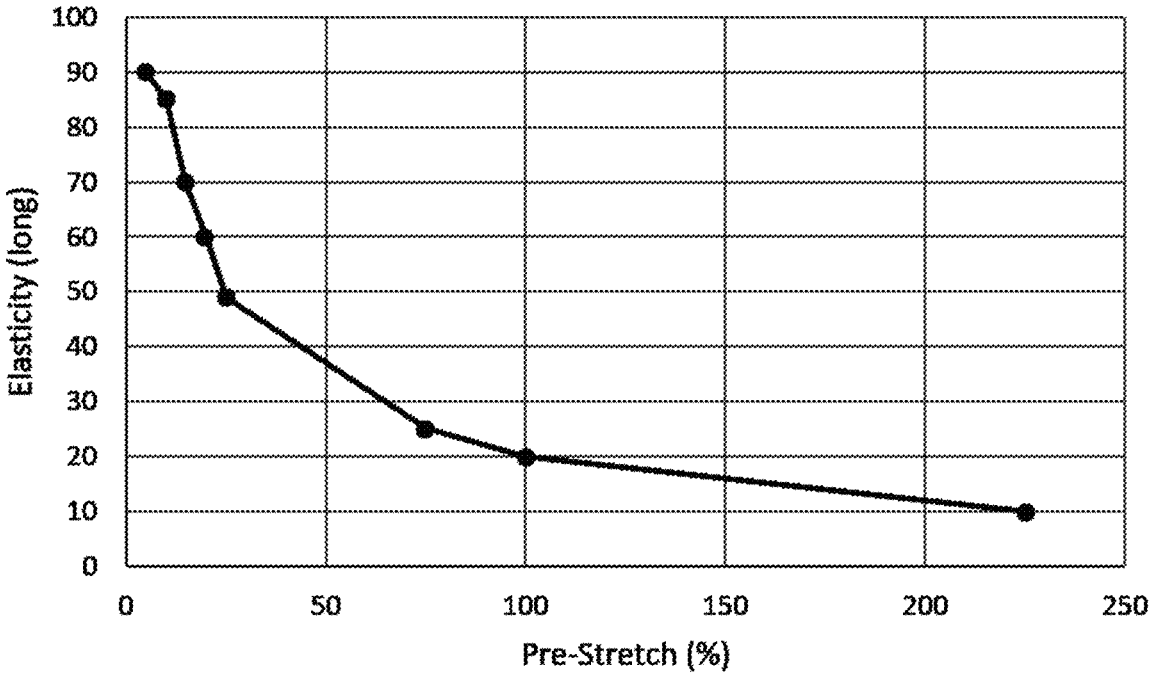
FIG. 5 is a graph of elasticity recovery for different amounts of pre-stretch for an example stretch film suitable for use in a reusable stretch film system consistent with the invention.

FIG. 5, as another example, illustrates a graph of elasticity recovery in an example 50 gauge stretch film subject to different stretch amounts. In this specific example, the amount of pre-stretch used to stretch the stretch film is used on the x-axis, with the assumption being that a payout percentage of 100% is used such that no additional stretch is applied after the pre-stretch assembly. The y-axis is an elasticity recovery represented as a percent, which is the percent of the original elongation of the stretch film that is recovered when force is released from the stretch film after elongation. It should be noted that at a pre-stretch level of about 25% and beyond, over half of the elasticity of the stretch film is lost, which typically renders the stretch film unsuitable for use in a subsequent wrapping operation because pre-stretch at the same level on a subsequent wrapping operation could potentially result in a film break as the combined elongation of the two wrapping operations would exceed the limits of the stretch film, as will be discussed in greater detail below. However, below about 25% pre-stretch, it may be seen that the elasticity recovery rises relatively quickly to about 90%, with pre-stretch levels of about 5% to about 10% resulting in an elasticity recovery exceeding about 85%.

The effects of elongation and recovery after elongation on stretch film intended for reuse may further be understood by considering the concepts of Total Stretch on Load (TSOL) and Incremental Stretch on Load (ISOL). In the context of the present disclosure, TSOL generally refers to the total elongation applied to a stretch film when wrapping a load, generally expressed in terms of a percentage. From the perspective of single use stretch film using a stretch wrapping apparatus incorporating pre-stretch, for example, TSOL represents the total stretch applied to the stretch film based on the amount of pre-stretch and the amount of stretch induced via the dispense rate (referred to herein as "post-stretch" or "payout"). Thus, for example, where dispense rate is controlled in terms of payout percentage, TSOL may be represented as follows:

$$TSOL = \left[\left(\frac{100+PS}{100}\right)\times\left(2-\frac{PO}{100}\right)-1\right]\times 100 \tag{1}$$

where PS is pre-stretch percentage and PO is payout percentage, i.e., the length of pre-stretched film applied to the load relative to girth (the overall perimeter length of the load), which is typically represented as a percentage that is typically between about 90% and about 120%. Similarly, the elongation in the stretch film resulting from wrapping based upon the aforementioned parameters may be represented as follows:

$$L_{nr} = \left(\frac{TSOL}{100}+1\right)\times L_i \tag{2}$$

where $L_{nr}$ is the non-recovered instantaneous stretched length and $L_i$ is the initial length. As a result, assuming an initial length $L_i$=5 inches, where wrapping is performed using 0% pre-stretch and 100% payout percentage, the TSOL=0% and the non-recovered instantaneous stretched length $L_{nr}$=5 inches. In the context of a typical single use wrapping operation, where wrapping is performed using 250% pre-stretch and 96% payout percentage, the TSOL=264% and the non-recovered instantaneous stretched length $L_{nr}$=18.2 inches. In contrast, in the context of a wrapping operation more suited for reuse, where wrapping is performed with 10% pre-stretch and 102% payout percentage, the TSOL=7.8% and the non-recovered instantaneous stretched length $L_{nr}$=5.39 inches.

ISOL in the context of this disclosure generally refers to the amount of additional stretch or elongation that is placed on a stretch film in a particular reuse cycle (i.e., wrapping, unwrapping, and recovery). When stretch film is reclaimed by winding for reuse, plastic deformation accumulates with each reuse cycle, and incrementally adds to the TSOL. In some embodiments, for example, ISOL may be calculated as follows:

$$ISOL = TSOL\times\left(1-\frac{E_r}{100}\right) \tag{3}$$

where $E_r$ is the elasticity recovery, which is the amount of length recovered within a stretch and rewind cycle, and which may be calculated as follows in some embodiments:

$$E_r = \left(2-\frac{L_r}{L_i}\right)\times 100 \tag{4}$$

where $L_r$ is the recovered length and $L_i$ is the initial unstretched length. The recovered length, in this regard, may be measured after the stretch film is removed from a load or test apparatus and allowed to elastically recover. The ratio of the recovered length to the initial length is subtracted from 2 to describe a full elasticity recovery as 100%; however, in other embodiments, other formulas may be used, as it will be appreciated that where $L_r/L_i>2$ (which in some embodiments may be greater than is acceptable for film reuse), a negative value will result for $E_r$. In other embodiments, for example, elasticity recovery may be calculated as follows:

$$E_r = \frac{L_i}{L_f}\times 100 \tag{5}$$

where $L_f$ is the final length after recovery.

For example, assuming that a stretch film is wrapped using 10% pre-stretch and 100% payout percentage, the TSOL would be 10%. Further, assuming that the stretch film after removal and recovery had an elasticity recovery of 90%, the ISOL would be 1%. As another example, assuming that a stretch film is wrapped using 15% pre-stretch and 98% payout percentage, the TSOL would be 17.3%. Further, assuming that the stretch film after removal and recovery had an elasticity recovery of 80% (which would be expected given the higher pre-stretch and tension to the load), the ISOL would be 3.5%.

It should be appreciated that it may also be assumed that the stretch film's elasticity will gradually be lost with each reuse, so the ISOL may gradually increase for some stretch films with each subsequent use. ISOL, for the purposes of this disclosure, assumes that the stretch film is allowed to recover some of its elastic elongation during rewinding but still retains some of its original inelastic elongation. Thus, as stretch film elongation moves upward, a larger portion of its original elongation remains, leaving less elasticity for subsequent wrapping operations. Furthermore, an upward shift of the stress strain curve for a particular stretch film will occur with each subsequent reuse due to strain hardening in the film. The upward shift in the stress-strain curve results in an upward shift in the wrap force at the same elongation, eventually leading to a wrap force that is likely to result in a film break. Further, as a practical matter, the TSOL may also be impacted by the amount of elastic elongation that is released during the collection/unwinding of the stretch film from the wrapped load, since collection/unwinding of the stretch film may be performed under tension such that not all of the elastic elongation may be removed when the stretch film is removed from the load.

TSOL in the context of this disclosure may also refer to the cumulative effect of all of the reuse cycles, which then relates to an elongation limit for the stretch film where a significant risk of a film break is introduced, typically due to the relatively increased force required for further elongation of the stretch film. It has been found that the ultimate limit of reuse for a stretch film in some embodiments may be largely predictable by understanding when the accumulated elongation represented by the TSOL reaches a point where a film break would be expected when wrapping a load in a single use.

In some embodiments, for example, the number of reuse cycles may be predicted for a stretch film based at least in part on when the TSOL is predicted to reach the yield point of the stretch film. In other embodiments, the number of reuse cycles may be predicted for a stretch film based at least in part on the monitored wrap force, as when a reusable stretch film is used in multiple wrapping operations while substantial elasticity remains in the film, the monitored wrap force during wrapping will remain relatively constant over each wrapping operation. As the stretch film loses sufficient elasticity, however, the monitored wrap force will increase relatively rapidly, which signals the existence of both an increased risk of a film break, and an increased risk of crushing or twisting the load.

It will be appreciated that the limit of reuse cycles for a particular stretch film may be impacted by a number of factors, including the ISOL added with each wrapping operation, the elasticity recovery remaining, the production process of the stretch film (e.g., cast vs. blown), the process controls during each wrapping operation, the film recipe, and the quality of the collected stretch film after each wrapping operation. In addition, ISOL may increase with subsequent wrapping operations for the reasons mentioned above, even when wrapping using the same wrapping parameters.

For example, if the ISOL is known (and for the purposes of this discussion, assuming that the ISOL is the same for each reuse cycle), the overall TSOL after n cycles can be calculated as follows:

$$TSOL_n = 100 \times \left[\left(1 + \frac{ISOL}{100}\right)^n - 1\right] \tag{6}$$

In single use applications, it has been found that a typical stretch film is capable of reliably accommodating a maximum of about 250% TSOL, and that about 350% TSOL a substantial risk of a film break exists. It is believed that carbon neutrality may be achieved for many stretch films after about 4 reuse cycles, and as such, it may be desirable to utilize wrapping parameters that provide an ISOL in which the accumulated TSOL is below about 250%, and in some embodiments, is below about 25% (e.g., about 10 to about 25% in some embodiments) after at least 4 reuse cycles (or alternatively after x reuse cycles, where x=the desired number of reuse cycles to be supported).

It will be appreciated that the number of cycles available for reuse may be impacted by the pre-stretch and payout percentage amounts selected for a particular film, and it has been found that the selection of a relatively low ISOL (e.g., about 10% or under, which may be obtained, for example, using about 5% to about 10% pre-stretch and about 100% payout percentage, or using other combinations of wrapping parameters) may permit 20 or more reuse cycles with some stretch films, including some stretch films that are conventionally used in single use applications.

As such, in some embodiments, the number of reuse cycles may be heavily dependent on the ISOL for each reuse cycle, such that, for example, when the stretch film is allowed to fully recover its elasticity with each reuse and with an ISOL of 2%, the TSOL after 10 reuse cycles would be about 21.9% and after 15 reuse cycles about be about 34.6%, which indicates that even after 15 reuse cycles, the stretch film would still be well below the structural limits of the stretch film, such that the stretch film may still be usable for additional reuse cycles. On the other hand, with an ISOL of 15%, the TSOL after 10 reuse cycles would be about 305% and after 15 reuse cycles would be about 714%, indicating that the stretch film would likely break well before 15 reuse cycles.

In some embodiments, it may also be desirable to print markings or information on the surface of the stretch film, e.g., during manufacture, to effectively provide a cumulative stress gauge that allows measurement of the cumulative elongation experienced by the stretch film over its lifetime, and to determine if and when the stretch film has reached its end of life due to TSOL or excessive strain hardening. In some embodiments, for example, a ruler or guide with a fixed distance (e.g., 10 inches) may be printed on the stretch film prior to initial use, such that future measurements of the ruler or guide may be compared to the original distance to measure the percentage of elongation in the film in an unstretched state. The ruler or guide may also be measured on a wrapped load to indicate the amount of elongation applied to the film when on the load. Additional information may also be printed on a stretch film in other embodiments, e.g., instructions for proper use, or to simply indicate that the stretch film is suitable for use in reuse applications. Moreover, it may be desirable in some embodiments to print, paint, or otherwise mark the ending tail of stretch film when cut and affixed to the side of a load, to assist with later identification of the tail during an unwrapping operation.

Figure 6:
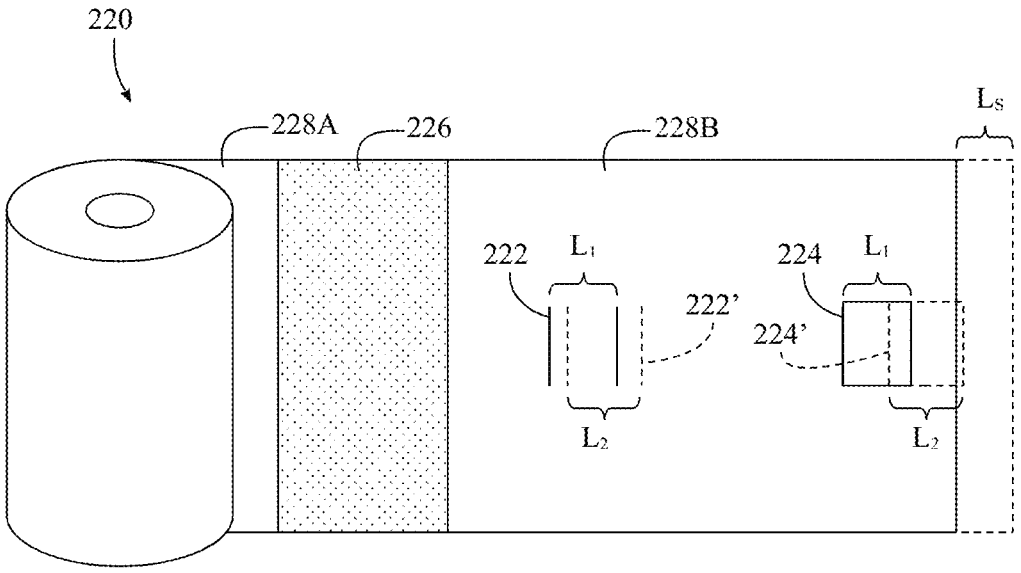
FIG. 6 illustrates an example stretch film supply roll including markings for use in measuring elongation of the stretch film.

For example, as illustrated in FIG. 6, it may be desirable to implement a cumulative stress gauge by printing markings of predetermined dimensions on a roll 220 of stretch film, e.g., one or more vertical lines 222 separated by a predetermined distance $L_1$, a rectangle 224 having a predetermined width, or any other suitable markings of predetermined dimensions in a stretching direction (also referred to herein as a length in the stretching direction). It will also be appreciated that roll 220 may be coreless in some embodiments, while in other embodiments, roll 220 may include a paper, polymer, metal, or other core about which the stretch film is wound.

In some embodiments, for example, a separation of about 5 inches between lines 222, or a rectangle 224 having a width of about 5 inches, may be used, although other dimensions could be used. Markings may be placed on a stretch film at regular intervals during manufacture, for example, to ensure that markings are available for measurement at different points during the lifetime of a roll of stretch film. It may be seen that, for example, after one or more wrapping operations, the stretch film may have elongated a distance $L_S$, and the markings may have similarly elongated, e.g., as illustrated by dashed lines at 222' and 224', such that the length of each marking in the stretching direction is $L_2$.

As such, the TSOL to which a stretch film has been subjected after one or more previous wrapping operations may also be determined empirically in some embodiments based upon the measurement of a marking 222' or 224' prior to any subsequent wrapping operation, which enables a determination to be made of the total unrecovered elongation based on the ratio of the measured length and the original length of the marking. For example, TSOL may be determined empirically in some embodiments as follows:

$$TSOL = ((L_M/L_O) - 1) \times 100\% \quad (8)$$

where $L_M$ is the measured length of the marking, and $L_O$ is the original length of the marking.

Selection of a suitable stretch film for use in reuse applications may be based on various factors, including elasticity, toughness, tear resistance, cost, etc., and a wide variety of stretch films commonly used in non-reuse applications may be suitable for use in reuse applications as well. Thus, in some embodiments, a stretch film used for reuse applications may be configured in a similar manner to stretch films commonly used for non-reuse applications. In other embodiments, however, a stretch film used for reuse applications may be configured with relatively higher elasticity, toughness and tear resistance as compared with stretch films used in non-reuse applications, e.g., with high elasticity below about 40% stretch at the load, capable of allowing for at least about 20 repeat elongations (strains) to at least about 20% stretch at the load, and generally without more than about a 20% increase in strain (stretching force) after 20 repeat elongations. In this regard, stretch at the load may be considered to be the total stretch applied to the stretch film when applied to the load by the stretch wrapping apparatus, which may include (if used) pre-stretch (i.e., stretch applied via a pre-stretch assembly) and/or post-stretch (i.e., stretch applied between the film dispenser and the load). It may also be desirable in some embodiments for a stretch film to have a modulus providing under about 20 lbs. of wrap force at about 20% strain, which is about the practical limit for some loads before load twisting occurs.

The stretch film may also desirably be tacky at least on its inner surface to facilitate the secure attachment of overlapping layers to each other, as well as to enable the ending tail to adhere to the side of the load. Moreover, as will be discussed in greater detail below, tackiness also facilitates the formation of a lap seal between lengths of reusable stretch film when wound back into a roll during unwrapping, and when later dispensed when wrapping subsequent loads with a stretch wrapping apparatus.

Figure 7:
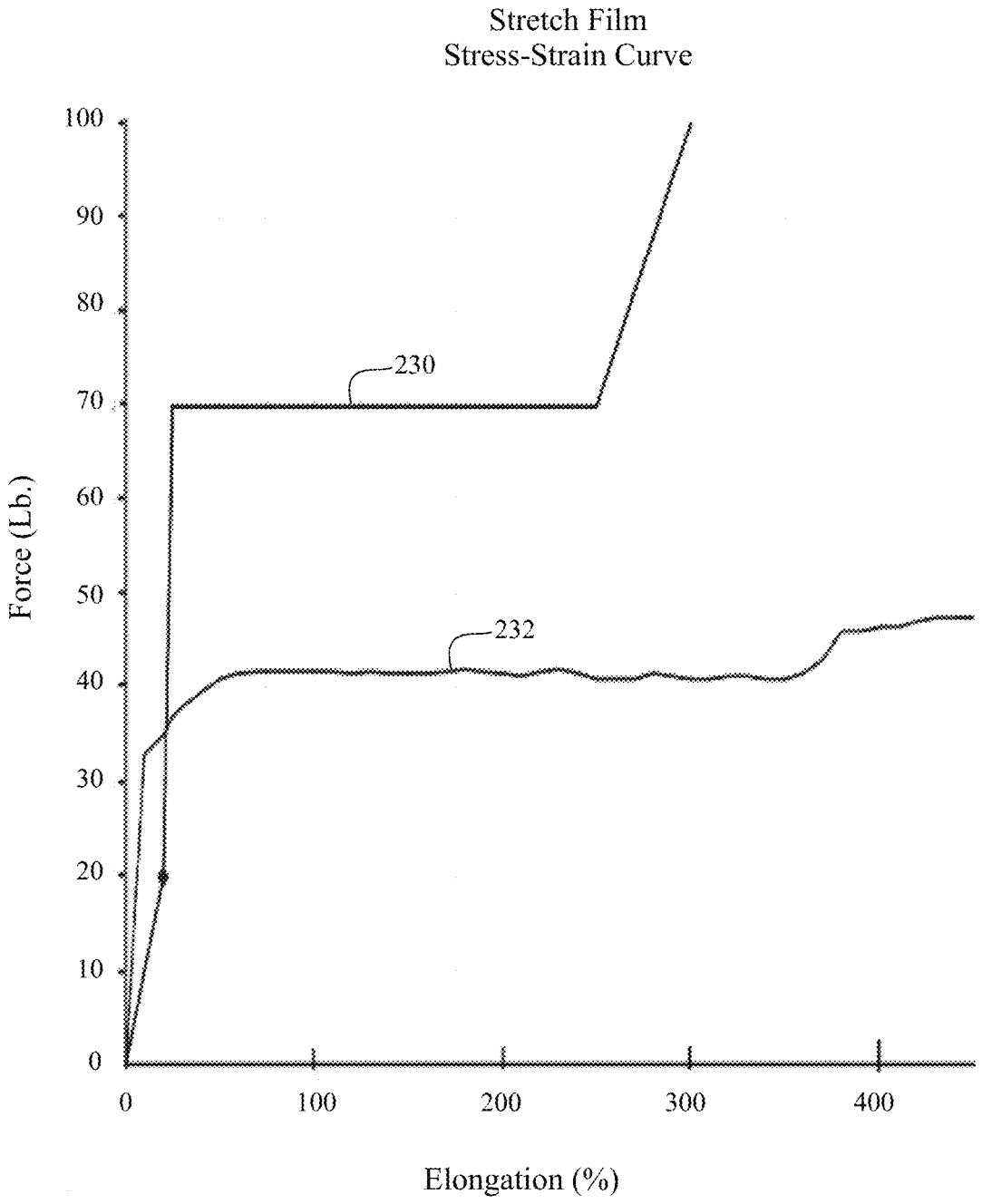
FIG. 7 is a graph comparing the stress-strain curves of two example stretch films suitable for use with a reusable stretch film system consistent with the invention.

It may also be desirable in some embodiments for a stretch film for reuse applications to have a stress strain curve to have a yield point above about 50% elongation, and desirably with an "upward knee" before the yield point, which indicates highly elastic performance below about 30% of elongation. FIG. 7, for example, illustrates a stress-strain curve 230 for an example stretch film suitable for reuse in some embodiments, which exhibits, below about 25% elongation, high elastic performance, but that requires at least about 70 lbs. of force for further elongation towards the yield point (represented by the horizontal portion of the curve), and which allows for relatively high containment forces to be achieved to restrict movement and shifting of a load during transport. For comparison, the stress-strain curve of a typical 80 gauge stretch film is illustrated at 232, where elastic performance occurs with relatively less elongation, and where elongation towards the yield point occurs at a relatively lower force of about 42 lbs., which limits the achievable containment force that can be achieved without strain hardening. Nonetheless, when a suitable amount of stretch is applied to the stretch film represented by curve 232, this type of stretch film may also be utilized in a reusable stretch film system in some embodiments.

In addition, given the reusable nature of the stretch film, it may also be desirable in some embodiments for the stretch film to have a relatively higher maximum tear force (e.g., over about 25 lbs. using a puncture tear test), and for the film to be relatively stiff to the feel to assist with handling during unwrapping without wrinkles.

Based on the performance characteristics of a particular stretch film, wrapping parameters are desirably selected to preserve much of the elasticity of the stretch film whenever it is desired to reuse the stretch film in subsequent wrapping operations. In particular, may be desirable to limit stretch or elongation of a stretch film used by a reusable stretch film system to well below the "knee" in the stress-strain curve for the film, and thereby limit the amount of strain hardening and allowing for repeated stretching and recovery over multiple reuse cycles. In one embodiment, for example, an initial 20% stretch at a relatively low force relative to gauge may be used where the upward knee of the film's stress-strain curve is around 40%, such that any re-stretch or strain during shipment would avoid stresses into the higher force part of the curve. In some embodiments, the amount of stretch or elongation applied for the purposes of film reuse may be about 25% or lower, while in some embodiments, the amount of stretch or elongation may be about 10% or lower, or even about 5% or lower.

The manner in which controlled elongation may be applied to a stretch film during wrapping may also vary in different embodiments. In some embodiments, for example, control over elongation may be implemented at least in part using a pre-stretch assembly, i.e., through control over the relative rates of rotation of the upstream and downstream pre-stretch rollers. In some embodiments, control over elongation may be implemented at least in part based on controlling the amount of elongation applied after a pre-stretch assembly, e.g., typically through control over dispense rate relative to the rate of relative rotation between the film dispenser and the load, which generally controls the tension in the web of stretch film extending between the film dispenser and the load. Further, in embodiments in which no pre-stretch assembly is used, control over the amount of elongation is generally based on the dispense rate relative to the rate of relative rotation and/or the tension in the web extending between the film dispenser and the load. As noted previously, stretch that occurs after a pre-stretch assembly, or that occurs on a stretch wrapping apparatus that does not utilize a pre-stretch assembly, may be referred to as post-stretch, and it should be appreciated that the term "post-stretch" with reference to a controlled elongation implemented by a stretch wrapping apparatus between a film dispenser and a load should not be construed as requiring that the film dispenser include a pre-stretch assembly.

Figure 8:
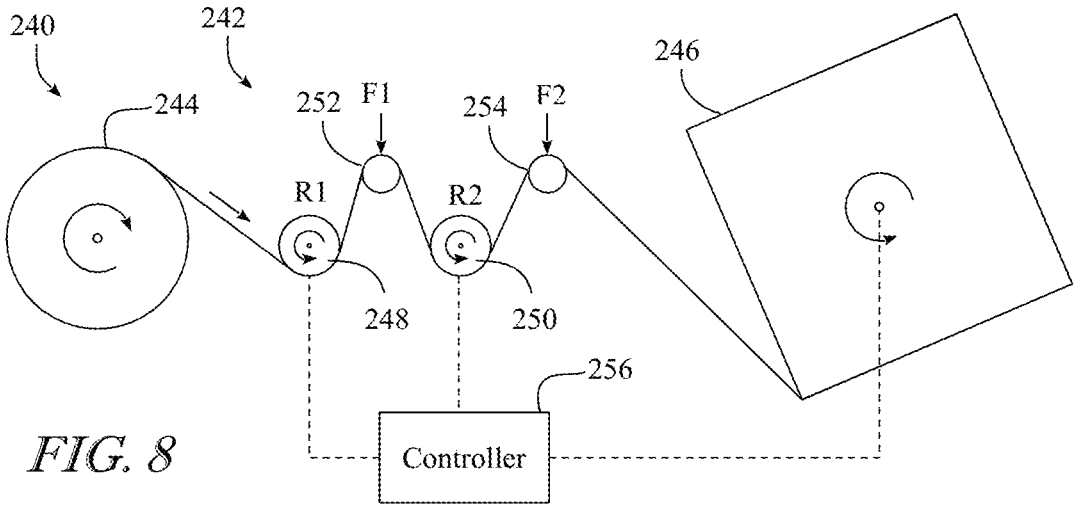
FIG. 8 functionally illustrates a film dispenser and pre-stretch assembly suitable for use in stretch wrapping apparatus consistent with the invention.

FIG. 8, for example, functionally illustrates an example film dispenser 240 that incorporates a pre-stretch assembly 242 and that dispenses stretch film from a roll 244 to a load 246. Pre-stretch assembly 242 includes an upstream pre-stretch roller 248 and a downstream pre-stretch roller 250. Also illustrated is a first idle roller 252 between pre-stretch rollers 248, 250, and a second idle roller 254 that is downstream of the pre-stretch assembly. It will be appreciated that additional driven and/or idle rollers may also be used in other embodiments, and that multiple pre-stretch zones, e.g., as supported by three or more pre-stretch rollers, may be used in some embodiments.

The amount of elongation applied by pre-stretch assembly 242 may be controlled by controlling the relative rates of rotation of pre-stretch rollers 248, 250, e.g., using a controller 256. Pre-stretch rollers 248, 250 generally include non-slip surfaces such that rotation of downstream pre-stretch roller 250 at a higher rate than that of upstream pre-stretch roller 248 will stretch the stretch film conveyed through the pre-stretch assembly. As such, if the tangential velocity of the surface of the downstream pre-stretch roller is 10% higher than that of the up-stream pre-stretch roller, 10% stretch will be applied to the stretch film when conveyed through the pre-stretch assembly. In some embodiments, a fixed amount of pre-stretch may be applied by pre-stretch assembly 242, e.g., through mechanically linking the pre-stretch rollers via gears, belts, chains, transmissions, etc., and in such embodiments, controller 256 may not control the amount of pre-stretch applied by the pre-stretch assembly, such that control over pre-stretch roller 248 and/or pre-stretch roller 250 by controller 256 may be omitted in some embodiments. In other embodiments, the amount of pre-stretch may be variable, and controlled, for example, through controller 256 driving the pre-stretch rollers 248, 250 via separate motors or drives.

The amount of post-stretch applied downstream of pre-stretch assembly 242 may be controlled by controlling the overall dispense rate of the film dispenser relative to the relative rotation between the film dispenser and the load 246, which is in turn controlled by the rate of rotation of downstream pre-stretch roller 250, and which effectively controls the tension in the web of stretch film between the film dispenser and the load. Likewise, where no pre-stretch assembly is used, the rate of rotation of a stretch film supply roll, or if used, a drive roller disposed downstream of the stretch film supply roll, may be used to control the tension, and thus the amount of post-stretch applied to the stretch film. In either case, controller 256 may control the relative rotation of the film dispenser and the load, e.g., by controlling a rotational drive (e.g., to rotate a turntable, a rotating arm, or a rotating ring in different embodiments). Furthermore, while in some embodiments no electronic control of dispense rate of film dispenser 240 may be used (e.g., where film dispenser 240 is mechanically controlled to dispense a predetermined amount of stretch film during each relative rotation between the film dispenser and the load), in other embodiments electronic control of the dispense rate of film dispenser 240 may be provided, e.g., by controlling the rate of rotation of downstream pre-stretch roller 250.

In such embodiments, the dispense rate may be controlled based on various dispense rate control approaches utilized in for stretch wrapping, as will be appreciated by those of ordinary skill in the art having the benefit of the instant disclosure. One such approach, for example, is a tension-based control that controls dispense rate in response to sensed tension or monitored wrap force to the load, which attempts to match a sensed tension or force to a setpoint. Another approach is a girth-based approach that controls dispense rate to dispense a predetermined length of stretch film during each relative rotation between the film dispenser and the load. Yet another approach is an instantaneous demand-based approach that controls dispense rate to match the instantaneous demand of the load. Still another approach is an effective circumference-based approach that controls dispense rate based on a geometric relationship between the film dispenser and one or more corners of the load. Other approaches may combine aspects of these approaches, and practically any dispense rate control that is capable of controlling the amount of post-stretch applied to the stretch film when wrapping a load may be used, as will be appreciated by those of ordinary skill in the art having the benefit of the instant disclosure.

In some embodiments, it may be desirable to primarily control the elongation using a pre-stretch assembly, in part due to the fact that controlling a post-stretch amount based on dispense rate can be complicated by the non-cylindrical cross-section of many palletized loads, which can result in natural variations in the demand of the load, as well as corresponding variations in the dispense rate to accommodate the variations in demand. It will be appreciated that for a load with a rectangular cross-section, demand will decrease as the film approaches a corner, and then will rapidly increase once contact is made with the corner, such that if the dispense rate does not increase correspondingly with the demand of the load, wrap force will generally spike, which can induce additional (and potentially undesired) elongation of the stretch film.

Furthermore, it has been found that the use of wrap force or tension between a film dispenser and a load is not a consistent predictor of the amount of elongation applied to a stretch film in many instances. Many loads, for example, are wrapped by hand (e.g., by walking a handheld film dispenser around a load, in some instances using pre-stretched stretch film) or using a brake-type tension control that attempts to maintain a predetermined tension in the film web during wrapping. In particular, for many stretch films, above a relatively low amount of elongation, wrap force or tension is not a reliable predictor of elongation because the stress-strain curve levels out such that the stretch amount cannot be ascertained based on the sensed wrap force or tension. Moreover, because elongation or stretch of a stretch film is generally difficult to ascertain from a visual standpoint, it is generally not feasible to monitor or control the amount of elongation when hand wrapping. Given also that a relatively small increase in elongation can have a significant impact on the accumulated stretch or elongation of a stretch film, as well as the number of reuse cycles that may be achieved, manual or tension-based approaches would generally not provide sufficient repeatability to ensure that a stretch film retains sufficient elasticity for use in a subsequent wrapping operation.

Figure 9:
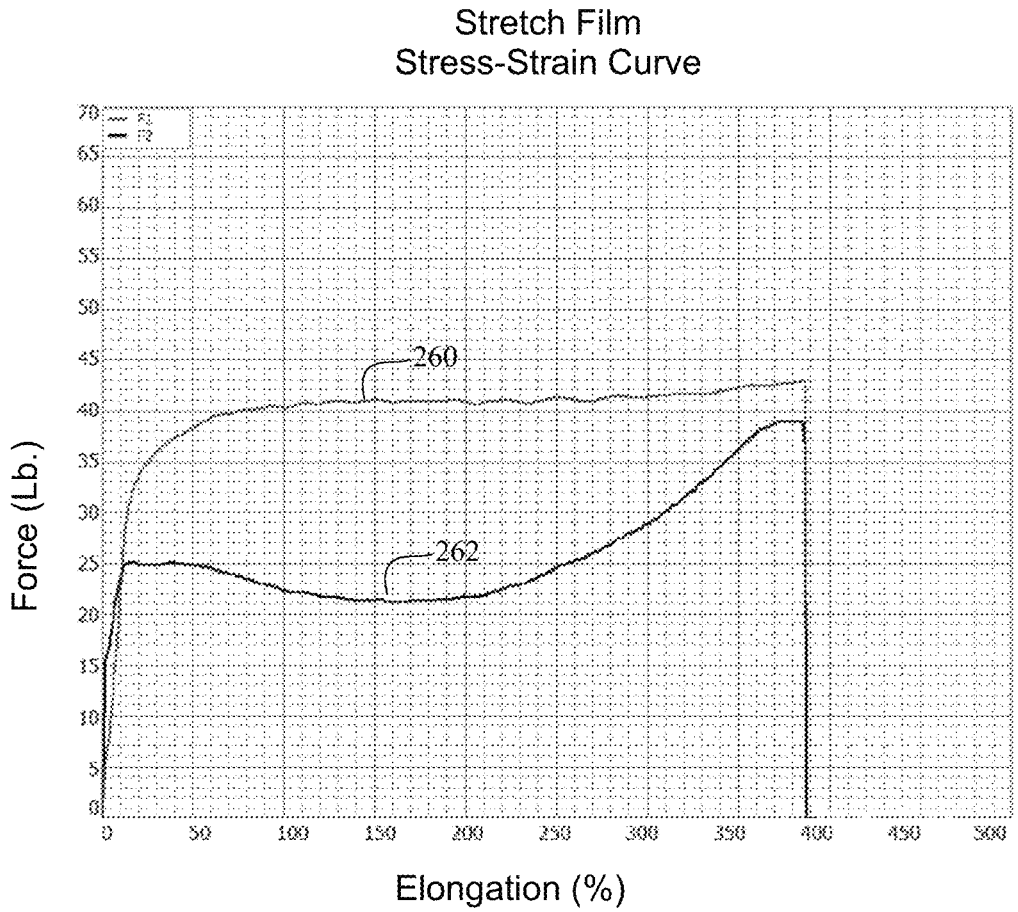
FIG. 9 is a graph of a stress-strain curve of another example stretch film suitable for use with a reusable stretch film system consistent with the invention.

To illustrate this distinction, FIG. 9 illustrates a stress-strain curve generated for an example 80 gauge stretch film, generated by varying pre-stretch amounts while controlling dispense rate to dispense at 100% payout percentage, whereby the amount of film dispensed during a relative rotation about the load is substantially equal to the girth of the load, and where the amount of post-stretch is minimized or eliminated. Line 260 represents the amount of force sensed within the pre-stretch assembly, referred to as F1, which as illustrated in FIG. 8 may be sensed, for example, using a load cell coupled to idle roller 252, among other manners. Line 262 represents the amount of force sensed downstream of the pre-stretch assembly, referred to as F2, which as illustrated in FIG. 8 may be sensed, for example, using a load cell coupled to idle roller 254.

It will be appreciated from line 262 that above about 10% elongation, the curve is substantially horizontal, and even decreases between about 50% and 150% elongation. As such, the F2 force generally may not be used to predict elongation at or above about 10% elongation. In contrast, in order to provide a predetermined elongation amount of X % to a stretch film, the relative rates of rotation of the downstream and upstream pre-stretch rollers may be selected such that the tangential velocity of the surface of the downstream pre-stretch roller is X % faster than that of the upstream pre-stretch roller. Consequently, in some embodiments, more precise control over elongation can be achieved by controlling the amount of pre-stretch than by controlling dispense rate.

Thus, in some embodiments, it may be desirable to control a pre-stretch assembly of a film dispenser to provide about 25% or lower elongation, while in some embodiments, the amount of pre-stretch may be about 10% or lower elongation, or even about 5% or lower elongation. Furthermore, it may be desirable to utilize such pre-stretch control with little or no additional elongation provided downstream of a pre-stretch assembly, which in some embodiments may result in more controlled elongation of the stretch film.

In one particular embodiment, for example, 10% pre-stretch may be coupled with a dispense rate corresponding to 100% or higher payout percentage to retain sufficient elasticity in a stretch film to enable the stretch film to be reused for multiple reuse cycles. For one example stretch film having an 80 gauge thickness, such wrapping parameters may be used to allow the stretch film to be used in up to about 20 reuse cycles (or potentially more) before it is no longer suitable for reuse. This is based on the fact that generating a controlled elongation of such a stretch film when wrapping with about 10% pre-stretch and about 100% payout to supply about 10% total stretch of the stretch film on the load may result in the stretch film being permanently elongated about 3-6% from its original length once removed from the load. Subsequent reuse of the stretch film to wrap subsequent loads and using similar wrapping parameters may similarly permanently elongate the stretch film an additional 3-6% per reuse cycle, which in some instances can support up to about 20 reuses or more of the stretch film before the loss of elasticity substantially increases the risk of a film break.

It will be appreciated, however, that a wide variety of other combinations of pre-stretch, post-stretch, dispense rate, and other wrapping parameters may be used in other embodiments, and that such parameters may vary for different types of stretch films, so the invention is not limited to the specific wrapping parameters.

Returning to FIG. 6, another aspect of a reusable stretch film system in some embodiments is the manner in which lengths of stretch film recovered from wrapped loads are incorporated into a roll of stretch film that is suitable for use in reuse applications. In some embodiments, for example, recovered lengths of stretch film may be collected into a roll in which the individual lengths of reusable stretch film are attached to one another end-to-end, e.g., via lap seals where the end of one length of stretch film is overlapped with the end of another length of stretch film. FIG. 6, for example, illustrates an example lap seal 226 where the end of a first length of stretch film 228A is overlapped with the end of a second length of stretch film 228B.

A lap seal, within the context of the invention, may be considered to include any manner of attaching adjacent lengths of stretch film at least in part by overlapping portions of the adjacent lengths. In some embodiments, a lap seal may simply rely on the tackiness of the stretch film, such that by overlapping ends of adjacent lengths of stretch film, the tackiness of the adjacent lengths throughout the area of overlap is sufficient to withstand the tensile forces to which the stretch film is typically subjected to, e.g., during collection, during wrapping, and while wrapped around a load. In other embodiments, various treatments may be used to strengthen a lap seal, e.g., the use of mechanical forces via a wipe down mechanism, a knurled roller, or via pressing against or clamping across the lap seal and/or the use of heat to soften the stretch film, or in some instances, to fuse the adjacent lengths together. In some embodiments, adhesives may also be used to strengthen a lap seal, and in some embodiments, a tail may be folded, rolled, cut, slit, etc. to further improve adhesion and restrict delamination of the lap seal. In still other embodiments, portions of one or both surfaces of a stretch film adjacent to or under a lap seal may be abraded or scuffed by an abrasive, treated with a solid or liquid agent having detackifying properties, e.g., soapy water, talcum powder, etc., or otherwise detackified to reduce the likelihood that the lap seal does not separate during wrapping, e.g., due to the overlapped end of stretch material in the lap seal having greater adhesion to the surface of the roll than to the overlapping end of stretch material in the lap seal. The manner in which lap seals may be formed, as well as the manner in which a roll of stretch film may be treated to increase the integrity of a lap seal and/or reduce the likelihood of lap seal separation, are discussed in greater detail below. In general, it may be desirable in some embodiments to create a differential level of tack in order to effectively remove a lap seal web that has been re-wound into a roll, since as stretch film is re-applied, the underlying layer of stretch film directly below the created lap seal has a tackifier that naturally has more "adhesive" effect on the leading edge of the lap seal that is directly above it than the adhesion between the two layers of the lap seal. This can cause the lap seal lower layer to tend to stick to the underlying layer, rather than to the lap seal that has been created due to the relatively weaker adhesion of the created lap seal than the natural tack of the stretch film.

Moreover, it should be appreciated that in many applications the amount of stretch film dispensed to wrap each load in a reusable stretch film system will not be identical for every load, and that the ends of each distinct length of stretch film in a roll of reused stretch film will not line up exactly such that a load wrapped using a roll of reused stretch film will only utilize one distinct length of stretch film. As such, it should be appreciated that a wrapping operation performed with a roll of reused stretch film will, in many circumstances, result in dispensing and wrapping one or more lap seals around a load, and further, that the number of lap seals present in a roll of reused stretch film will generally increase as the number of reuse cycles of the stretch film incorporated into the roll increases. As such, it should be expected that a wrapping operation utilizing a roll of reused stretch film will generally dispense one or more lap seals onto a wrapped load.

Therefore, in some embodiments, a stretch wrapping apparatus suitable for reuse applications may include a film dispenser configured to dispense stretch film to the load, a rotational drive configured to generate relative rotation between the film \dispenser and the load about an axis of rotation, and a controller configured to control the rotational drive to generate relative rotation between the film dispenser and the load about the axis of rotation to wrap the load with the stretch film, and to control an elongation of the stretch film at the load to be substantially below a yield point of the stretch film during wrapping of the load.

In addition, in some embodiments, a stretch wrapping apparatus suitable for reuse applications may include a film dispenser configured to dispense stretch film to the load, where the stretch film includes first and second lengths previously used to wrap different palletized loads, a rotational drive configured to generate relative rotation between the film dispenser and the load about an axis of rotation, and a controller configured to control the rotational drive to generate relative rotation between the film dispenser and the load about the axis of rotation to wrap the load with at least a portion of each of the first and second lengths of stretch film. It should also be noted that the first and second lengths may also differ from one another based upon the fact that they may be formed of different film materials, thicknesses, compositions, and/or constructions, be formed by different manufacturing processes, be manufactured by different manufacturers, and/or have different model numbers or other identifiers in some embodiments.

Further, in some embodiments, a stretch wrapping apparatus suitable for reuse applications may include a film dispenser configured to dispense stretch film to the load, where the stretch film is disposed on a roll that includes first and second lengths joined by a lap seal, a rotational drive configured to generate relative rotation between the film dispenser and the load about an axis of rotation, and a controller configured to control the rotational drive to generate relative rotation between the film dispenser and the load about the axis of rotation to wrap the load with the lap seal and at least a portion of each of the first and second lengths.

Unwrapping Apparatus Configurations

Various unwrapping apparatus configurations may be used in different embodiments. An unwrapping apparatus, within the context of the invention, is a device suitable for unwrapping stretch film from a wrapped load, e.g., at a destination location to which the load has been shipped. An unwrapping apparatus, in some embodiments, may utilize relative rotation between the load and a take up device capable of collecting the stretch film unwrapped from the load. In some embodiments, the take up device may collect only a length of stretch film recovered from an individual load, while in other embodiments, the take up device may collect multiple lengths of stretch film recovered from multiple loads, e.g., by forming a roll in which the individual lengths of stretch film are attached to one another end-to-end, e.g., via lap seals where the end of one length of stretch film is overlapped with the end of another length of stretch film. Such multiple lengths, when joined together via lap seals, may be considered to form a continuous web of stretch film, which in some embodiments may then be suitable for reuse in wrapping other loads. In other embodiments, stretch film collected using an unwrapping apparatus may not be reused, but may instead be collected for recycling purposes.

In some embodiments, in particular, an unwrapping apparatus may unwrap a stretch film from a load spirally, and over the course of multiple relative rotations between the load and the take up device of the unwrapping apparatus. Put another way, unwrapping stretch film from a load consistent with some embodiments of the invention may be performed in a similar manner to that in which the stretch film is initially wrapped onto the load, but in reverse. Moreover, while cutting may be used in some embodiments, in many embodiments, an unwrapping apparatus consistent with the invention may unwrap a stretch film from a load without performing any cutting of the stretch film while the stretch film is on the load, or in some instances, even after the stretch film has been removed from the load.

Stretch wrapping, in particular, generally includes the generation of relative rotation between a film dispenser and a load while a leading end of a web of stretch film is attached to the load, such that the relative rotation causes the stretch film to be wound around the load. The stretch film is generally provided in roll form and with a width (where the width may be considered to be the dimension that is substantially perpendicular to the direction of travel for the stretch film, or the distance between the opposing edges of the stretch film) that is substantially smaller than the height of the load. Typical stretch film widths used in the industry are 20 and 30 inches, for example, while many loads are between about 48 and about 84 inches high. As a result of these differences, the stretch film is wound in a spiral manner around the load, and over the course of multiple relative rotations, with the elevation of the film dispenser relative to the load (i.e., the position of the film dispenser along an axis generally parallel to the axis of rotation through which relative rotation is performed) controlled such that the stretch film covers a contiguous region between a top and bottom of the load. The film dispenser elevation may also be controlled such that stretch film wrapped during a particular relative rotation partially overlaps the stretch film wrapped during the prior relative rotation, thereby ensuring that no gaps exist within the contiguous region. While in some instances, a single layer of stretch film may be wrapped around a load (e.g., by starting at the bottom of the load and raising the elevation of the film dispenser during relative rotation until the top of the load is reached, or conversely, by starting at the top of the load and lowering the elevation of the film dispenser during relative rotation until the bottom of the load is reached), in other instances, multiple layers of stretch film may be used, whereby upon reached the top or bottom of the load, the movement of the film dispenser is reversed to spirally wind one or more additional layers of stretch film onto the load. Regardless of the number of layers, however, a stretch wrapping operation generally ends by severing the web of stretch film between the load and the film dispenser to create a tail and pressing or otherwise securing the tail against the side of the load.

An unwrapping apparatus consistent with some embodiments of the invention may unwrap stretch film from a load starting with the tail created during the wrapping process and spirally unwrapping the stretch film from the load through multiple relative rotations between the load and a take up device in an opposite direction from that used to initially wrap the load. As will become more apparent below, in some embodiments the spiral unwrapping may utilize a take up device that is movable in a manner similar to a film dispenser, i.e., in a direction substantially parallel to an axis of rotation, such that the elevation of the take up device is controlled to follow the elevation of the stretch film as it is unwound from the load. Where the axis of rotation is vertical, for example, the take up device may similarly move in a substantially vertical direction. In other embodiments, however, the take up device may incorporate a collection roller having a length along its axis of rotation that is at least as long as a distance between opposing edges of a wrapped region of the load, such that in some instances movement of the take up device in a direction substantially parallel to the axis of rotation need not be supported.

Furthermore, in some embodiments a take up device may wind collected stretch film into a roll form, e.g., to form a roll of stretch film that may be coreless or may include a core about which the stretch film is wound. The roll of stretch film, in some embodiments, may be suitable for use by a stretch wrapping apparatus such that collected stretch film is reusable for wrapping subsequent loads by installing the roll of stretch film in a stretch wrapping apparatus after the stretch film is collected on the roll. In some embodiments, the collected stretch film may be wound directly into a roll form when it is unwrapped from a load, while in other embodiments, a take up device may collect stretch film from multiple loads on an intermediate collection device, e.g., a collection roller, and the collected stretch film from the multiple loads may be transferred to another device, e.g., for winding it into a roll form or a form suitable for recycling.

Further, given that in some applications the entity unwrapping the load may have no control over how the load is initially wrapped (e.g., clockwise vs. counter-clockwise, location of tail, hand vs. machine wrapped, etc.), it will be appreciated that an unwrapping apparatus in some embodiments may also be capable of accommodating loads that are wrapped in different directions, i.e., clockwise or counter-clockwise, as well as accommodating loads where the tail is located at different elevations on the load. Some loads, for example, are wrapped from bottom to top, while others are wrapped from top to bottom, and some loads are wrapped over multiple passes. As such, the tail that is initially pulled from the load at the beginning of an unwrapping operation may be located near the top of the load, near the bottom of the load, or anywhere in between. An unwrapping apparatus in some embodiments may therefore be capable of generating relative rotation to handle both clockwise and counter-clockwise unwrapping, and in some embodiments, may also include a take up device such as a collection roller that is operable in different directions to accommodate different types of loads.

Figure 10:
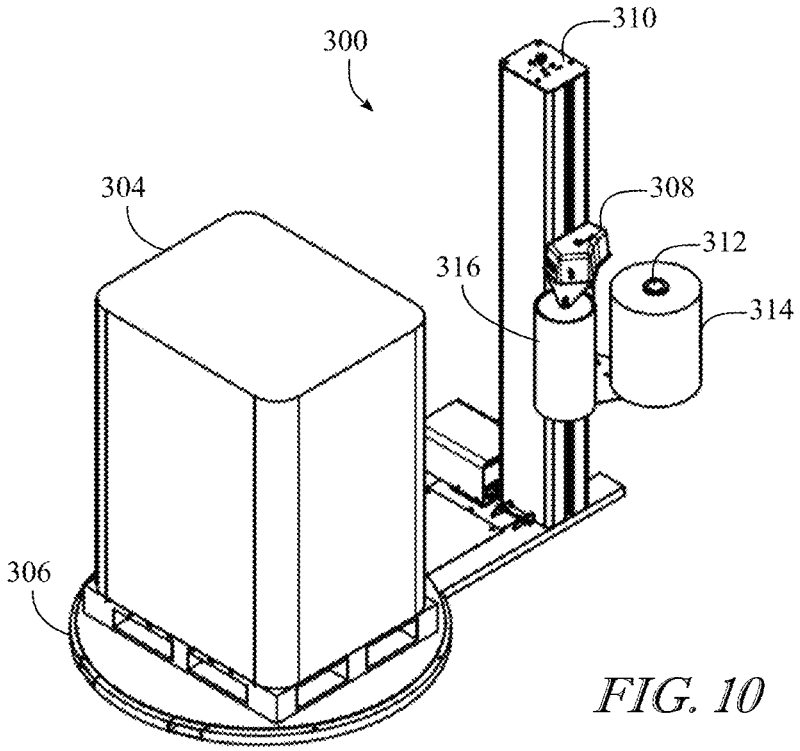
FIGS. 10 and 11 are perspective views of an example turntable-type unwrapping apparatus consistent with the invention.
Figure 11:
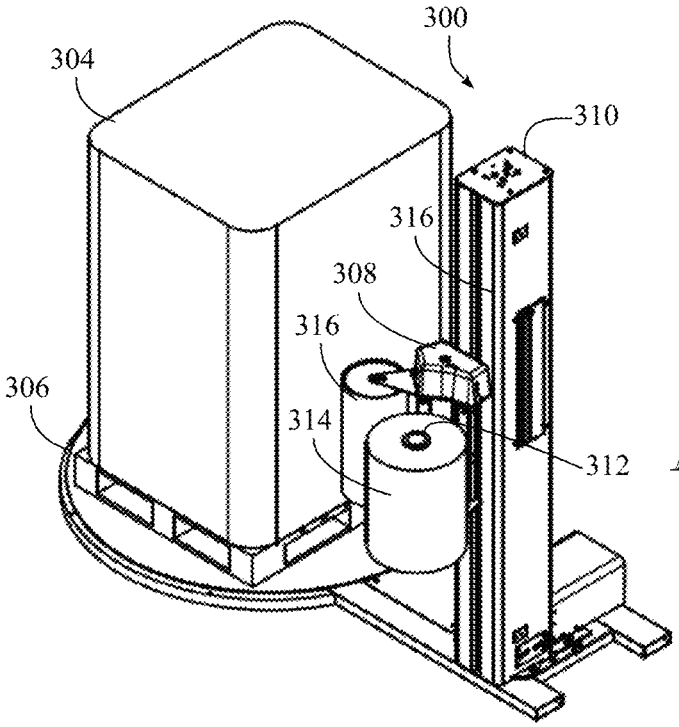
Figure 12:
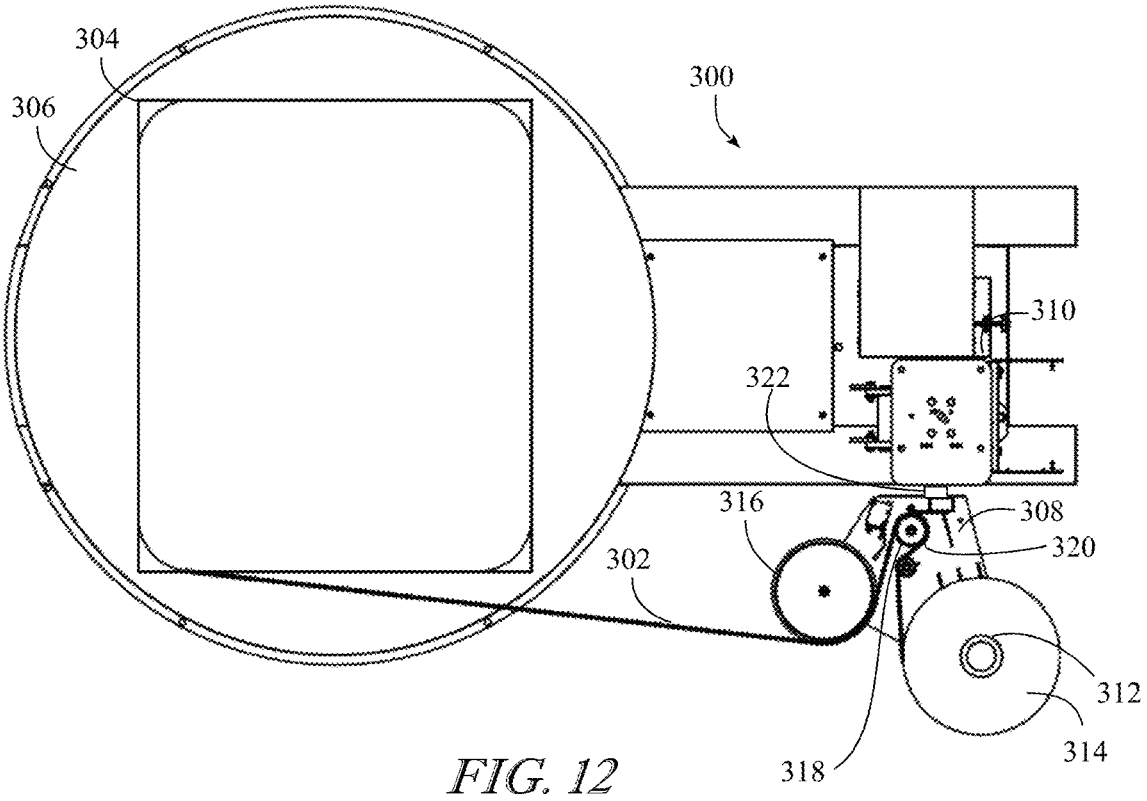
FIG. 12 is a top plan view of the unwrapping apparatus of FIGS. 10-11.

FIGS. 10-12, for example, illustrate an example unwrapping apparatus 300 consistent with some embodiments of the invention, and capable of unwrapping a length of stretch film 302 from a load 304. Apparatus 300 is a turntable-type unwrapping apparatus, whereby the load is supported on a turntable 306 for rotation about a substantially vertical axis of rotation relative to a take up device including a film windup carriage 308 supported for substantially vertical movement along a mast 310. Film windup carriage 308 may include, for example, a roll support 312 for supporting a roll 314 of stretch film, as well as a take up drum 316 disposed between the load 304 and the roll 314. In some embodiments, roll support 312 may support a hollow core about which stretch film is wound, while in other embodiments, a coreless approach may be used, where roll 314 is formed about one or more retractable fingers such that the stretch film is formed into a roll without the use of a separate core, and such, that, once the fingers are retracted, a full roll of stretch film may be removed from apparatus 300.

Additional components in apparatus 300, e.g., a lift drive for driving film windup carriage 308, a rotational drive for rotating turntable 306 and a controller for controlling apparatus 300 (not shown in FIGS. 10-12) may be similarly configured to the corresponding components described above in connection with stretch wrapping apparatus 100 of FIG. 3. In addition, film windup carriage 308 may include one or more windup drives for driving roll 314 and/or take up drum 316 to wind stretch film onto roll 314 during rotation of turntable 306. It will be appreciated that various techniques similar to those used for controlling the dispense rate of a stretch wrapping apparatus may be used to control the windup rate of film windup carriage 308, e.g., based on tension, load geometry, film speed, or other inputs that will be appreciated by those of ordinary skill in the art having the benefit of the instant disclosure.

It will be appreciated that other manners of introducing relative rotation may be used in other embodiments, e.g., similar to various rotating arm-type or ring-type wrapping apparatus configurations, where the film windup carriage would rotate around a stationary load.

Take up drum 316 in various embodiments desirably provides a surface to facilitate the attachment of a stretch film tail (which, in some instances, may be considered to be a leading end from the perspective of unwrapping) to a roll of stretch film supported by film windup carriage 308. In some embodiments, the take up drum may be fed by a vacuum or may have a tackifier sensitive coating to facilitate forming a lap seal with the ending tail of a previous load that has at least partially been wound about roll 314.

In addition, as illustrated in FIG. 12, film windup carriage 308 may include one or more additional driven or idle rollers 318, 320 to redirect the stretch film wound onto roll 314. In addition, film windup carriage 308 may be supported by a bearing 322 that allows for rotation of film windup carriage 308 about a substantially horizontal pivot axis. Doing so allows carriage 308 to tilt to align with the film unwind position on the load. Carriage 308 may be guided by the rigidity of the film web itself or by web position sensing feedback to control the take up drum angle and carriage speed. In some embodiments, an operator may use a "joystick" or other manual control to control carriage elevation to maintain the film web centered on the take up drum, and the carriage may be balanced to freely pivot to naturally guide and align the carriage with the web of stretch film. In other embodiments, automated systems may be used to provide integrated control of elevator alignment, position, and speed, e.g., using a sensing array on both sides of the web and positioned on a take up roller or lap seal roller to identify and maintain productive web centering.

In addition, in some embodiments, manual operator attachment of a leading end from a load to the tail of a preceding load in carriage 308 may be used, while in other embodiments, an automated (e.g., robotic) pick-up arm/clamp may be used to identify, locate, and attach itself to the leading end (e.g., by suction or other means as the load is rotated) and move it to the take up drum 316 to form a lap seal. In addition, manual or automated operations may be performed to start a new roll of stretch film, e.g., using a slit-in-side guide or mechanical clamp.

Figure 13A:
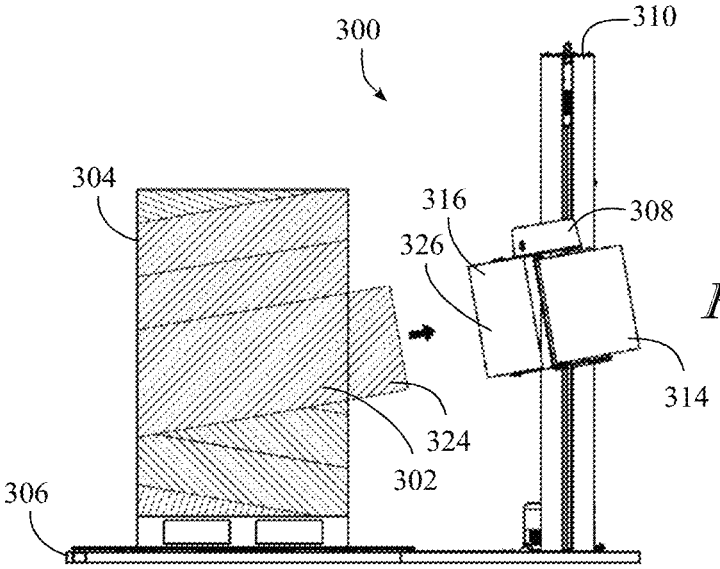
FIGS. 13A-13D illustrate an example unwrapping operation performed with the unwrapping apparatus of FIGS. 10-12.
Figure 13B:
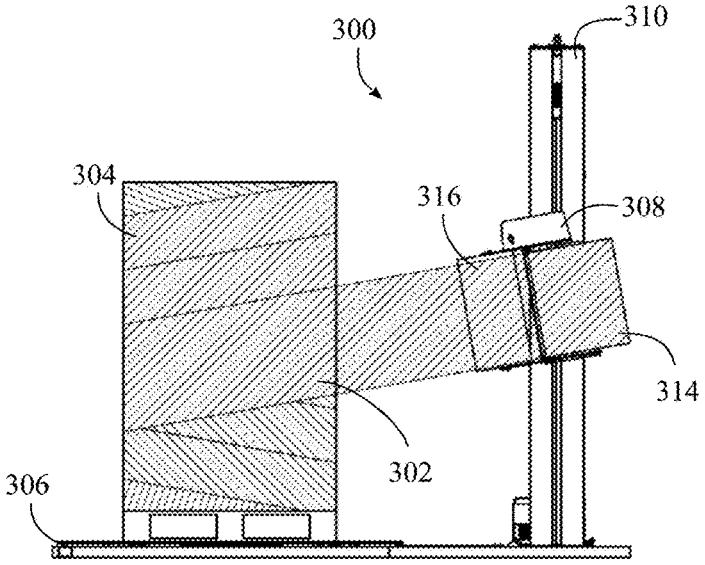
Figure 13C:
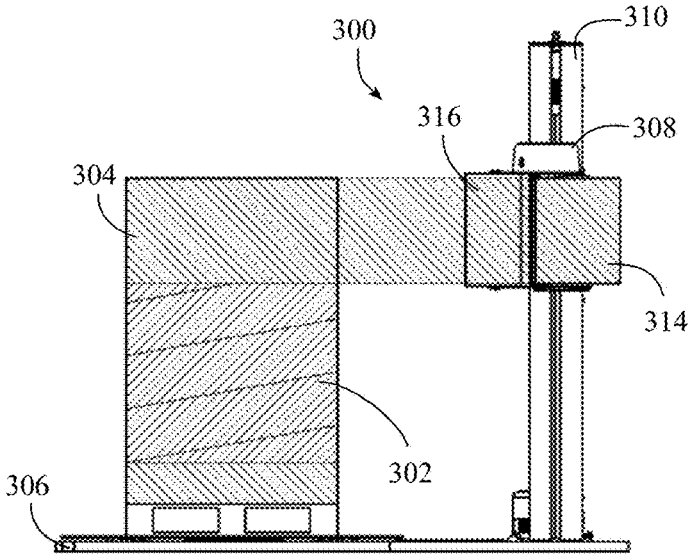
Figure 13D:
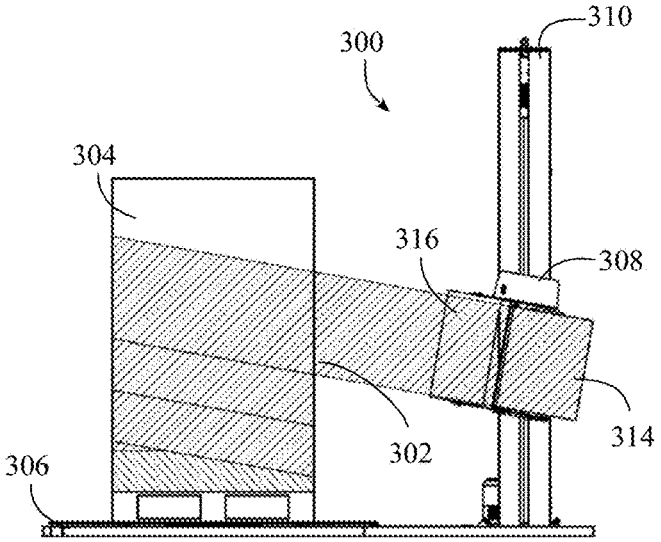

FIGS. 13A-13D, for example, illustrate an example winding operation whereby a leading end 324 of stretch film 302 disposed on load 304 is initially separated from the side of the load (FIG. 13A) and moved (manually or in an automated fashion) into engagement with a tail 326 of a stretch film collected on roll 314. Then, as illustrated in FIGS. 13B-13D, relative rotation is generated by turntable 306 to unwrap stretch film 302 from load 304 and wind it around roll 314, with the height and tilt of carriage 308 being controlled as needed to align with the direction of film being unwrapped from the load. By aligning the carriage in this manner, wrinkling or puckering of the film as it is wrapped around roll 314 is minimized.

FIGS. 14-17 next illustrate another example unwrapping apparatus 400 capable of unwrapping stretch film 402 from a load 404. Unwrapping apparatus 400 is similar to unwrapping apparatus 300 in that it is a turntable-type unwrapping apparatus, whereby the load is supported on a turntable 406 for rotation about a substantially vertical axis of rotation relative to a film windup carriage 408 supported for substantially vertical movement along a mast 410. Film windup carriage 408 includes a roll support 412 for supporting a roll 414 of stretch film, as well as a take up drum 416 disposed between the load 404 and the roll 414.

Figure 16:
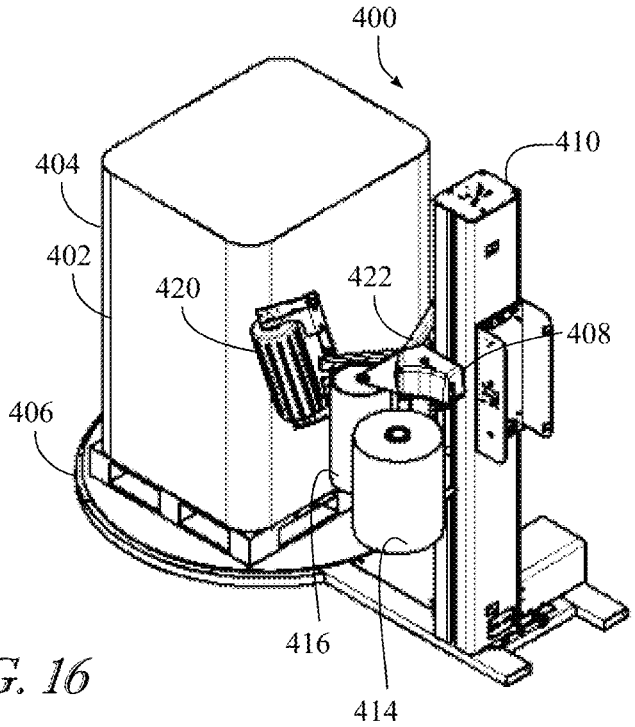
FIG. 16 is a perspective view of the unwrapping apparatus of FIG. 14, showing tilting of the initial film take up roller.

In addition, however, unwrapping apparatus 400 includes an initial film take up roller 420 supported on an arm 422 capable of positioning roller 420 against the side of load 404. Roller 420 is a conformable roller capable of conforming to the surface of load 404, and may be implemented, for example, as an inflatable roller, a compressible roller, a foam roller, or any other suitable control suitable for maintaining contact with the side of the load as the load rotates. In one embodiment, for example, roller 420 may be implemented using a cylindrical marine boat fender. In addition, rather than having carriage 408 pivot to align with the unwrapped stretch film, roller 420, or at least a portion of arm 422, may be pivotable as illustrated in FIG. 16.

Figure 14:
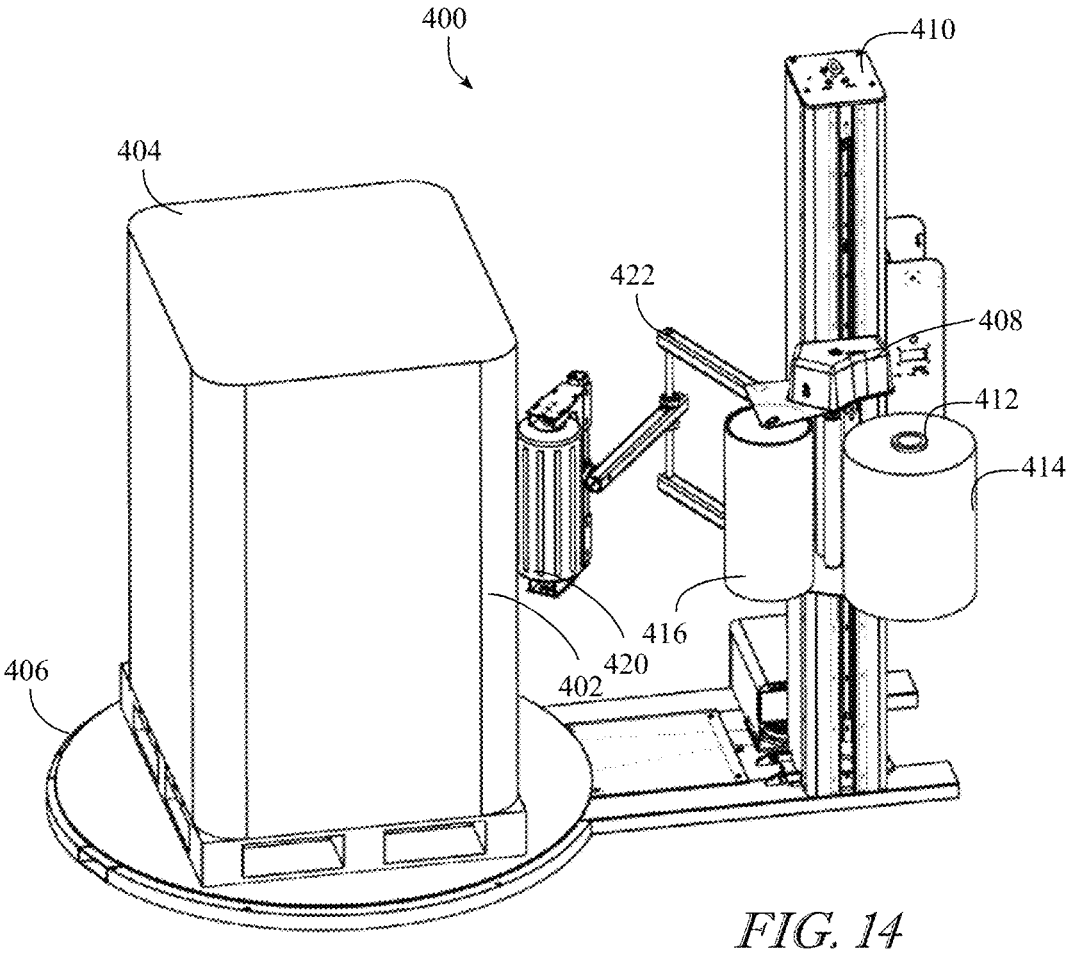
FIG. 14 is a perspective view of another example turntable-type unwrapping apparatus consistent with the invention.
Figure 15:
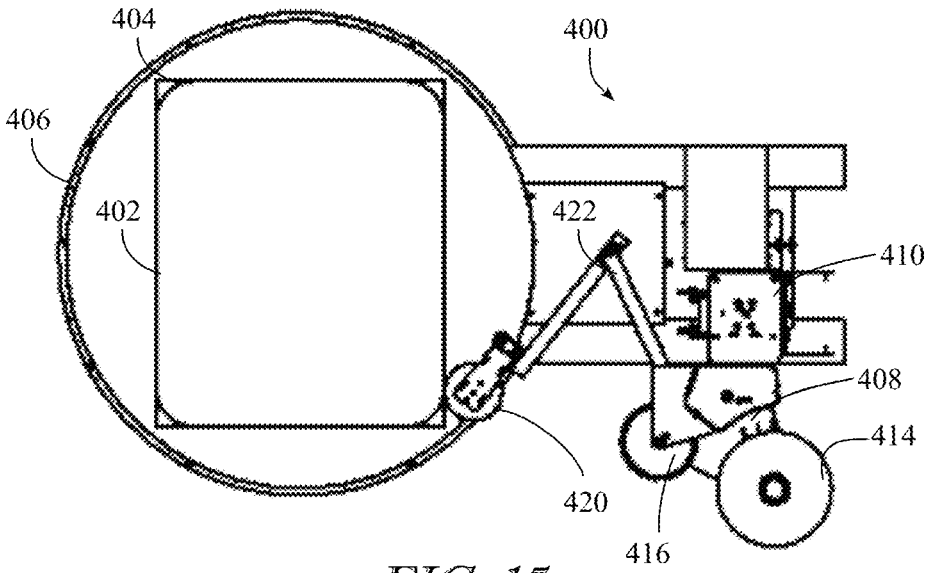
FIG. 15 is a top plan view of the unwrapping apparatus of FIG. 14, showing an initial film take up roller in an extended position.
Figure 17:
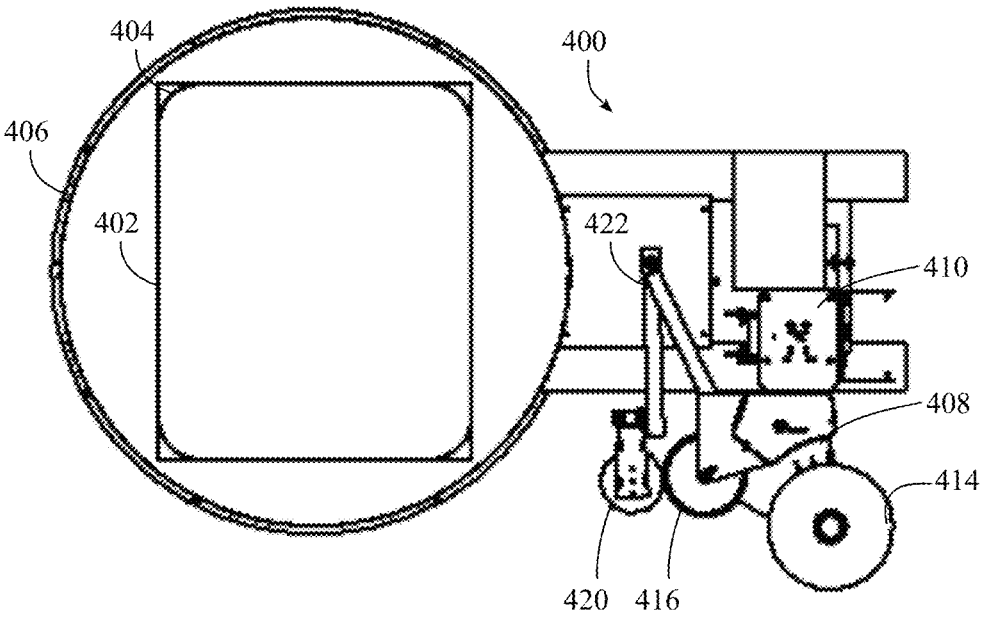
FIG. 17 is a top plan view of the unwrapping apparatus of FIG. 14, showing the initial film take up roller in a retracted position for subsequent winding onto a take up roll.

Roller 420 may be driven in some embodiments, while in other embodiments, roller 420 may be simply rotated as a result of rotation of load 404, as it is in contact with the surface of the load throughout the rotation. Arm 422 may be biased in some embodiments to press the roller against the side of the load during unwrapping, and further may be capable of articulating between an unwrapping position that places roller 420 into contact with the side of load 404 (as shown in FIGS. 14-16) and a retracted position in which roller 420 is separated from the side of load 404 (as shown in FIG. 17).

In this embodiment, unwrapping is performed in two stages, with the stretch film initially collected on an intermediate device, here roller 420, before subsequently being transferred to another device, here roll 414. Specifically, in a first stage, the leading end of the stretch film 402 wrapped around load 404 is initially attached to roller 420 or to stretch film from a prior load that is wrapped around roller 420. Rotation of turntable 406 then causes roller 420 to roll along the surface of load 404, and carriage 408 is moved up and down as needed (e.g., under manual or automated control) to maintain the film proximate the center of the roller, until all of the stretch film has been unwrapped from the load. Then, in a second stage, arm 422 retracts roller 420 from the load and positions the roller adjacent take up drum 416, where the film is attached to the tail of a preceding load at least partially wound around roll 414, and the stretch film is then transferred from roller 420 to roll 414 in a similar manner to that described above for unwrapping apparatus 300.

It will be appreciated that in other embodiments, the stretch film from multiple loads may be wound onto roller 420 prior to transferring the stretch film to roll 414. In still other embodiments, an unwrapping apparatus may be configured to wind stretch film onto roller 420 but not transfer the film to a separate roll in the apparatus. Instead, the stretch film from multiple loads may be found onto roller 420, and then the roller may be removed and transferred to a separate apparatus to form a coreless or cored roll. Such a downstream apparatus could support multiple unwrapping apparatuses, and could operate at a higher transfer speed in some embodiments due to the fact that the transfer effectively occurs from one substantially cylindrical roll to another, and in some embodiments, such a downstream apparatus could be configured to smooth or otherwise minimize wrinkling of stretch film prior to transport.

Other unwrapping apparatus configurations may be used in other embodiments. Collection of stretch film, for example, may be semi-automatic and require an operator to attach the ending tail from a wrapped load onto a collection roller or automatic with connection performed by a robotic arm, fluid air blasts, suction, etc. In addition, depending on desired speed and available space, an unwrapping apparatus may utilize various techniques for inducing relative rotation between a take up device and a load, e.g., a turntable, rotating arm, ring, or motorized unwrapping "robot," or even a manually pushed cart containing a manual or powered film collection mechanism. Therefore, the invention is not limited to the particular configurations discussed herein.

Unwrapping Apparatus with Pivotable, Collapsible, Extended Height Collection Roller FIGS. 18-22B illustrate another example embodiment of an unwrapping apparatus 500 consistent with the invention. In this embodiment, a take up device 502 includes a collection roller 504 that collects stretch film 506 from a load 508 through relative rotation between the take up device 502 and the load 508 about an axis of rotation 510. Unwrapping apparatus 500 is configured to generate relative rotation similar to a rotating arm-type stretch wrapping apparatus 150 of FIG. 4, and as such, take up device 502 in this embodiment is disposed on a rotating arm 512 that is rotatably coupled to a base 514 and driven by a rotational drive 516, e.g., an electric motor.

In this embodiment, unwrapping apparatus 500 unwraps stretch film 506 from load 508 spirally, and over the course of multiple relative rotations between the load and the take up device, but does so using a collection roller 504 that has an extended length along its axis of rotation 518 (e.g., in a height dimension where axis 518 is a vertical axis) that enables stretch film disposed at different elevations of the load to be wound onto the collection roller without having to control the elevation of the collection roller itself, as is the case with each of unwrapping apparatus 300 and unwrapping apparatus 400. In some embodiments, in particular, the elevation of collection roller 504 (or alternatively, the position of the collection roller along axis 518) may be substantially fixed, such that no elevational change occurs with the collection roller during an unwrapping operation. In other embodiments, however, the collection roller may be movable along axis 518.

The length of collection roller 504 along axis 518 may vary in different embodiments. In some embodiments, the length may be at least as long as a distance between opposing edges (e.g., edges 520, 522) of a wrapped region 524 of load 508. Moreover, where unwrapping apparatus 500 is used to unwrap loads of varying heights, the length of collection roller 504 may be at least as long as a distance between opposing edges of a wrapped region of a tallest supported load. Selection of a suitable length may be based in some embodiments on the width of the stretch film web, e.g., with the length of the collection roller being at least about 2 times the width of the stretch film web. In some embodiments, for example, the length may be at least about 80 inches, while in some embodiments, the length may be at least about 110 inches.

Figure 23:
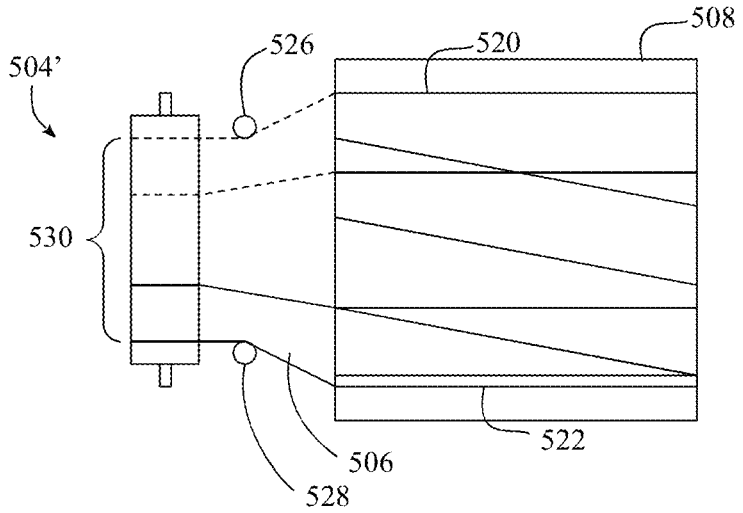
FIG. 23 is a functional view of an alternate collection roller to that of the unwrapping apparatus of FIGS. 18-19, and incorporating a pair of film guides.

In other embodiments, however, the length of collection roller 504 along axis 518 may be less than the distance between the opposing edges of the wrapped region of the load. For example, as illustrated by collection roller 504' in FIG. 23, it may be desirable in some embodiments to utilize one or more film guides 526 and/or 528 proximate an end of collection roller 504' to redirect the stretch film 506 collected from load 508 to within a predetermined region 530 of the collection roller. Collection roller 504' may still be maintained at a fixed elevation during an unwrapping operation, but still may collect stretch film at a plurality of elevations throughout wrapped region 524, even if the stretch film elevation when on load 508 extends above or below the predetermined region 530 of collection roller 504'. Film guides 526, 528 in some embodiments may be implemented using rollers, and in other embodiments may be implemented using fixed surfaces (e.g., round or curved metal stock) along which the edge of a stretch film web may ride, similar in many respects to a roping mechanism used in some stretch wrapping apparatus designs.

The use of an extended length collection roller on unwrapping apparatus 500 may be suitable, for example, when unwrapping stretch film for recycling purposes, as formation of a continuous web of a stretch film using lap seals for reuse purposes may not be needed. Instead, for each load to be unwrapped, the leading end of stretch film may be attached to the extended length collection roller (or to existing stretch film wound about the extended length collection roller) at practically any position along the length of the roller, such that a roll of stretch film collected from multiple loads may be formed on the collection roller, but without adjacent lengths of stretch film collected from any two loads joined by a lap seal formed between the leading and trailing ends of those adjacent lengths of stretch film.

It will be appreciated, however, that in other embodiments, unwrapping apparatus 500 may be used to collect stretch film for reuse purposes. For example, collection roller 504 may be used as an intermediate collection device for stretch film, and the roll of stretch film formed on collection roller 504 may subsequently be transferred to a secondary device, whether on unwrapping apparatus 500 (similar to an arrangement discussed above in connection with unwrapping apparatus 400), or on a separate apparatus disposed at the same or even a different geographical location, to assemble the lengths of stretch film in the roll into a roll of stretch film including a continuous web of stretch film suitable for use in a stretch wrapping apparatus.

Returning to FIGS. 18-22B, collection roller 504 may also be pivotably supported on unwrapping apparatus 500 to pivot between unwrapping and unloading positions. In particular, in some embodiments collection roller 504 may be pivotably supported by a roller support 532 that allows for pivoting of collection roller 504 about a pivot axis 534 that is substantially perpendicular to axis 518.

Figure 18:
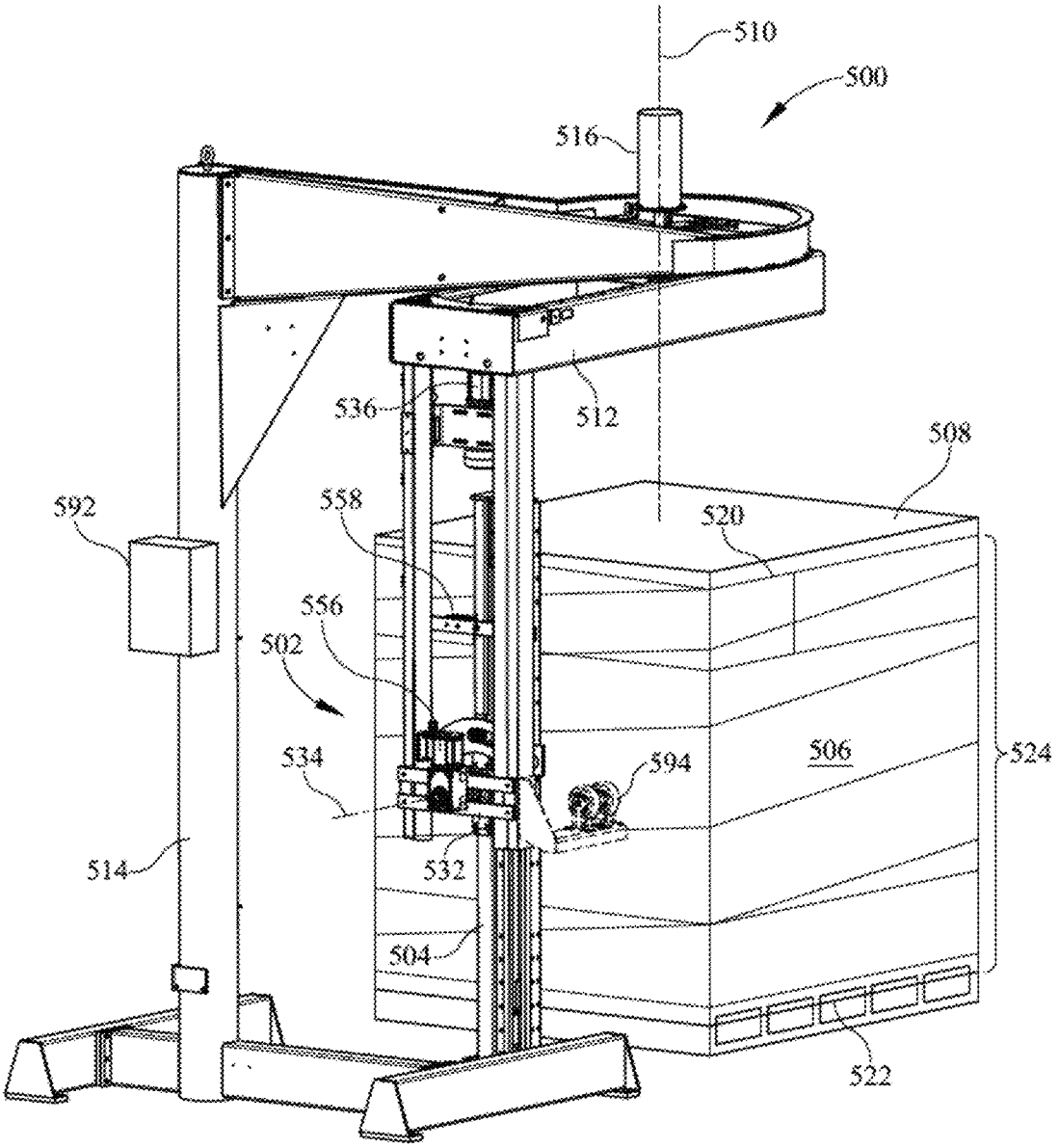
FIG. 18 is a perspective view of another example rotating arm-type unwrapping apparatus consistent with the invention.
Figure 19:
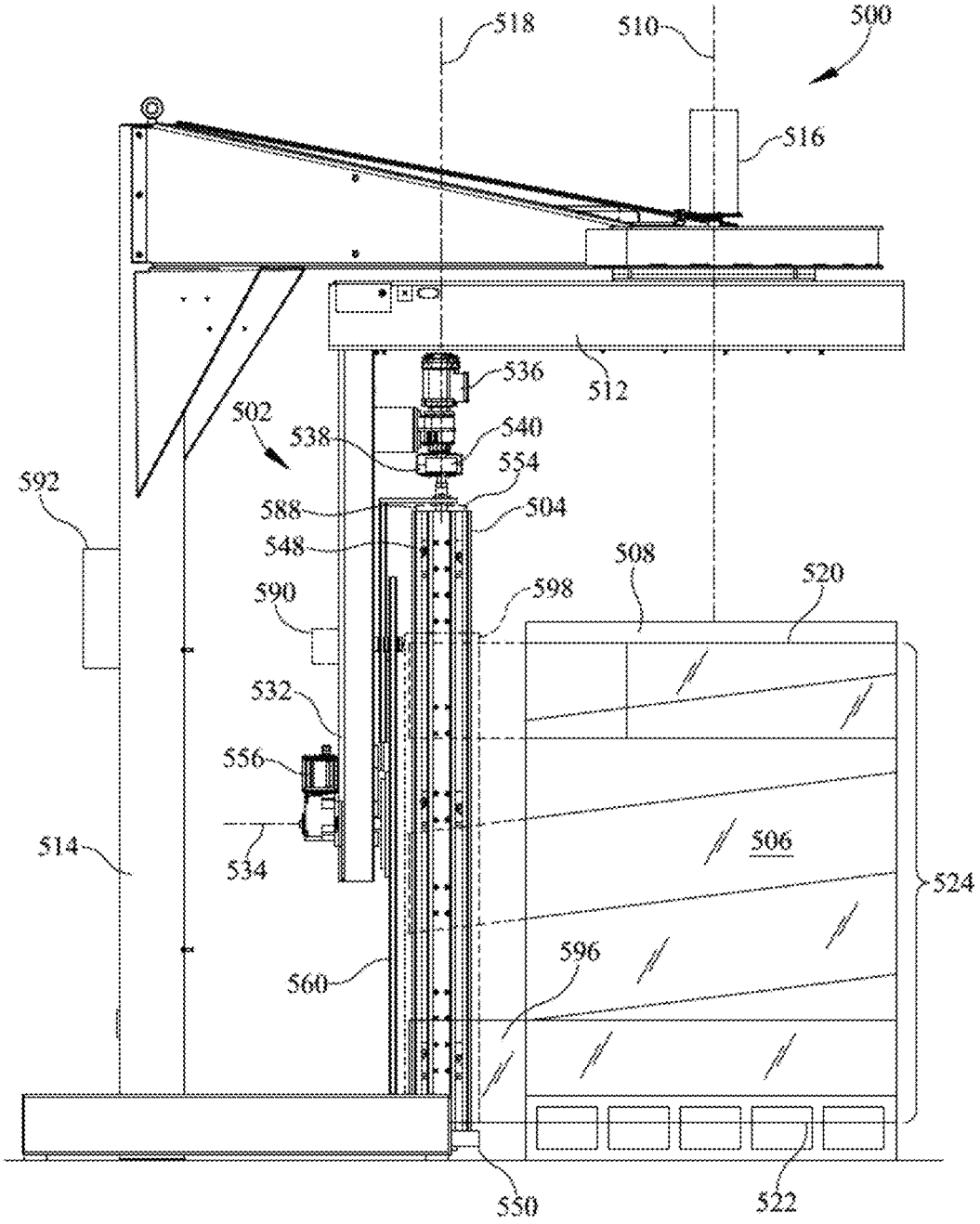
FIG. 19 is a side elevational view of the unwrapping apparatus of FIG. 18.
Figure 20A:
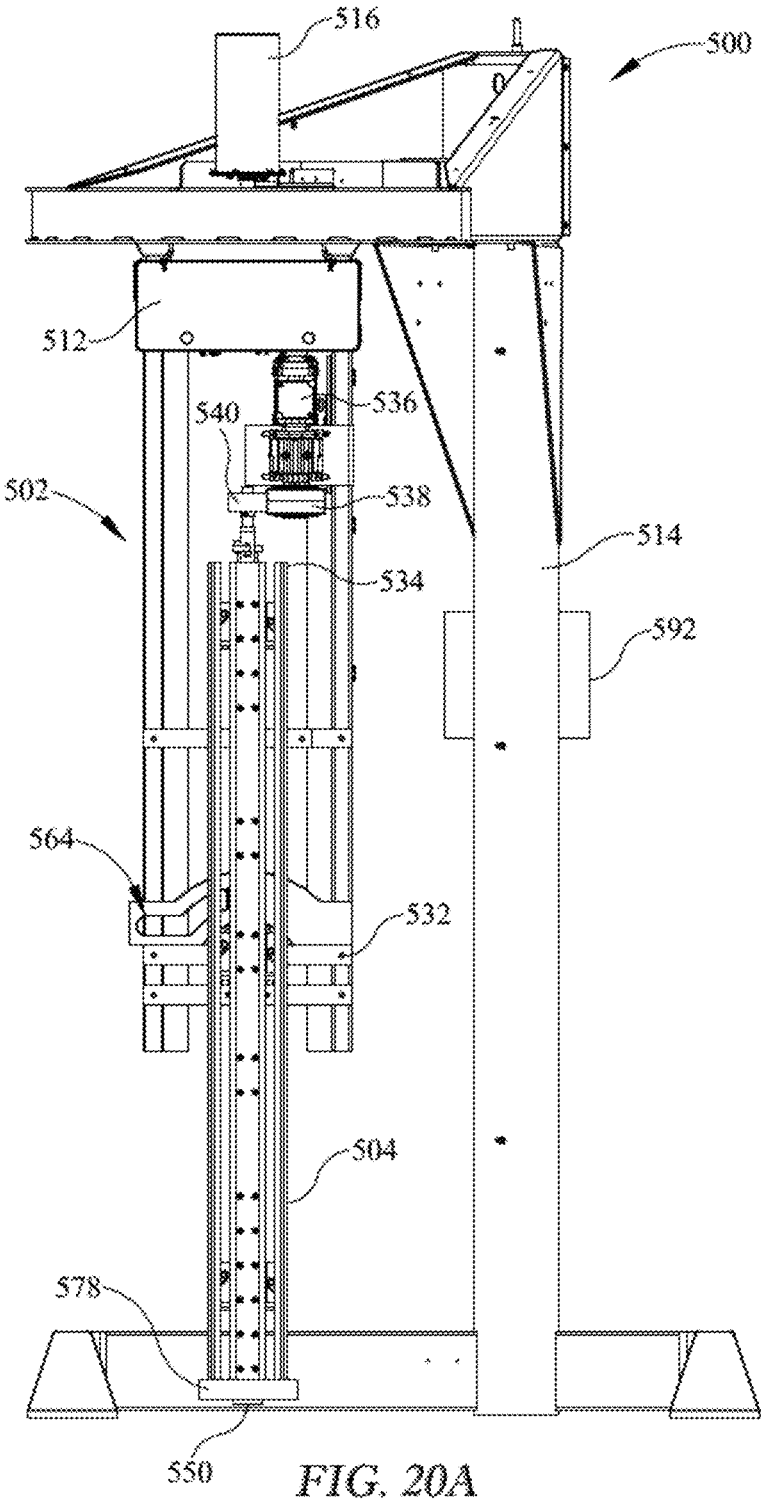
FIG. 20A is a front elevational view of the unwrapping apparatus of FIGS. 18-19, with the collection roller in an unwrapping position.

In the unwrapping position, which is illustrated in FIGS. 18, 19 and 20A, collection roller 504 is substantially vertical, such that axis 518 is substantially parallel to axis 510. Furthermore, collection roller 504 in the unwrapping position is operably engaged with a roller drive 536, e.g., an electric motor, such that roller drive 536 can drive rotation of collection roller 504 about axis 518. Roller drive 536 includes a drive member 538, and collection roller 504 includes a driven member 540 that engages drive member 536 such that rotation of drive member 538 by roller drive 536 drives rotation of both driven member 540 and collection roller 504 about axis 518. In some embodiments, drive member 538 and driven member 540 may be implemented as contact friction rollers that engage one another through frictional contact, while in other embodiments drive member 538 and driven member 540 may be implemented using gears. Other manners of providing power transfer to collection roller 504 through a disengageable coupling may be used in other embodiments, as will be appreciated by those of ordinary skill in the art having the benefit of the instant disclosure. Moreover, in other embodiments, roller drive 536 may be coupled to collection roller 504 through a non-disengageable coupling (e.g., through a direct coupling to a shaft member of collection roller 504), and may, for example, be pivotable along with collection roller 504 when moving to an unloading position.

Figure 24:
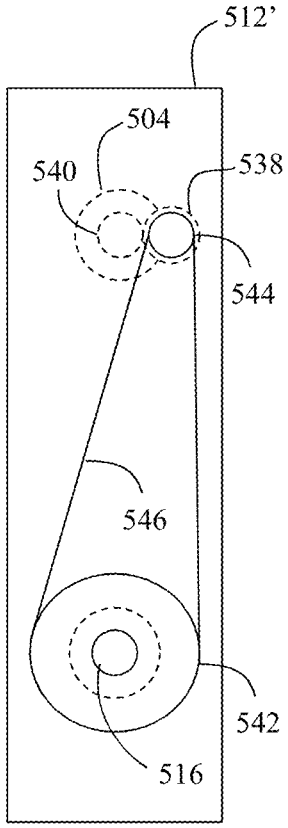
FIG. 24 is a functional view of an alternate rotating arm to that of the unwrapping apparatus of FIGS. 18-19, and incorporating a mechanical linkage for driving the collection roller responsive to rotation of the rotating arm.

In still other embodiments, no independent roller drive may be used, and rotation of a collection roller may be driven by rotation of a rotating arm by a rotational drive through a mechanical linkage. FIG. 24, for example, illustrates an alternate rotating arm 512' in which, rather than using a roller drive to rotate drive member 538, a chain-and-sprocket arrangement, including a pair of sprockets 542 and 544 operably coupled to one another via a chain 546, is used to drive collection roller 504 in response to rotation of rotating arm 512' by rotational drive 516. Sprocket 542, for example, is configured to remain stationary during rotation of rotating arm 512' by rotational drive 516, such that relative rotation is generated between rotating arm 512' and a base of the unwrapping apparatus. It will be appreciated that various drive ratios may be used to control rotation of collection roller 504 relative to rotating arm 512' and thereby control the tension and/or rate of collection of the stretch film from the load as the rotating arm rotates about the load. It will also be appreciated that collection roller 504 may be mechanically linked to rotational drive 516 using various other arrangements, e.g., belt-and-pully arrangements, hydraulic arrangements, geared transmission arrangements, etc.

Returning once again to FIGS. 18-22B, and collection roller 504 may be coupled to roller support 532 by a roller bracket 548, which rotatably supports a first end 550 of collection roller 504, e.g., using one or more bearings 552. Driven member 540 is disposed proximate an opposite, second end 554, and in the illustrated embodiment, second end 554 also defines a stretch film removal end of the collection roller from which collected stretch film is removed from the collection roller through axial movement of a roll of stretch film collected on the collection roller along axis 518 and in the direction of second end 554. In other embodiments, however, stretch film removal may be performed from first end 550, i.e., at an opposite end from driven member 540. It is desirable in the illustrated embodiment for driven member 540 to be appropriately sized (e.g., with a diameter that is no larger than the diameter of collection roller 504 when in a collapsed configuration) to allow for the driven member 540 to pass through an interior channel formed by the roll of stretch film disposed on the collection roller as the stretch film is removed from the collection roller.

Figure 20B:
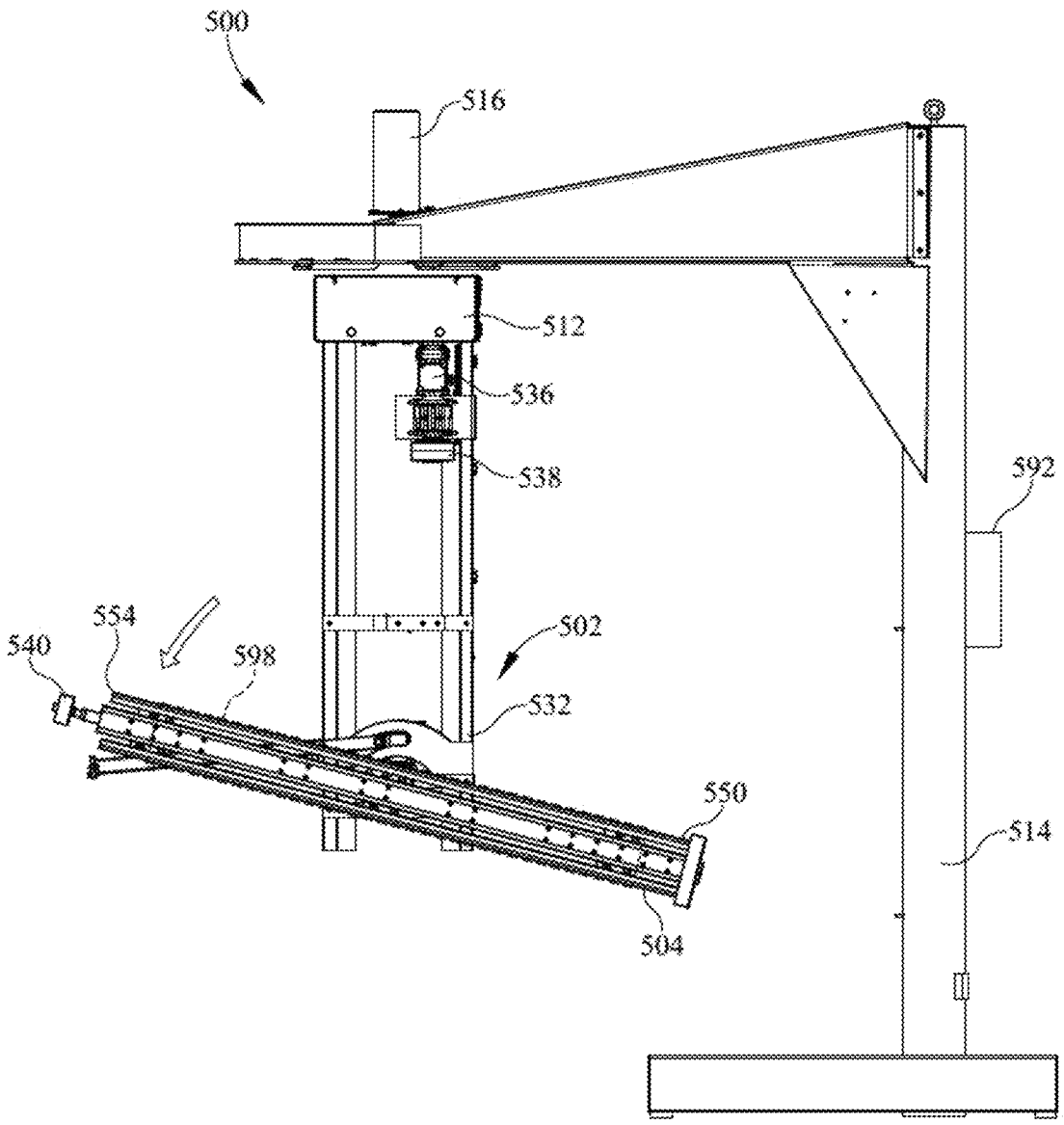
FIG. 20B is a side elevational view of the unwrapping apparatus of FIGS. 18-19, with the collection roller in an intermediate position.
Figure 20C:
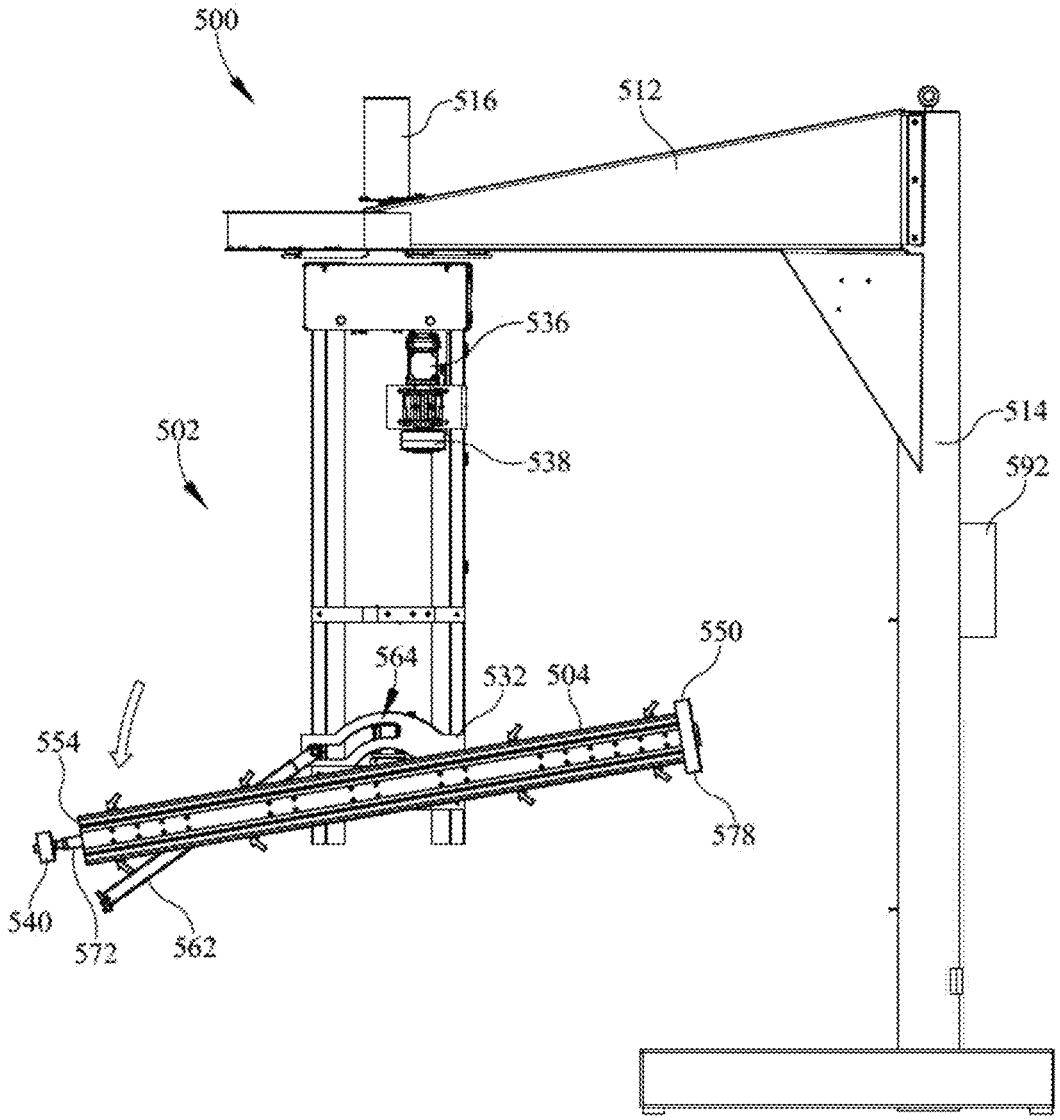
FIG. 20C is a side elevational view of the unwrapping apparatus of FIGS. 18-19, with the collection roller in an unloading position.

With specific reference to FIGS. 20B and 20C, when it is desirable to remove collected stretch film from the collection roller, roller bracket 548 is moved about pivot axis 534, through an intermediate position as illustrated in FIG. 20B to an unloading position as illustrated in FIG. 20C. In some embodiments, movement of roller bracket 548 may be implemented using a pivot drive 556, e.g., an electric motor, while in other embodiments pivot drive 556 may be omitted and movement of roller bracket 548 may be performed manually. In either instance, it may also be desirable to incorporate a locking or latching mechanism 558, which may be electronically-controlled or manual (e.g., using a lynch pin or other latching arrangement), in order to lock roller bracket 548 in the unwrapping position during an unwrapping operation, with movement away from the unwrapping position, and disengagement of driven member 540 from drive member 538, restricted.

Figure 21:
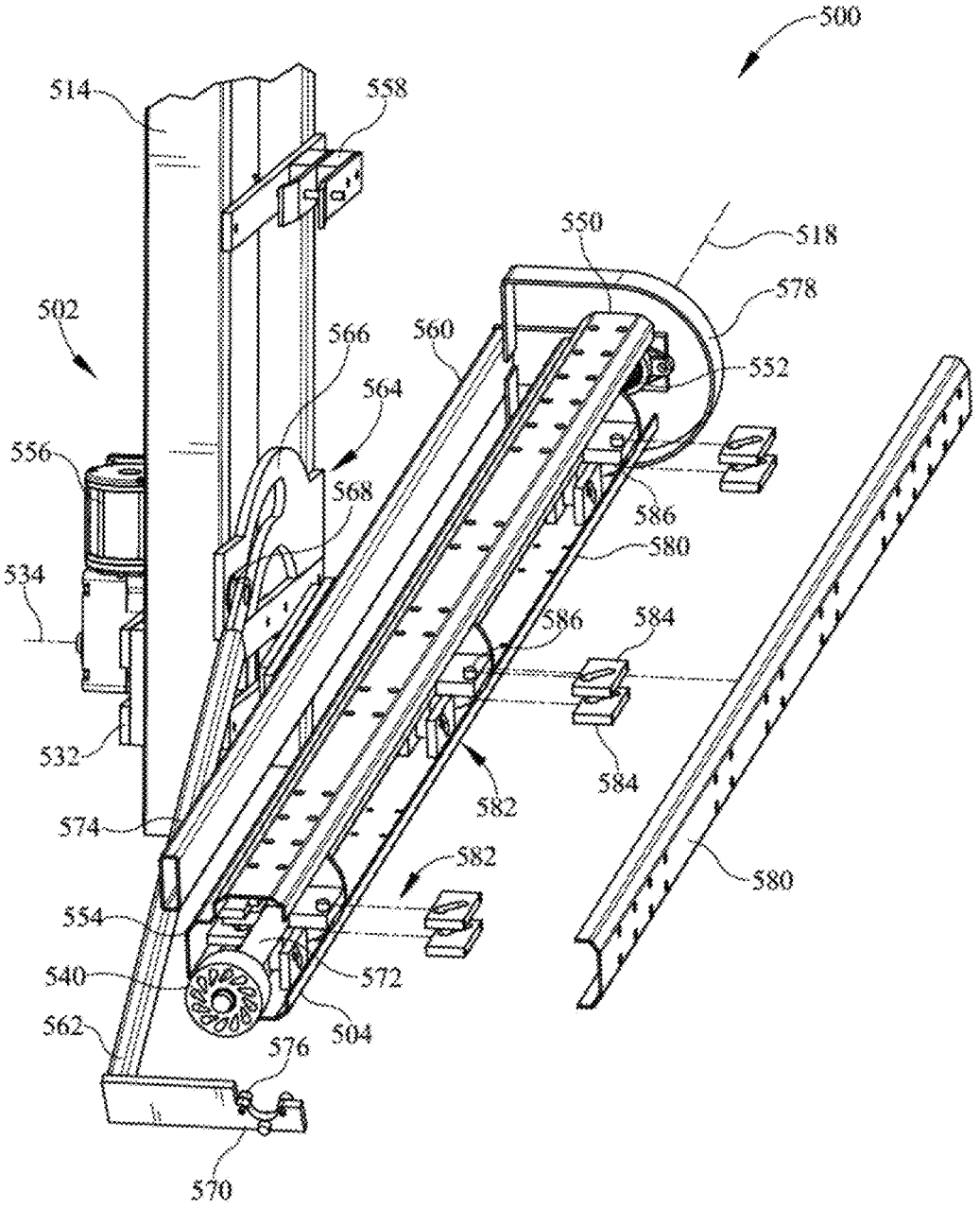
FIG. 21 is an exploded perspective view of the roller support and collection roller of the unwrapping apparatus of FIGS. 18-19.

In addition, in the illustrated embodiment, and with reference to FIG. 21, roller bracket 548 includes first and second bracket members 560, 562 respectively supporting the first and second ends 550, 554 of collection roller 504. Bearings 552 are supported on first bracket member 560 to support first end 550 of collection roller 504 in a cantilevered fashion, while second bracket member 562 is movable relative to first bracket member 560 to selectively disengage from second end 554 of collection roller 504 when the collection roller is in the unloading position to allow for removal of a roll of stretch film from the collection roller through the axial movement along axis 518. While other manners of disengaging roller bracket 548 from collection roller 504 to facilitate removal of the stretch film may be used in other embodiments, in the illustrated embodiment, movement of second bracket member 562 relative to first bracket member 560 is implemented using a cam arrangement 564 that includes a track 566 and cam follower 568 configured to follow within track 566. Track 566 is mounted to roller support 532 and cam follower 568 is mounted to second bracket member 562. Track 566 is configured such that, when collection roller 504 is in the unwrapping position, a shaft support 570 is placed into contact with a shaft member 572 of collection roller 504 to maintain contact between driven member 540 and drive member 538. However, as collection roller 504 moves to the unloading position, cam follower 568 causes second bracket member 562 to move relative to first bracket member 560 (e.g., about a pivot 574) to separate shaft support 570 from shaft member 572 of collection roller 504 and thereby enable stretch film collected on collection roller 504 to be removed from the collection roller via axial movement along axis 518. Shaft support 570 may also include one or more bearings 576 to facilitate rotation of shaft member 572 when engaged with shaft support 570.

It will be appreciated that track 566 and cam follower 568 may be reversed in some embodiments, with track 566 coupled to second bracket member 562 and cam follower 568 coupled to roller support 532, and that other arrangements allowing for relative movement between the roller bracket and an end of a collection roller via sliding and/or pivoting movement may be used in other embodiments. In addition, first bracket member 560 may also include a film guide 578 that restricts stretch film from wrapping around the end of the collection roller, i.e., by redirecting the stretch film to within a predetermined region of the collection roller proximate first end 550 thereof.

Figure 22A:
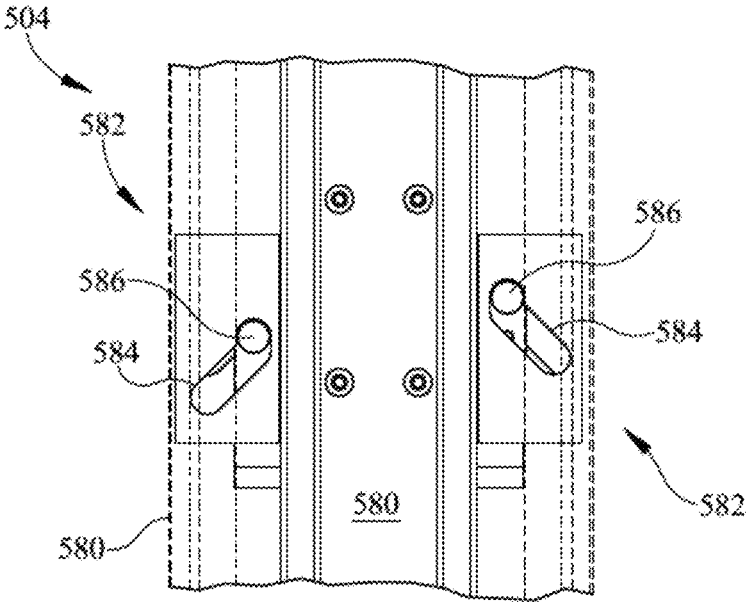
FIG. 22A is a partial elevational view of the collection roller from the unwrapping apparatus of FIGS. 18-19, in an extended configuration.
Figure 22B:
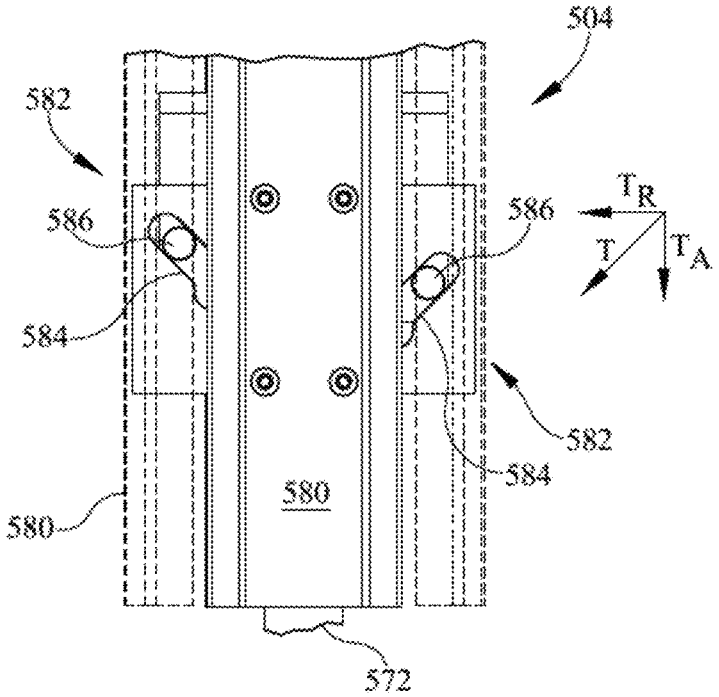
FIG. 22B is a partial elevational view of the collection roller from the unwrapping apparatus of FIGS. 18-19, in a partially collapsed configuration, and inverted relative to FIG. 22A.

With specific reference to FIGS. 21 and 22A-22B, collection roller 504 in the illustrated embodiment may also include a collapsible core configured to facilitate stretch film removal when the collection roller is in the unloading position. The collection roller 504 is reconfigurable between extended (as illustrated in FIGS. 20A-20B and 22A and collapsed (as illustrated in FIGS. 20C and 22B) configurations. Collection roller 504 is configured to be in the extended configuration during a wrapping operation, and then is reconfigurable into the collapsed configuration when in the unloading position to reduce a cross-sectional size of collection roller 504 and thereby allow for removal of the roll of stretch film from the collection roller through axial movement of the roll of stretch film along axis 518.

In the illustrated embodiment, and with reference to FIG. 21, collection roller 504 may include a plurality of faces (e.g., four) 580 coupled to shaft member 572 through a plurality of collapsible couplers 582, each of which including a pair of tracks 584 and associated cam followers 586. As illustrated in FIG. 22A, each track 584 includes an angled portion that projects in a direction T, which includes both an axial component TA and a radial component TR. The combination of axial and radial components in this manner allows for the collection roller to be configured in the extended configuration when the collection roller is in the unwrapping configuration illustrated in FIG. 22A, as the influence of gravity in this configuration urges faces 580 both downwardly and outwardly. In some embodiments, gravity alone may be sufficient to maintain the collection roller in the extended configuration. In other embodiments, however, and as illustrated in FIG. 18, it may be desirable to include a stop member 588 proximate second end 554 of collection roller 514, e.g., on roller bracket 548 or supported on base 514 proximate roller drive 536, to restrict upward movement of faces 580 when collection roller 504 is in the unwrapping position.

When collection roller 504 is pivoted to the unloading position, however, the influence of gravity no longer urges faces 580 outwardly, allowing collection roller 504 to transition to the collapsed configuration, as illustrated in FIG. 22B. In some embodiments, the unloading position may be beyond a substantially horizontal orientation, as illustrated in FIG. 20C, such that the influence of gravity may be sufficient to urge faces 580 inwardly and downwardly (due to the somewhat inverted orientation of the collection roller relative to the unwrapping position). Irrespective of whether the unloading position is beyond a horizontal orientation, however, it will be appreciated that a force that urges the faces axially in the direction of second end 554 will likewise urge the faces inwardly to collapse the collection roller. Such a force, in some embodiments, may result from pulling or otherwise moving a roll of stretch film collected on the collection roller in an axial direction along axis 518, which occurs when removing the roll of stretch film from the collection roller.

As such, in some embodiments, movement of collection roller 504 between extended and collapsed configurations may be substantially manual or mechanical in nature. In other embodiments, however, movement may be electro-mechanical in nature, e.g., using an electronically-controlled actuator 590 and controllable, for example, by a controller 592 of unwrapping apparatus 500 (see FIG. 19). Actuator 590 may be implemented in various manners, e.g., using an electric motor, a solenoid, a linear actuator, a hydraulic actuator, or a pneumatic actuator (among others). Where electro-mechanical reconfiguration is used, various alternative mechanisms may be used to couple faces 580 to shaft member 572, so the invention is not limited to the particular configurations illustrated herein.

With reference again to FIG. 18, in some embodiments it may also be desirable to support or otherwise limit movement of collection roller 504 beyond the unloading position. For example, a pair of wheels 594 may be used in some embodiments to both support collection roller 504 and allow for axial movement of a roll of stretch film collected thereon.

In operation, when performing an unwrapping operation, and as illustrated in FIGS. 18-20A, collection roller 504 is initially oriented in the unwrapping position. Initially, a free end 596 of stretch film 506 is secured to collection roller 504, either to the collection roller itself, or by securing the stretch film to itself when wrapped around the collection roller, or by securing the stretch film to a previous length of stretch film collected on the roller, as the tackiness of the stretch film is generally enough to resist separation of the stretch film from the collection roller while winding the stretch film onto the collection roller.

The unwrapping operation may then commence, e.g., in response to operator input to controller 592, whereby relative rotation between load 508 and collection roller 504 may be initiated by rotational drive 516 and rotation of collection roller 504 may be initiated by roller drive 536. It will be appreciated that due to the spiral wrapping of stretch film 506 around load 508, stretch film 506 will wind around collection roller 504 at various elevations along collection roller 504, as illustrated by dashed lines in FIG. 19, which generally results in the formation of a roll of stretch film 598 having a length along axis 518 corresponding generally to the distance between the opposing edges 520, 522 of stretch film 506 initially on load 508.

The relative rates of rotation of drives 516, 536 may be fixed in some embodiments, or the rate of rotation of drive 536 may be controlled in various manners as described above. Both drives 516, 536 operate until all stretch film from the load is collected from load 508, at which point drives 516, 536 may be deactivated, either manually by an operator, or automatically as a result of detecting the removal of all stretch film from the load. Where tension in the web of stretch film extending between the load and collection roller 504 is monitored, or where an idle roller is interposed between collection roller 504 and load 508, for example, a lack of sensed tension or a lack of rotation of the idle roller may be used to removal of all stretch film from the load.

Thereafter, additional loads may be unwrapped in a similar manner, which the free end 596 of the stretch film on each load initially secured to the existing roll 598 of stretch film collected on collection roller 504. It will be appreciated that the elevation at which the free end is secured will generally dictate where on the collection roll the stretch film is initially secured. Moreover, particularly when the stretch film is to be recycled, rather than reused, the free end 596 may not need to be secured to the tail of the stretch film collected from the preceding load, and may instead form a seal with any portion of the stretch film already wound about the collection roller.

Once multiple loads (e.g., up to 10 loads in some embodiments, and up to 100-200 loads or more in some embodiments) have been unwrapped and collected by collection roller 504, the roll 598 of stretch film may be removed from collection roller 504. In some embodiments, a determination of when to remove the roll of stretch film may be handled manually by an operator, while in other embodiments, the determination of a need to remove the roll of stretch film may be automated, e.g., based on a predetermined number of unwrapping operations being performed, or based on sensor input such as roller weight as sensed by a weight sensor, or roll thickness or roller radius as sensed by a dimensional sensor. It may be desirable in some embodiments, for example, to remove a roll based on material handling issues related to the weight of the roll, e.g., 50-60 pounds in some embodiments.

To remove the roll of film in some embodiments, an operator may release locking or latching mechanism 558 and move collection roller 504 from the unwrapping position to the unloading position. In some embodiments, release of locking or latching mechanism 558 and/or movement of collection roller 504 to the unloading position may be initiated in response to operator input to 592, or alternatively, may be performed manually by the operator. In some embodiments, it may also be desirable to rotate rotating arm 512 to the rotational position illustrated in FIGS. 20B and 20C (which is about 90 degrees from the home position illustrated in FIG. 18) such that the collection roller extends front-to-back rather than side-to-side relative to base 514.

As noted above, when collection roller 504 is in the unloading position, collection roller 504 is allowed to transition to the collapsed configuration, thereby enabling the roll 598 of stretch film to be removed from the collection roller through axial movement along axis 518. The roll 598 may then be prepared for recycling or reuse. In some embodiments, for example, the roll may be stacked on a pallet or other container with other rolls for transport to a recycling facility. Recycling, in this regard, may include processing for various uses, e.g., by shredding and/or pelletizing the stretch film for incorporation into newly-manufactured stretch film, as well as various other industrial and/or consumer uses that will be apparent to those of ordinary skill in the art having the benefit of the instant disclosure.

It will be appreciated that in other embodiments, removal of the roll 598 of stretch film from collection roller 504 may be partially or fully automated, e.g., using grippers, rotating wheels, or other automated mechanisms capable of pulling the stretch film from the collection roller. In addition, while cutting may be used to remove the stretch film from the collection roller in some embodiments, it is generally desirable in some embodiments to remove the stretch film from both the load and from the collection roller without having to cut any of the stretch film.

Incremental Unwrapping and Depalletization

It will be appreciated that an unwrapping apparatus as described herein may be used in connection with depalletization of a load, i.e., in connection with removing the stacked layers of items disposed in a load at a destination location. Moreover, in some embodiments, it may be desirable to utilize such an unwrapping apparatus in connection with incremental unwrapping and depalletization, where a load is unwrapped, and items are removed from the load, in an incremental manner (i.e., removal of at least some items from the load is performed prior to completely unwrapping the load). In some embodiments, for example, incremental unwrapping and depalletization may occur on a layer-by-layer basis, where unwrapping occurs to expose at least a portion of one or more layers among the stacked layers and items are removed from the exposed layer(s) prior to proceeding with further unwrapping.

In some embodiments, for example, a controller of an unwrapping apparatus may be configured to controllably pause relative rotation between a take up device and a load after exposing a predetermined layer of a plurality of stacked layers to allow for removal of one or more items from the layer. It will be appreciated that the manner in which a layer is exposed sufficiently to allow for removal of items from the layer may vary in different embodiments.

Figure 25:
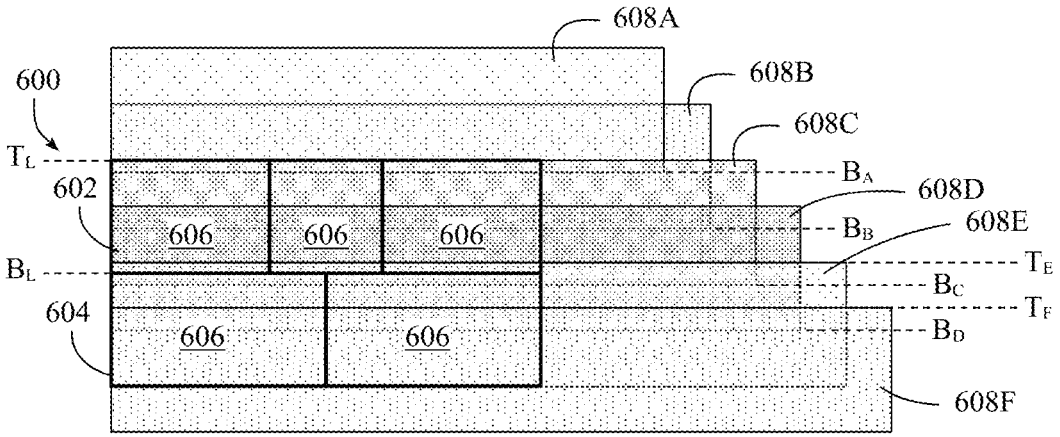
FIG. 25 is a functional view illustrating various manners of exposing a layer of a load using an incremental unwrapping and depalletization operation consistent with the invention.

For example, as illustrated in FIG. 25, a load 600 may include a plurality of stacked layers (e.g., layers 602, 604), each including a plurality of items (e.g., boxes) 606). To illustrate various elevations of stretch film suitable for exposing layer 602 in various embodiments, six stretch films 608A, 608B, 608D, 608E, and 608F are illustrated. In the illustrated example, these stretch films are illustrated as extending substantially horizontally, although it will be appreciated that in many instances, at least portions of the stretch film will extend at an angle due to the spiral nature of the wrapping, so the discussion below regarding the elevation of a stretch film with respect to a particular layer may refer to only a portion of the stretch film (e.g., a point on the stretch film) rather than the entire length of stretch film that wraps around the load.

In order to expose layer 602 to allow for removal of one or more items from the layer, it may be desirable in some embodiments to unwrap the stretch film wrapped around the load to an elevation that is relative to the top ($T_L$) and/or bottom ($T_B$) of the layer. For example, as illustrated by stretch film 608A, in some embodiments exposure of the predetermined layer may result from unwrapping the load to a point where a bottom edge ($B_A$) of the stretch film being removed from the load is positioned proximate a top of the predetermined layer, while in some embodiments, as illustrated by stretch film 608B, exposure of the predetermined layer may be result from unwrapping the load to a point where the bottom edge ($B_B$) of the stretch film being removed from the load is positioned below the top ($T_L$) of the predetermined layer. In still other embodiments, as illustrated by stretch film 608C, such exposure of the predetermined layer may be result from unwrapping the load to a point where the bottom edge ($B_C$) of the stretch film being removed from the load is positioned proximate the bottom ($B_L$) of the predetermined layer, and in some embodiments, as illustrated by stretch film 608D, such exposure of the predetermined layer may be result from unwrapping the load to a point where the bottom edge ($B_D$) of the stretch film being removed from the load is positioned below the bottom ($B_L$) of the predetermined layer. In still other embodiments, as illustrated by stretch film 608E, such exposure of the predetermined layer may be result from unwrapping the load to a point where the top edge ($T_E$) of the stretch film being removed from the load is positioned proximate the bottom ($B_L$) of the predetermined layer, and in some embodiments, as illustrated by stretch film 608F, such exposure of the predetermined layer may be result from unwrapping the load to a point where the top edge ($T_F$) of the stretch film being removed from the load is positioned below the bottom ($B_L$) of the predetermined layer.

In addition, in some embodiments, exposure of layer 602 may occur when a controlled pause is initiated after unwrapping substantially all stretch film above a top surface of layer 602, i.e., when the elevation of the stretch film still remaining on the load has a top edge that is substantially at or below the elevation of the top ($T_L$) of layer 602. In some embodiments, exposure of layer 602 may occur when a controlled pause is initiated after unwrapping substantially all stretch film above a bottom surface of layer 602, i.e., when the elevation of the stretch film still remaining on the load has a top edge that is substantially at or below the elevation of the bottom ($B_L$) of layer 602. In addition, in some embodiments, exposure of layer 602 may occur when a controlled pause is initiated after unwrapping stretch film covering at least a portion of the side surfaces of layer 602, e.g., the side surfaces of items 606 in layer 602 that are visible in FIG. 25.

Exposure of a predetermined layer generally involves the exposure of a top of the layer, thereby enabling removal of items from the layer via manual or automated removal. In some embodiments, exposure of a predetermined layer may also involve exposure of at least a portion of one or more sides of the layer. It will be appreciated, for example, that stretch film wrapped around a layer of a load will generally apply a containment force to the layer, which in some instances may complicate removal of items that are bound within the layer by the containment force. As such, in some embodiments, exposing at least a portion of one or more sides of the layer may reduce or remove the containment force to facilitate item removal. In other instances, however, particularly when a layer is irregular in nature and gaps exist between items in the layer, items may be removed without exposing any portion of any side of the layer. Moreover, once a single item is removed from a layer, containment force is also generally reduced or removed as the remaining items are allowed to shift into the void left by the removed item.

As noted above, controlled pausing of relative rotation between a take up device and a load is generally performed in association with exposure of a layer of load via unwrapping in order to allow for removal of items in the layer from the load. A controlled pause, in this regard, may be considered to be a controlled modification in the relative rotation between a take up device and a load that provides sufficient time to remove the items from the load. In some embodiments, a controlled pause may include a temporary discontinuation of relative rotation between the take up device and the load such that no relative rotation occurs during item removal for a particular layer. In other embodiments, a controlled pause may only include a decrease in the rate of relative rotation sufficient to facilitate item removal.

Further, in some embodiments, regardless of whether or not a controlled pause results in a full discontinuation of relative rotation, incremental unwrapping and depalletization may also include incremental adjustment of the orientation of a load during depalletization of a layer of the load. For example, it may be desirable in some embodiments to enable a load to be rotated relative to an operator (e.g., via rotation of the load or a platform upon which the operator is positioned) during removal of items from a particular layer to enable an operator to reach all items in the layer. In some embodiments, for example, an operator may remove some of the items in the layer from one side of the load, the load may be rotated about 180 degrees, and then the operator may remove the rest of the items in the layer from the opposite side of the load.

Control over a controlled pause may be manual in some embodiments or may be partially or fully automated. For example, in some embodiments, a controller may unwrap a load until the top layer is exposed and controllably pause relative rotation to permit an operator or robot to remove the items in the top layer. Once the items have been removed, the controller may be notified that unwrapping of the next layer may be initiated (e.g., via an operator activating a control or via a command from a robot), and the controller may restart relative rotation and then controllably pause relative rotation once the next layer is exposed. Alternatively, a controller may detect when the items from an exposed layer have been removed, and automatically restart relative rotation until the next layer is exposed. As another alternative, a controller may be programmed to start and stop relative rotation at predetermined intervals to implement controlled pauses. Other manners of controlling an incremental unwrapping and depalletization operation may be used in other embodiments, as will be appreciated by those of ordinary skill in the art having the benefit of the instant disclosure.

In addition, while the discussion hereinafter focuses on incremental unwrapping and depalletization that occurs on a single layer-by-single layer basis, in other embodiments controlled pauses may be utilized after two or more layers have been exposed, such that items from multiple layers may be removed from the load before relative rotation restarts to expose additional layers of the load.

Figure 26:
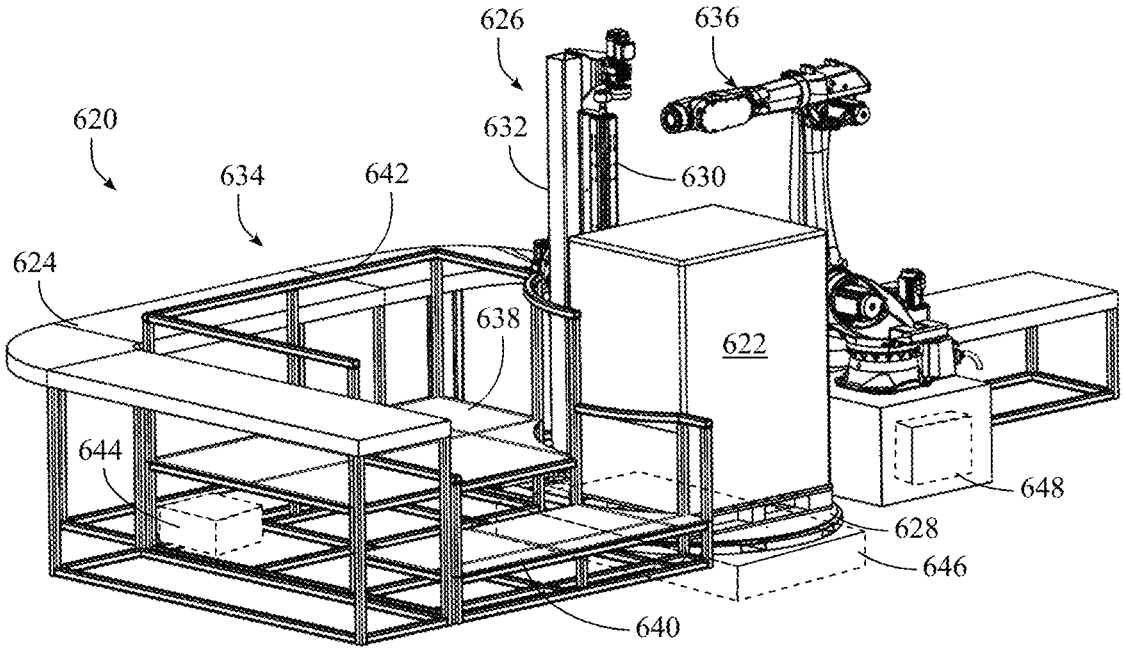
FIG. 26 is a perspective view of an example embodiment of an incremental unwrapping and depalletization apparatus consistent with the invention.

Now turning to FIG. 26, an example incremental unwrapping and depalletization apparatus 620 is illustrated in greater detail. Apparatus 620 may be used to unwrap and depalletize a load 622 and is disposed adjacent a conveyor 624 upon which items from load 622 may be placed for conveyance to another station or system. It will be appreciated that conveyor 624 is illustrated merely for the purposes of convenience, and that items removed from a load may be moved to various alternative locations for different purposes, e.g., for storage, distribution, sorting, etc.

Figure 27:
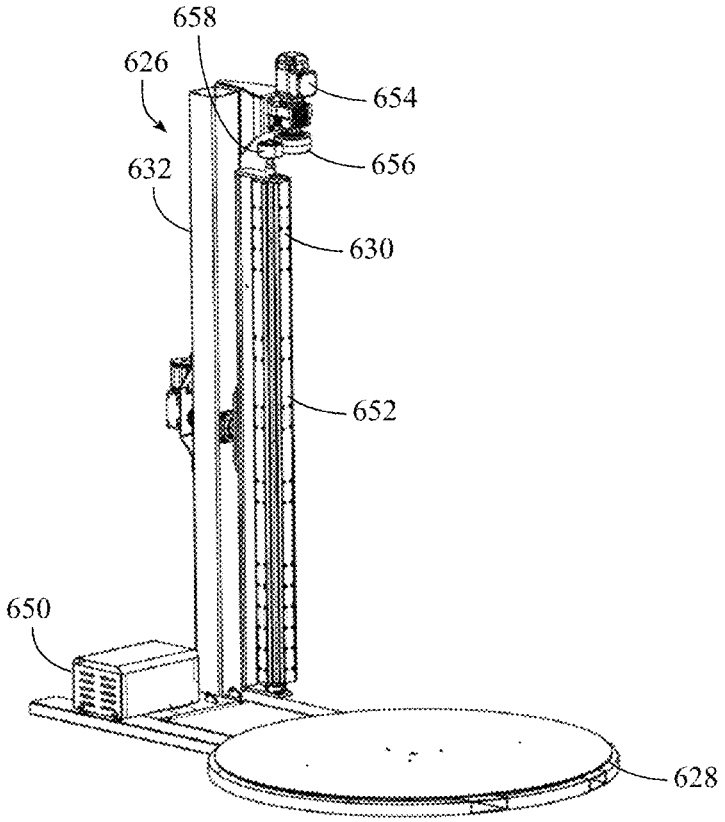
FIG. 27 is a perspective view of the unwrapping apparatus from the incremental unwrapping and depalletization apparatus of FIG. 26.

With additional reference to FIG. 27, apparatus 620 includes an unwrapping apparatus 626, which in the illustrated embodiment is a turntable-based unwrapping apparatus including a turntable 628 for rotating load 622 relative to a take up device 630 supported on a mast 632. Load 622 may be placed on turntable 628 via a lift truck or fork truck in some embodiments, and it will be appreciated that in other embodiments, load 622 may be positioned in an unwrapping position in other manners, e.g., via a conveyor.

In the illustrated embodiment, apparatus 620 supports both manual (operator) and automated item removal, and as such includes a support platform 634 configured to support one or more operators proximate load 622 during manual removal of items from the load, as well as a robotic arm 636 configured to remove items from the load in an automated manner. In each instance, items may be placed on conveyor 624, and it will be appreciated that in some embodiments, some types of loads may be better suited for automated removal or manual removal, so manual or automated removal may be used for different types of loads in apparatus 620. In other embodiments, however, only manual or only automated removal may be supported, whereby an incremental unwrapping and depalletization apparatus may omit one or both of support platform 634 and robotic arm 636.

For manual item removal, support platform 634 in the illustrated embodiment includes multiple levels, e.g., levels 638, 640, to support an operator at multiple elevations to facilitate manual removal of items from different layers from a load, with level 638 generally suited for removal of higher elevation (upper) layers of load 622, and level 640 generally suited for removal of lower elevation layers of load 622. A railing system 642 may also be provided to physically separate the operator from conveyor 624 and unwrapping apparatus 626 in some embodiments, and may have multiple elevations selected to facilitate item placement on conveyor 624 and item removal from load 622. Greater or fewer levels may be used in other embodiments, and in some embodiments one or more levels may be height adjustable, i.e., be movable between a plurality of elevations. Such movement may be automated in some embodiments, e.g., using an optional actuator 644 capable of raising or lowering the elevation of platform 638. Further, in some embodiments, control over the elevation of a level may be integrated with control over incremental unwrapping, e.g., such that the elevation automatically changes as each layer of the load is exposed and items are removed from the layer.

In addition, rather than (or in addition to) changing the elevation of the operator via the use of multiple levels and/or via a movable level, in other embodiments the elevation of the load 622 may be controlled, e.g., via an optional lift system 646 capable of lifting all or a portion of unwrapping apparatus 626 (e.g., turntable 628).

It will be appreciated that a wide variety of platform configurations may be used in other embodiments depending, for example, upon particular application needs. As such, the invention is not limited to the specific platform configuration illustrated in FIG. 26.

Robotic arm 636 may be configured in various manners, and may include an end effector suitable for removing particular types of items (e.g., boxes) from load 622 and placing them on conveyor 624. Other depalletizing equipment suitable for removing items from a load, e.g., depalletizing equipment configured to pick up various types of items disposed in regular arrays (e.g., bottles, cans, containers, etc.), may also be used in other embodiments.

Control over apparatus 620 may be implemented using one or more controllers, e.g., controller 648. Separate interfaced controllers may be used to control the various components of apparatus 620 in some embodiments, although a single controller may also be used in some embodiments.

Now turning to FIG. 27, unwrapping apparatus 626 may be a turntable-based unwrapping apparatus, including a turntable 628 and a take up device 630 supported on a mast 632. A rotational drive 650 controllably rotates turntable 628 to provide relative rotation between a load and take up device 630. In addition, similar to unwrapping apparatus 500 of FIGS. 18-22B, take up device 630 may include a collection roller 652 that is driven by a roller drive 654 through a drive member 656 and driven member 658. Collection roller 652 is a pivotable, collapsible, extended height collection roller similar to collection roller 504 of unwrapping apparatus 500. It will be appreciated, however, that any of the various modifications described above in connection with unwrapping apparatus 500 may be utilized with unwrapping apparatus 626. Moreover, rather than a turntable-based unwrapping apparatus, a rotating arm-type or ring-type unwrapping apparatus may be used. In addition, it will be appreciated that stretch film collected from a load in an incremental wrapping and depalletization operation may be suitable for reuse, whereby a roll of stretch film suitable for use as a stretch film supply roll may also be collected in such an operation, or alternatively the collected stretch film may be recycled. Therefore, the invention is not limited to the specific unwrapping apparatus illustrated in FIG. 27.

Figure 28A:
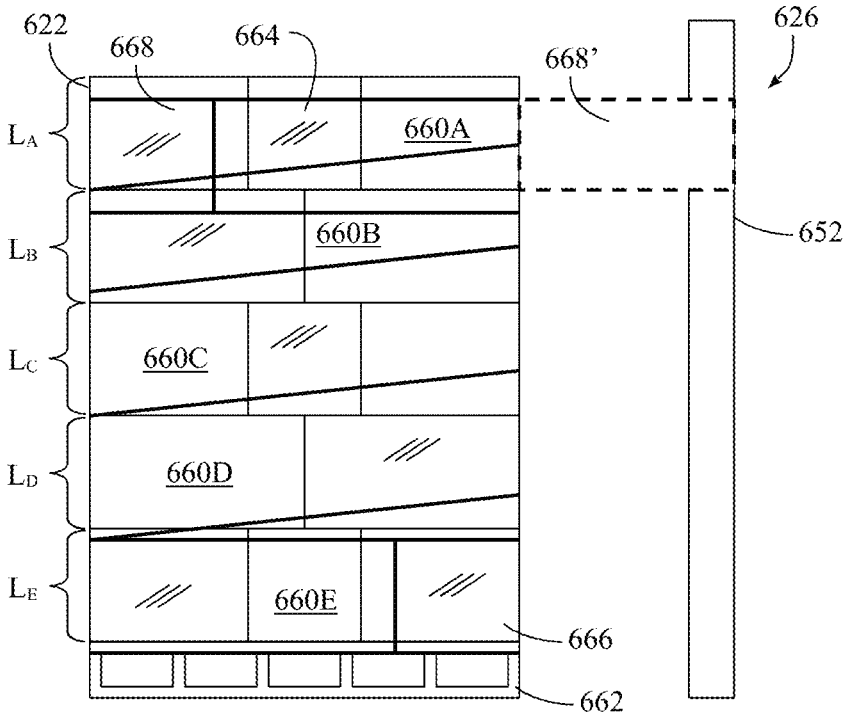
FIGS. 28A-28H are functional side elevational views illustrating an example incremental unwrapping and depalletization operation using the incremental unwrapping and depalletization apparatus of FIG. 26.

An example incremental wrapping and depalletization operation using apparatus 620 is illustrated in greater detail in FIGS. 28A-28H. In this example, and as illustrated in FIG. 28A, load 622 includes a plurality of stacked layers $L_A$, $L_B$, $L_C$, $L_D$, and $L_E$, each including a plurality of items (e.g., boxes) 660A, 660B, 660C, 660D, 660E supported by a pallet 662. A length of stretch film 664 is spirally wrapped around load 622, and in the illustrated embodiment, the stretch film is wrapped bottom to top such that a leading end 666 (from a wrapping perspective) is proximate a bottom of the load, while a tail end 668 (again, from a wrapping perspective) is proximate a top of the load.

It will be appreciated that for incremental unwrapping purposes, it is generally desirable to wrap starting from proximate the bottom of the load, such that layers can be incrementally exposed for item removal from a top to bottom direction until the end of the length of stretch film has been detached from the load. In some embodiments, the entire length of stretch film may be spirally wrapped from bottom to top in a single pass, while in other embodiments, multiple passes may be made in order to increase the amount of stretch film applied to the load. For example, wrapping in some embodiments may start proximate the bottom of the load, spiral upward to proximate the top of the load during a first pass, and then spiral downward back to proximate the bottom of the load during a second pass. In still other embodiments, more than two upward and/or downward passes may be performed. It will also be appreciated that the amount of overlap between successive revolutions of the stretch film may vary, and that additional wraps near the top and/or bottom of the load may be performed in some embodiments. Regardless of the number of passes, extra wraps, and/or overlap used, however, incremental unwrapping desirably exposes the layers of the load from top to bottom such that items may be depalletized from the load incrementally in one or more layers at a time.

Thus, as illustrated in FIG. 28A, to initiate an incremental wrapping and depalletization operation, the tail end 668 of stretch film 664, which now may be considered to be a leading end from the perspective of unwrapping, is attached to collection roller 652 as illustrated at 668'. In this example, no prior stretch film has been collected by collection roller 652, so attachment is directly to collection roller 652; however, if some stretch film has already been collected, then end 668 may be attached to a roll of stretch film already present on the collection roller. It will be appreciated that if the load is wrapped using more than one upward and/or downward pass, then end 668 may be disposed at different elevations on the load, and thus attached at different elevations on collection roller 652.

Figure 28B:
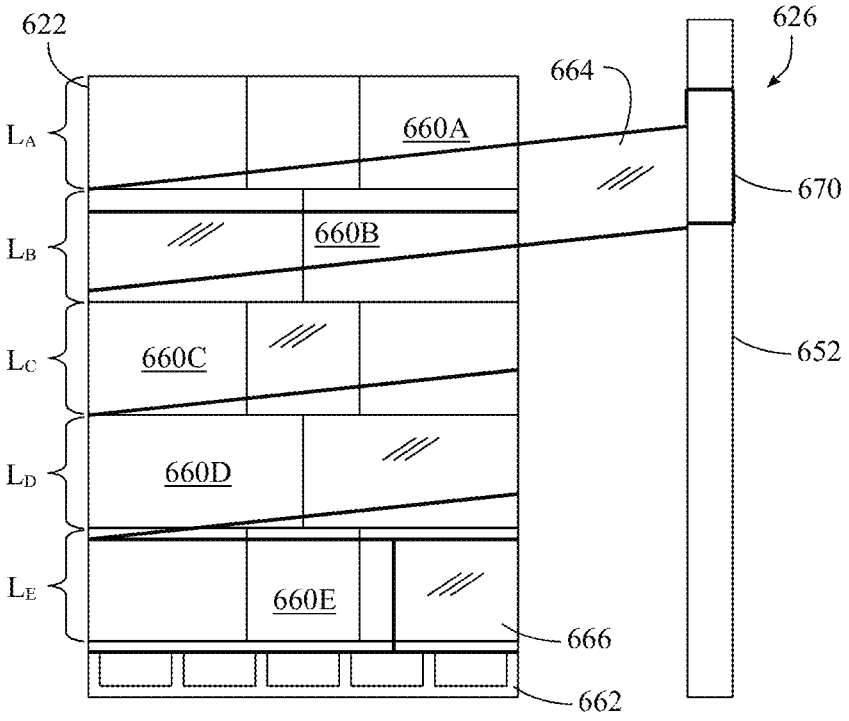

With additional reference to FIG. 27, unwrapping is then initiated (e.g., by controller 648) by generating relative rotation between collection roller 652 and load 622 through rotation of turntable 628 by rotational drive 650, as well as rotating collection roller 652 using roller drive 654. Stretch film 664 is then collected on collection roller 652 to form a roll 670 of stretch film. Unwrapping proceeds until layer $L_A$ is exposed, as illustrated in FIG. 28B, at which point relative rotation between the load and the collection roller is controllably paused (e.g., stopped). For this layer, exposure is shown occurring when the top edge of the stretch film extending from the load is proximate the bottom of layer $L_A$ and the bottom of the stretch film extending from the load is below the bottom of layer $L_A$, although any of the other elevations described above in connection with FIG. 25 may be used to trigger a controlled pause in other embodiments.

Figure 28C:
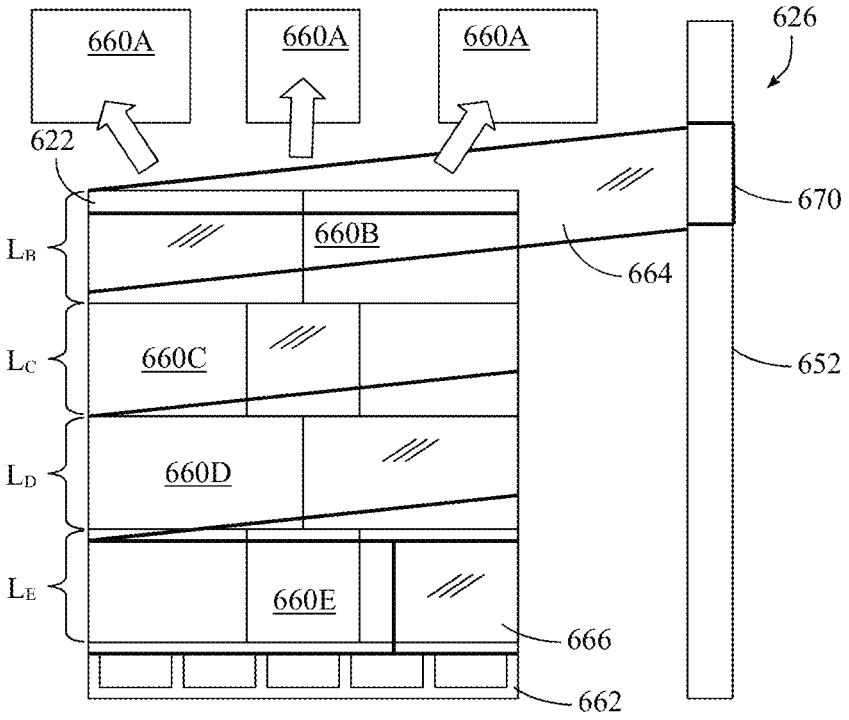
Figure 28D:
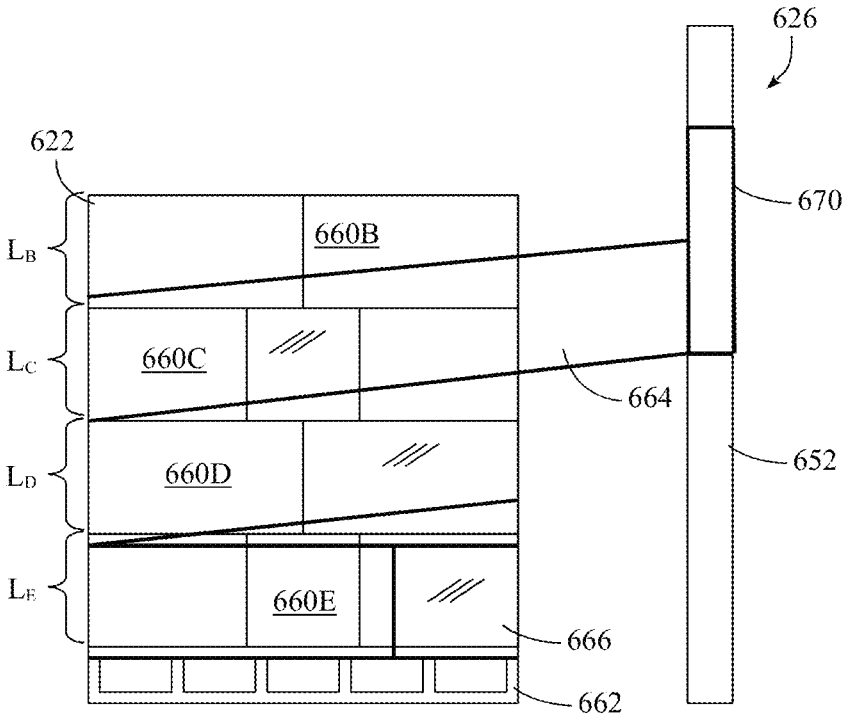

Next, as illustrated in FIG. 28C, the items 660A from layer $L_A$ may be removed from load 622, either by an operator or by a robotic arm or other automated depalletization equipment. The controlled pause may then be discontinued and relative rotation may again be commenced until layer $L_B$ is exposed, as illustrated in FIG. 28D, at which point relative rotation between the load and the collection roller is again controllably paused. For this layer, exposure is shown occurring when the top edge of the stretch film extending from the load is still above the bottom of layer $L_B$ but with the bottom of the stretch film extending from the load being below the bottom of layer $L_B$, although again any of the other elevations described above in connection with FIG. 25 may be used to trigger a controlled pause in other embodiments.

Figure 28E:
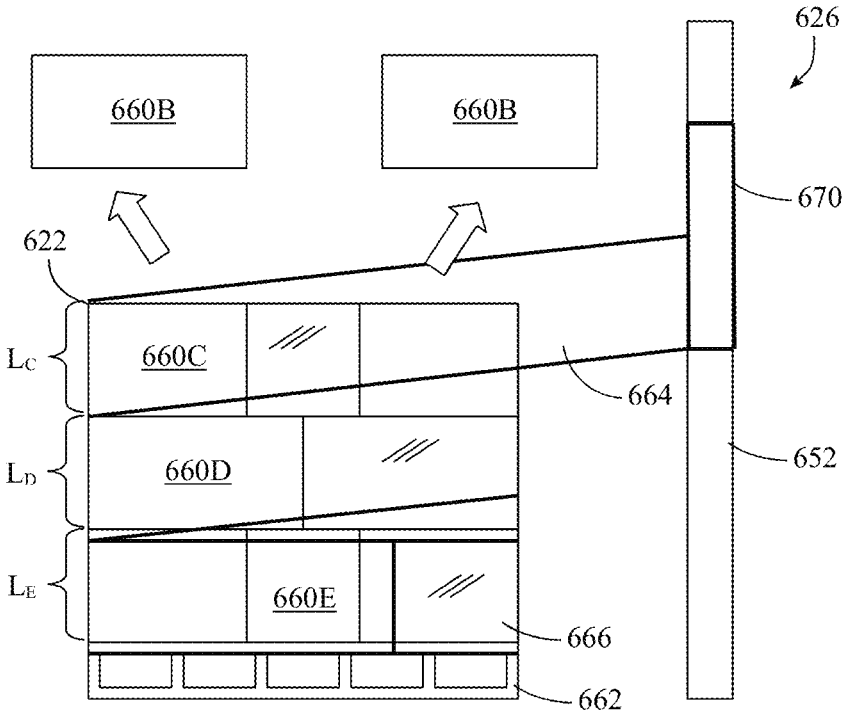

Next, as illustrated in FIG. 28E, the items 660B from layer $L_B$ may be removed from load 622, either by an operator or by a robotic arm or other automated depalletization equipment. The controlled pause may then be discontinued and relative rotation may again be commenced until layer $L_B$ is exposed, as illustrated in FIG. 28D, at which point relative rotation between the load and the collection roller is again controllably paused. Then, as illustrated in FIG. 28E, the items 660B from layer $L_B$ may be removed from load 622, either by an operator or by a robotic arm or other automated depalletization equipment.

Similar steps may be then be performed to incrementally expose layers $L_C$ and $L_O$ and remove items 660C and 660D from these layers. In addition, when removing items from any of layers $L_A$-$L_D$, it will be appreciated that load 622 may be reoriented at various points during the removal by generating relative rotation between the load and the collection roller (e.g., by rotating turntable 628) some portion of a full revolution (e.g., 90, 180 or 270 degrees in some embodiments) to facilitate manual removal of items. In one embodiment, for example, an operator may remove the items closest to the operator when the controlled pause is initiated for a particular layer and then activate a control to rotate the load 180 degrees to orient the remaining items in the layer closer to the operator to facilitate removal of those remaining items by the operator.

Figure 28F:
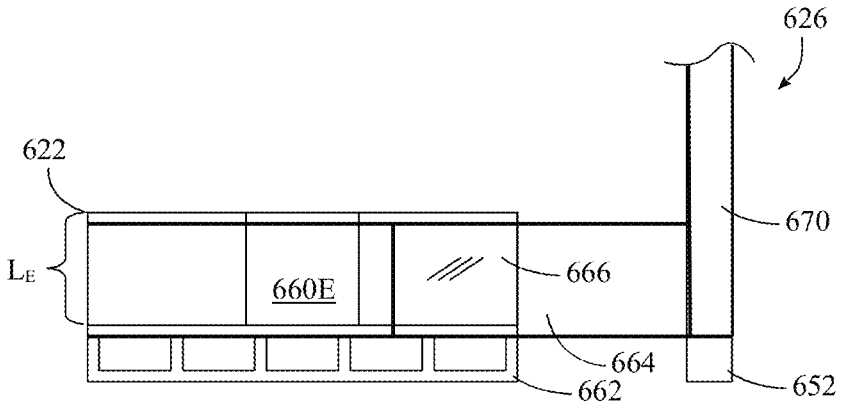

As shown in FIG. 28F, after removal of the items from these layers, it may be the case that stretch film 664 has been unwrapped until the elevation of the stretch film extending from the load has reached a point where the top edge of the stretch film extending from the load is either above, proximate, or slightly below the top of layer $L_E$, as well as where the bottom edge of the stretch film extending from the load is either above, proximate, or slightly below the bottom of layer $L_E$. At this point, additional wrapping may be performed to further expose layer $L_E$ in some instances (and in some instances, to remove the remaining stretch film altogether), although in other embodiments, by virtue of the removal of the items of layers $L_A$-$L_D$ and the loosening of stretch film 664, layer $L_E$ may be sufficiently exposed even in the scenario illustrated in FIG. 28F to allow for items 660E to be removed from the load. Note that this exposure may also be used to incrementally remove layers above layer $L_E$ in some embodiments.

Figure 28G:
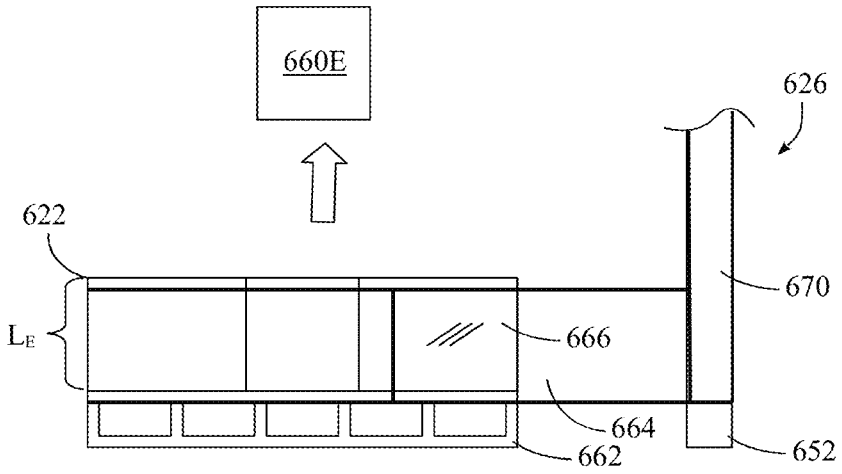
Figure 28H:
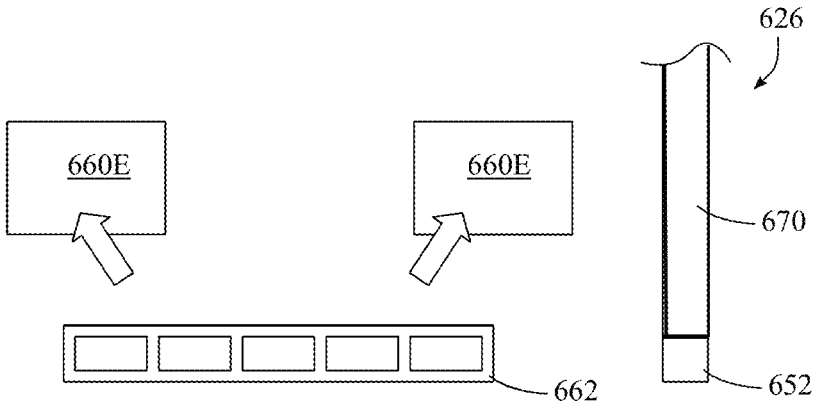

Thus, as illustrated in FIG. 28G, it may be desirable in some embodiments to remove one or more items 660E with stretch film 664 at the elevation illustrated in the figure. In some instances, for example, one or more items 660E disposed towards the center of the layer may be removed, which loosens the stretch film wrapped around the load due to the void left by the removed items in the layer. Then as illustrated in FIG. 28H, the remaining items 660E may be removed, and relative rotation may again be restarted until all stretch film is unwrapped from the load. Unwrapping and depalletization of load 622 is then complete.

Figure 29:
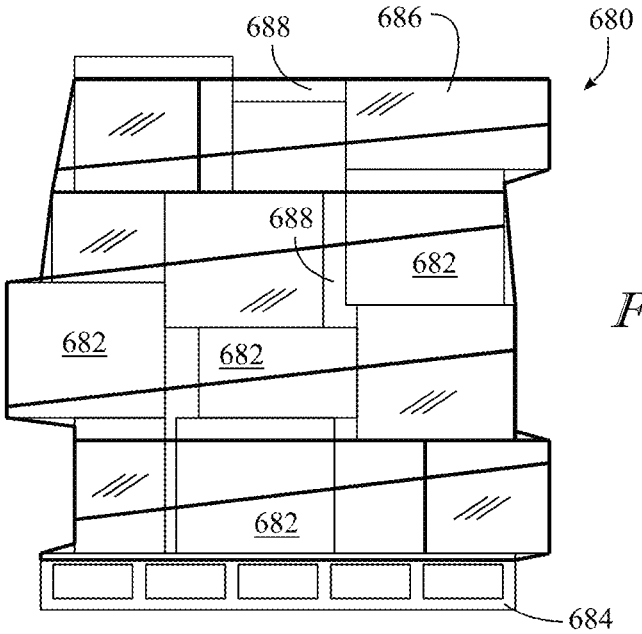
FIG. 29 is a side elevational view of an example irregular load capable of being unwrapped and depalletized using the incremental unwrapping and depalletization apparatus of FIG. 26.

While incremental unwrapping and depalletization may be performed on regular loads including regular arrays of items stacked in uniform layers, as illustrated in FIGS. 28A-28H, incremental unwrapping and depalletization may also be particularly useful for irregular loads that contain items stacked in irregular and/or non-planar layers and/or having non-uniform items and/or gaps or voids between items. FIG. 29, for example, illustrates an irregular load 680 including items 682 stacked in irregular, and in some instances, non-planar layers on a pallet 684 and wrapped with stretch film 686. As seen in this figure, for example, some items 682 overhang pallet 684 and/or items 682 disposed in lower layers, and multiple voids 688 are disposed throughout the load. Furthermore, rather than being arranged into layers having planar top and bottom surfaces, the top and/or bottom surfaces of various layers may have different elevations. Irregular loads within this context of this disclosure may include one or more of these irregularities, and it will be appreciated that an irregular load may be considered to be irregular even if one or more such irregularities do not exist.

With conventional unwrapping and depalletization, stretch film 686 may be unwrapped by cutting the stretch film one or more times vertically from top to bottom (either manually using a box cutter or other knife or in an automated fashion using a knife, heated wire or hot air) to remove all of the stretch film as a single sheet or as multiple sheets, with each sheet including multiple discontinuous sections of the spirally wrapped stretch film. However, for some irregular loads, a risk exists that conventional unwrapping using a vertical cut and removal of stretch film in one or more sheets may lead to instability in the load, e.g., due to a sudden release of tension in the stretch film that can displace or shift items in the load, due to items on upper layers being unbalanced on lower layers, and/or due to the entire load being unbalanced, which could result in some of all of the items in the load tipping over the sides of the load. In contrast, using incremental unwrapping and depalletization as described herein, as each layer is exposed, and items from the exposed layer are removed from the load, any layers below the exposed layer generally remain contained by the portion of the stretch film still wrapped around the load.

Unwrapping Apparatus with Controlled Take Up Device Elevation

Figure 30:
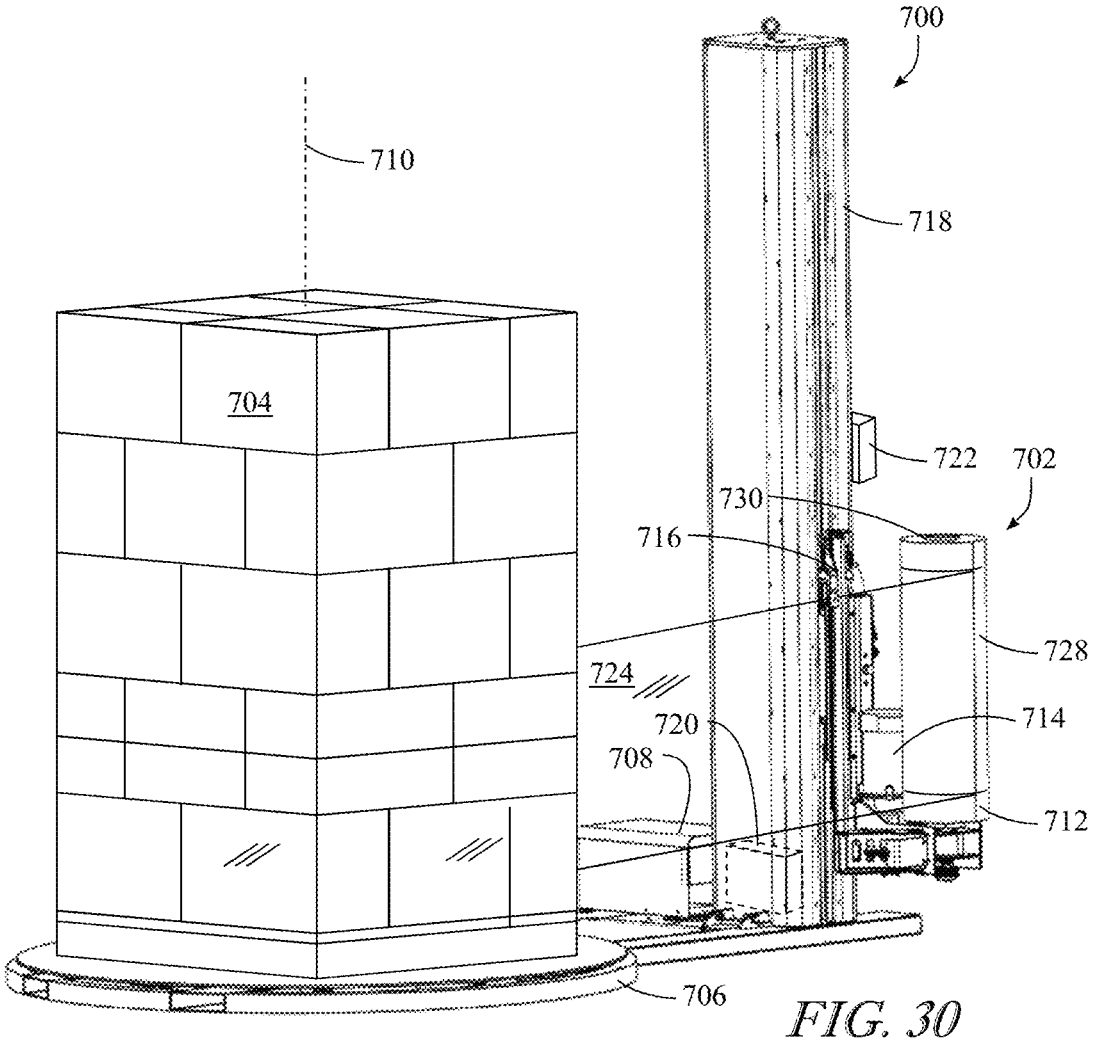
FIG. 30 is a perspective view of an example embodiments of an unwrapping apparatus including controlled take up device elevation consistent with the invention.

FIG. 30 illustrates another unwrapping apparatus 700 consistent with the invention, and utilizing a take up device with 702 a controllable elevation to collect stretch film from a load such as load 704. Unwrapping apparatus 700 may be suitable for use in reuse applications, although the unwrapping apparatus may also be used to collect stretch film for recycling purposes in other embodiments.

Unwrapping apparatus 700 is a turntable-type unwrapping apparatus, and includes a turntable 706 and a rotational drive 708 configured to generate relative rotation between take up device 702 and load 704 through rotation of turntable 706, and thus load 704, about an axis of rotation 710. It will be appreciated that relative rotation may be generated in other embodiments using, for example, a rotating arm or a ring to rotate take up device 702 around the load.

Take up device 702 includes a collection roller 712 driven by a roller drive 714 to rotate about an axis of rotation and supported on a film windup carriage 716 that is supported on a mast 718 and is movable along mast 718 in a substantially vertical direction by a lift drive 720. A controller 722 is coupled to each of rotational drive 708, roller drive 714 and lift drive 720 to perform an unwrapping operation to collect stretch film, e.g., a web 724 of which is illustrated as extending between load 704 and collection roller 712, from load 704.

Figure 31:
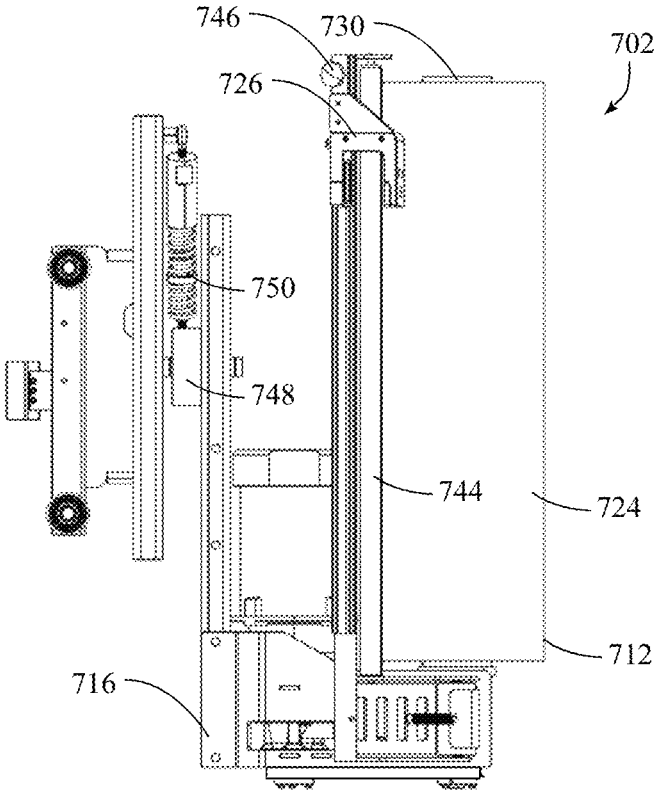
FIG. 31 is a front elevational view of the take up device of the unwrapping apparatus of FIG. 30.
Figure 32:
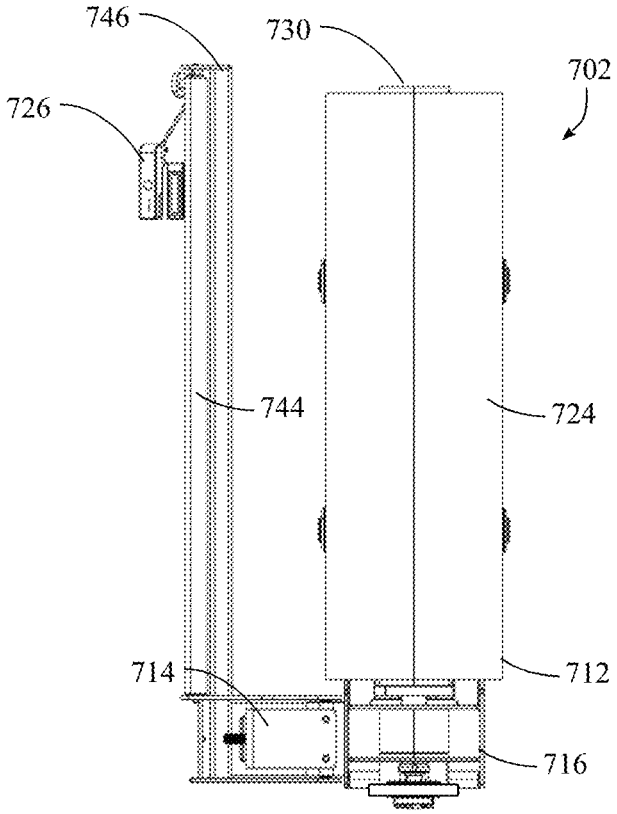
FIG. 32 is a side elevational view of the take up device of FIG. 31.

With additional reference to FIGS. 31-32, apparatus 700 also includes an alignment sensor 726 configured to sense the alignment of web 724, and the output of this sensor is used by controller 722 to control lift drive 720 to control the elevation of collection roller 712 of take up device 702 when collecting stretch film from load 704. Alignment sensor 726 in some embodiments may be configured to sense an edge of web 724 for the purpose of aligning the collected stretch film to form a roll 728 of stretch film on collection roller 712, and as such, controller 722 may control lift drive 720 during relative rotation to align the edges of the web with the edges of the roll and thereby produce a roll of stretch film similar to a stretch film supply roll used on a wrapping apparatus. Thus, in contrast, for example, to unwrapping apparatus 500 where collected stretch film forms a roll on collection roller 504 having a width that substantially exceeds the width of the web of stretch film wrapped around the load, unwrapping apparatus 700 desirably forms a roll on collection roller 712 that has a width that is substantially similar to that of the web of stretch film collected from the load. As such, when collected into such a roll form, the collected stretch film may be used in some embodiments to wrap other loads, e.g., by removing roll 728 from collection roller 712 and installing it as a stretch film supply roll in the film dispenser of a stretch wrapping apparatus.

In some embodiments, for example, collection roller 712 may be configured to support a removable core 730 onto which the roll 728 of stretch film is wound, and which is configured for installation in the film dispenser of a stretch wrapping apparatus, such that the roll is suitable for use as a stretch film supply roll in the stretch wrapping apparatus. In other embodiments, however, no core may be used, and roll 728 may be coreless.

Figure 33:
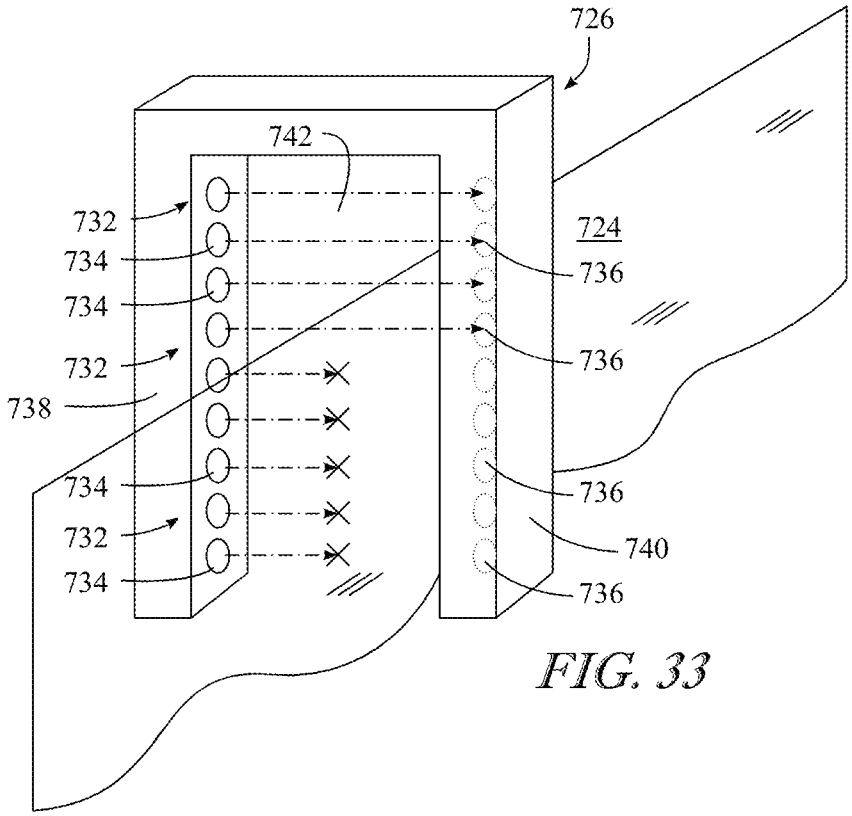
FIG. 33 is a functional perspective view of the alignment sensor of the unwrapping apparatus of FIG. 30.

With additional reference to FIG. 33, alignment sensor 726 may be configured as an edge detection sensor and may include an array of sensors 732 that are positioned to detect web 724 such that the edge of web 724 is detected based upon which of sensors 732 detects the web. In the illustrated embodiment, each sensor 732 is an ultrasonic sensor and includes an ultrasonic transmitter 734 and an ultrasonic receiver 736 that face one another and are supported by opposing members 738, 740 that define a gap 742 through which a portion of web 724 extends. It will be appreciated that as the relative angle of the web changes during the relative rotation, the surface of web 724 will selectively block the transmission paths between the ultrasonic transmitters and receivers of different sensors 732, such that the relative angle of the web 724, and thus the alignment of the web relative to the take up device 702, can be determined.

In some embodiments, and with reference to FIGS. 31-32, it may also be desirable to reduce angular variations of the web 724 within gap 742 during the relative rotation using a tracking roller 744 positioned intermediate alignment sensor 726 and collection roller 712. Tracking roller 744 may be a non-driven roller and may be pivotably supported on film windup carriage 716 by a spring-biased arm 746 that biases tracking roller 744 against the surface of web 724 in some embodiments. In other embodiments, tracking roller 744 may be omitted.

In addition, similar to film windup carriage 308 of unwrapping apparatus 300 of FIG. 12, film windup carriage 716 may be supported by a bearing 748 that allows for rotation of film windup carriage 716 about a substantially horizontal pivot axis. Doing so allows carriage 716 to tilt to align with the film unwind position on the load. Carriage 716 may be guided by the rigidity of the film web itself, and may be biased to a horizontal position by a spring 750 in some embodiments. In other embodiments, carriage 716 may be controllably tiltable by controller 722 in response to alignment sensor 726, e.g., using a tilt drive that controllably rotates the film windup carriage about bearing 748. In other embodiments, however, no tilting may be supported, and film windup carriage 716 may be maintained in a predetermined orientation, with control over alignment of the web of film being implemented solely through control over the elevation of the film windup carriage along mast 718 using lift drive 720.

To perform an unwrapping operation with unwrapping apparatus 700, a leading end of stretch film from load 704 is initially attached to collection roller 712, either manually by an operator, or by an automated mechanism. If stretch film is already collected on collection roller 712, attachment of the leading end of the stretch film forms a lap seal with the trailing end of the stretch film already wound onto collection roller 712. If no stretch film is already collected on collection roller 712, the stretch film is initially attached to core 730.

The unwrapping operation may then be initiated, e.g., in response to operator interaction with controller 722. Controller 722 controls rotational drive 708 to generate relative rotation between take up device 702 and load 704, and drives rotation of collection roller 712 using roller drive 714. In the illustrated embodiment, tension in web 724 is controlled by utilizing a torque feedback signal from roller drive 714 to maintain a substantially constant output torque. In one embodiment, for example, roller drive 714 includes a DC motor that provides a torque feedback signal to the controller, such that the torque feedback signal may be used to control the collection rate of the collection roller. An external torque sensor or load cell may be used in other embodiments.

In addition, during the unwrapping operation, the elevation of film windup carriage 716 is controlled using lift drive 720 and based on the output of alignment sensor 726. In some embodiments, for example, it is desirable for the edges of the web of stretch film collected on collection roller 712 to wind at substantially constant positions along the axis of rotation of the collection roller to minimize the amount of deviation between different layers of stretch film wound about the collection roller. In some embodiments, for example, a PID (proportional-integral-derivative) control algorithm may be used, although other algorithms may be used in other embodiments.

Unwrapping proceeds until all of the stretch film is removed from the load and collected by take up device 702, at which point the unwrapping operation may be terminated, e.g., based on operator input or based on a sensed drop in tension in the web. Load 704 may be removed from turntable 706 and a new load may be placed on the turntable and the leading end of the stretch film for that load may be attached to the trailing end of the stretch film collected from load 704 in order to prepare for a subsequent unwrapping operation for the new load.

Various modifications may be made to unwrapping apparatus 700 consistent with the invention. For example, rather than utilizing an ultrasonic array as illustrated in FIG. 33, sensors 732 may utilize other technologies such as optical or infrared transmission and detection. As another example, rather than utilizing spaced apart transmitters and receivers that detect the edge of a web of stretch film based upon whether the transmission paths between such transmitters and receivers are blocked, sensors incorporating co-located transmitters and receivers may be used to detect reflections off of the surface of web 724. In addition, multiple array sensors may be used to detect a web angle rather than a distance from a reference plane in some embodiments.

Figure 34:
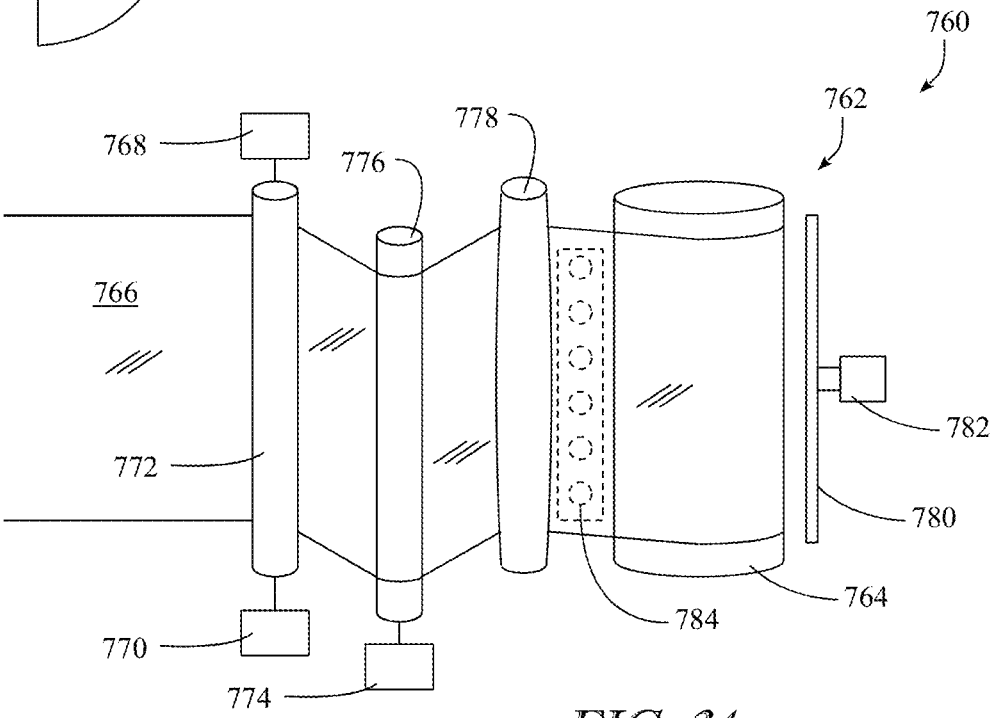
FIG. 34 functionally illustrates another example unwrapping apparatus consistent with the invention.

In addition, as illustrated in FIG. 34, another implementation of an unwrapping apparatus 760 may incorporate a take up device 762 utilizing a collection roller 764 for collecting a web 766 of stretch film from a load. In this embodiment, an alignment sensor may be implemented using a pair of force sensors 768, 770, e.g., load cells, coupled to sense force proximate opposite ends of a roller 772 around which web 766 wraps, which a difference in sensed force used to sense changes in alignment of the web relative to the take up device.

Unwrapping apparatus 760 also illustrates several additional variations that may be used independently or collectively in other embodiments. For example, a collection rate sensor 774, e.g., a force sensor such as a load cell, may be operably coupled to a roller 776 to sense tension in web 766, such that control over collection rate may be based on maintaining a substantially constant tension in web 766. In addition, a bowed roller 778 may be used to reduce wrinkling in the web of stretch film collected onto roller 764. It will be appreciated that different numbers of intermediate rollers such as rollers 772, 776, and 778 may be used in other embodiments, and that no intermediate rollers may be used in some embodiments as well. Further, other alignment and/or collection rate sensors may be used in other embodiments, and other manners of reducing wrinkling may also be used, as will be appreciated by those of ordinary skill in the art having the benefit of the instant disclosure. Moreover, as noted above, various collection rate control algorithms may be used, similar to the various types of dispense rate control algorithms capable of being used for a stretch wrapping apparatus, so the invention is not limited to a collection rate control based on torque or tension as is utilized in unwrapping apparatus 700 and unwrapping apparatus 760.

Another alignment sensor design that may be used in some embodiments, for example, may utilize a floating collar or finger that is mounted onto a roller that rests on the top edge of the stretch film, with a sensor, e.g., a laser distance sensor, used to identify a relative location from a target reference plane of the core. In addition, an additional sensor could be used to identify the target distance from the reference plane, or the distance can be mechanically fixed and accounted for in tracking logic.

In addition, as discussed above, it may be desirable in some embodiments to treat a portion of each lap seal and/or a portion of a roll of stretch film overlapped by each lap seal to reduce adhesion of the lap seal to the portion of the roll of stretch film. It will be appreciated that stretch film is inherently clingy, and may even be engineered with a tackifier to increase the stretch film's tendency to adhere to other layers of stretch film. Such clinginess is beneficial for maintaining containment force in a wrapped load as well as resisting any unwrapping of the tail end of the stretch film from a load during storage or transportation of the load. Such clinginess is also beneficial for forming lap seals between adjacent lengths of stretch film during unwrapping; however, when a roll of stretch film including lap seals is used on a stretch wrapping apparatus, a risk may also exist that the portion of the lap seal that is contiguous with the stretch film remaining on a roll will have greater adherence to the surface of the roll than to the portion of the lap seal being dispensed to a load, such that separation of the lap seal may occur and cause what is effectively a film break that requires a stretch wrapping operation to be stopped and restarted.

As such, in some embodiments it may be desirable to reduce the adherence of the lap seal to the portion of the roll of stretch film overlapped by that lap seal. In some embodiments, it may be desirable to utilize mechanical abrasion to reduce the tackiness of portions of the stretch film. As illustrated in FIG. 34, for example, an abrasive member 780 may be coupled to an actuator 782 that is configured to selectively bring the abrasive member into contact with the surface of collection roller 764 and/or the underside of the lap seal formed between adjacent lengths of stretch film being wound onto collection roller 764 to mechanically abrade the stretch film as it moves past the abrasive member. The abrasive member may be implemented in a number of manners, e.g., using sandpaper, emery paper, steel wool, scour pad material, or another suitable material that provides relatively mild abrasion of the surface of the stretch film.

Alternatively, and as also illustrated in FIG. 34, an applicator 784 may be positioned to apply a liquid or solid material to the collected stretch film to reduce the tackiness of portions of the stretch film. Various materials, e.g., powders, detergents, etc. may be deposited on the surface of the stretch film to reduce adhesion between a lap seal and the portion of the roll overlapped by the lap seal, as will be appreciated by those of ordinary skill in the art having the benefit of the instant disclosure. Either or both of abrasive member 780 and applicator 784 may be omitted from some embodiments.

Other modifications may be made to the illustrated embodiments, so the invention is not limited to the specific unwrapping apparatus designs disclosed herein.

Stretch Film Storage and Return

Storage and return of stretch film to a source location may be implemented in different manners consistent with the invention. For example, it may be desirable to utilize reusable pallets with supporting structures capable of supporting arrays of stretch film rolls, and in some instances, intermediate structures capable of supporting multiple layers of stretch film rolls. The pallets may be stackable in some embodiments, and may further include mechanical links to lock film rolls in position for shipment without damage. Pallets may also be configured to facilitate automated loading and/or unloading of film rolls. In some embodiments, for example, pallets may be loadable into an automated roll change assembly for a stretch wrapping apparatus such that film rolls may easily be loaded into a stretch wrapping apparatus after delivery to a source location with minimal manual intervention.

Test Apparatus

Some embodiments of the invention may also include a test apparatus configured to simulate film use cycles, including simulating stretch film wrapping operations and/or simulating stretch film unwrapping operations. A test apparatus may be configured, for example, similar to any of the test apparatus configurations described in U.S. Pat. No. 11,591,127, which is assigned to the same assignee as the present application, and which is incorporated by reference herein. Stretch film can be tested, for example, to determine appropriate wrap settings such as elongation/stretch (including pre-stretch and/or post-stretch) and/or wrap force to appropriately balance load containment with reusability. As noted above, elongation even below the measured yield point of a stretch film can still cause some degree of strain hardening, so selection of appropriate wrap settings to allow for sufficient load containment while minimizing strain hardening in each reuse cycle is generally desirable in many embodiments.

Figure 35:
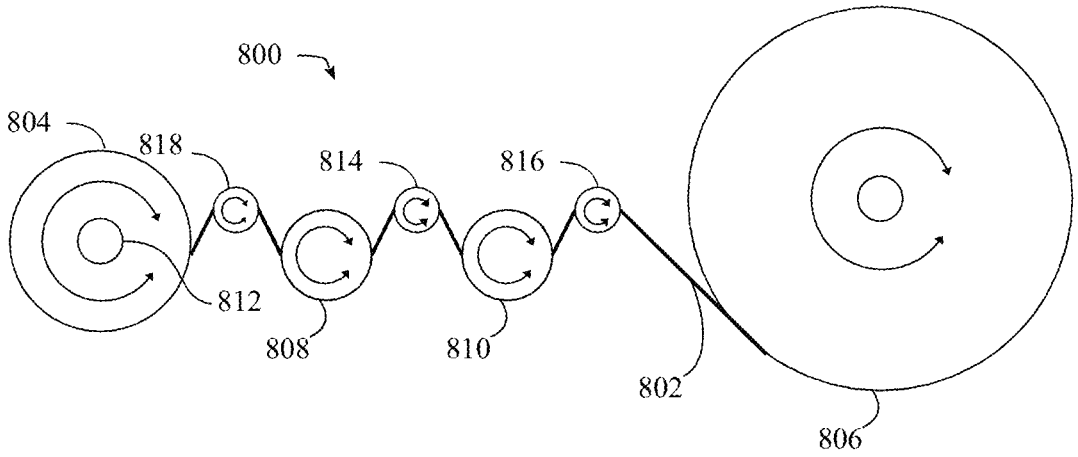
FIG. 35 functionally illustrates an example test apparatus suitable for testing stretch film for reusability consistent with the invention.
Figure 36:
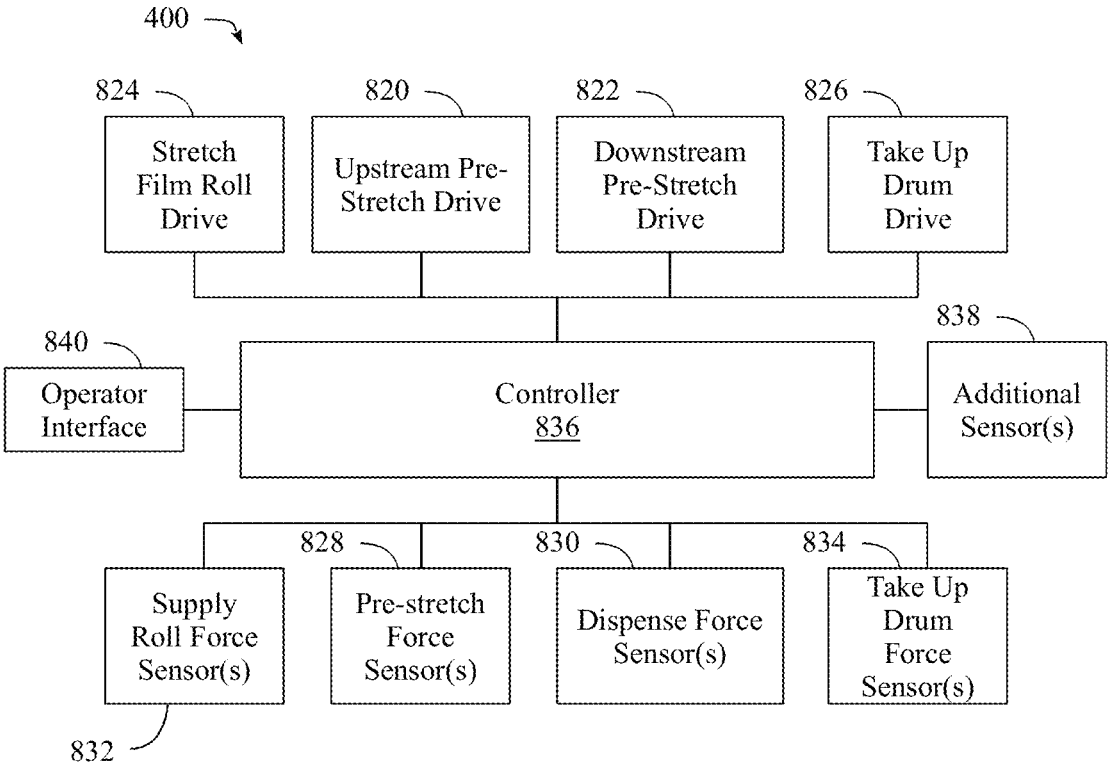
FIG. 36 is a block diagram of various electronic components in the test apparatus of FIG. 35.

In some embodiments, it may also be desirable to configure a test apparatus to allow for rewinding film samples back onto a source roll after a simulated stretch wrapping operation to facilitate simulating both stretch wrapping and unwrapping operations without having to remove film samples from the test apparatus. FIGS. 35-36, for example, illustrate an example implementation of a test apparatus 800 including a stretch film delivery system configured to convey a web of stretch film 802 between a stretch film roll 804 to a generally cylindrical take up drum 806. The stretch film delivery system of test apparatus 800 may include a pre-stretch assembly including an upstream pre-stretch roller 808 and a downstream pre-stretch roller 810. Stretch film roll 804 may be supported on a stretch film roll support, e.g., mandrel 812. In addition, various non-driven or idle rollers may be interposed between rollers 808 and 810 and take up drum 806, including a pre-stretch idle roller 814, exit idle roller 816, and stretch film roll idle roller 818. In the illustrated embodiment, stretch film roll 804 is a stretch film supply roll including a core, and is removable from mandrel 812. In other embodiments, however, stretch film may be dispensed and/or rewound directly onto a stretch film roll support, i.e., such that the stretch film roll is formed directly on the stretch film roll support, rather than using a stretch film roll that is removable from the stretch film roll support. In addition, while take up drum 806 is cylindrical in the illustrated embodiment, in other embodiments, take up drum 806 may have different shapes, e.g., cuboid, and in some embodiments, may be implemented by a body that emulates a palletized load, or a palletized load itself.

Rollers 808, 810, stretch film roll 804 (supported on mandrel 812), and take up drum 806 are driven to provide controllable stretching of stretch film when conveying the stretch film between stretch film roll 804 and take up drum 806, with transfer from stretch film roll 804 to take up drum 806 simulating a wrapping operation, and transfer from take up drum 806 to stretch film roll 804 simulating an unwrapping operation. With additional reference to FIG. 36, test apparatus 800 may also include a set of drives 820, 822, 824, and 826. Drives 820-826 may be, for example, bi-directional servo motors (and may additionally include encoders and/or other angular position or rotation sensors), and may be respectively coupled to upstream pre-stretch roller 808, downstream pre-stretch roller 810, mandrel 812 (to drive stretch film roll 804), and take up drum 806. Other types of drives, including, for example, DC motors, magnetic brakes, etc., may be used on any of drives 820-826. Further, in some embodiments, multiple rollers may be driven using a single drive, e.g., using a chain and sprocket, timing belt, etc. that can be manually modified to change a setting. Varying the rates of rotation of upstream and downstream pre-stretch rollers 808, 810 when simulating a wrapping operation, for example, may be used to apply a controlled amount of pre-stretch, while varying the rates of rotation of downstream pre-stretch roller 810 and take up drum 806 when simulating a wrapping operation may be used to apply a controlled amount of post-stretch, thereby simulating the amount of tension between a stretch film dispenser and a load during relative rotation between the stretch film dispenser and the load in a wrapping apparatus.

When simulating unwrapping operations, on the other hand, varying the rates of rotation of take up drum 806 and mandrel 812/stretch film roll 804 may be used to simulate the amount of tension during the unwrapping operation, as well as the amount of tension applied to the stretch film wrapped onto the stretch film roll. It will be appreciated that in some embodiments, when simulating an unwrapping operation, it may be desirable to control the rotation rates of upstream pre-stretch roller 808 and downstream pre-stretch roller 810 to effectively operate these rollers as idle rollers that neither add nor subtract tension to or from the stretch film. It will also be appreciated that the amount of stretch film collected by stretch film roll 804 and/or take up drum 806 may be measured and used to control the rates of rotation of stretch film roll 804 and/or take up drum 806 to compensate for the varying diameters thereof.

Test apparatus 800 may also include various force sensors to measure the force applied to the web of stretch film. For example, one or more force sensors such as load cells may be coupled to each of pre-stretch idle roller 814 (pre-stretch force sensor 828), exit idle roller 816 (dispense force sensor 830), and stretch film roll idle roller 818 (supply roll force sensor 832). In addition, take up drum 806 may include one or more take up drum force sensors 834 that are configured to measure the containment force applied by the web of stretch film to take up drum 806 during a wrapping operation. Multiple force sensors may be used for each roller and/or for take up drum 806, for example, to enable differentials in forces along the rotational axes thereof to be measured.

Each of drives 820-826 and sensors 828-834 may be coupled to a controller 836, and moreover, various additional sensors 838, e.g., one or more image sensors, ultrasonic sensors, etc., may also be coupled to controller 836 to sense other aspects of test apparatus 800. For example, one or more image sensors, e.g., high speed cameras, may be directed to capture images of the web of stretch film at various points within test apparatus 800, e.g., on stretch film roll 804, on take up drum 806, on various rollers and/or various points therebetween. Doing so, for example, may be useful for sensing flaws such as gels, tears, holes, etc. in the stretch film, or sensing lap seals, among other reasons.

Each drive 820-826 may also provide rotational or angular position data to controller 836, e.g., where each drive 820-826 is implemented as a servo motor with an integrated encoder functioning as a rotation or angular sensor. In other embodiments, however, separate rotation or angular sensors may be used for one or more of take up drum 806 and the various rollers described herein. Each rotation or angular sensor may be configured in some embodiments to measure an angular position of an associated component about a respective axis of rotation, which may also be used to detect or count full revolutions of the associated component, while in some embodiments one or more of the rotation or angular sensors may only be configured to detect or count full revolutions. For example, in some embodiments it may be desirable to mount a proximity switch on a frame of test apparatus 800 proximate take up drum 806 to detect a flag mounted at a predetermined angular position on take up drum 806 to detect each revolution of the take up drum, and thus each new layer of stretch film added to the take up drum during testing.

Test apparatus 800 may also include an operator interface 840 for use in setting up various control parameters for the apparatus, operating the apparatus, and retrieving test results therefrom. Operator interface may include various user input devices and/or displays coupled directly to test apparatus 800, or in some embodiments may be implemented on one or more remote computers or other devices in communication with test apparatus 800. It will also be appreciated that controller 836 may also be configured to perform a plurality of wrapping and unwrapping operations in sequence, repeating wrapping and unwrapping of a given length of stretch film under various wrapping and/or unwrapping conditions to simulate the characteristics of the stretch film over time as it is reused over multiple reuse cycles. From such simulation, information such as the elasticity recovery, ISOL, TSOL, and/or the number of potential reuse cycles, etc. may be determined, among other information.

CONCLUSION

It will be appreciated that, while certain features may be discussed herein in connection with certain embodiments and/or in connection with certain figures, unless expressly stated to the contrary, such features generally may be incorporated into any of the embodiments discussed and illustrated herein. Moreover, features that are disclosed as being combined in some embodiments may generally be implemented separately in other embodiments, and features that are disclosed as being implemented separately in some embodiments may be combined in other embodiments, so the fact that a particular feature is discussed in the context of one embodiment but not another should not be construed as an admission that those two embodiments are mutually exclusive of one another. Various additional modifications may be made to the illustrated embodiments consistent with the invention. Therefore, the invention lies in the claims hereinafter appended.

What is claimed is:

1. A method of making a stretch film supply roll, comprising:

unwrapping a first length of stretch film spirally wrapped around a first load into a roll form;

forming a lap seal joining together the first length of stretch film and a second length of stretch film spirally wrapped around a second load; and unwrapping the second length of stretch film into the roll form to form a continuous web of stretch film on the roll form.

2. The method of claim 1, wherein the first and second lengths of stretch film are formed of different film material.

3. The method of claim 1, wherein the first and second lengths of stretch film are manufactured by different manufacturers.

4. The method of claim 1, wherein the first and second lengths of stretch film have different thicknesses.

5. The method of claim 1, wherein the first length of stretch film has been controllably elongated below a first yield point of the first length of stretch film and the second length of stretch film has been controllably elongated below a first yield point of the second length of stretch film.

6. The method of claim 5, wherein the first length of stretch film includes a cumulative elongation gauge disposed on a surface thereof.

7. The method of claim 6, wherein the cumulative elongation gauge is formed on the first length of stretch film with a predetermined dimension along an elongation direction of the stretch film supply roll such that a current elongation of the first length of stretch film is determinable based on a measurement of a current dimension of the cumulative elongation gauge along the elongation direction of the stretch film supply roll.

8. The method of claim 7, wherein the cumulative elongation gauge is formed on the first length of stretch film prior to first use of the first length of stretch film to wrap a load.

9. The method of claim 7, wherein the cumulative elongation gauge includes a plurality of marks separated from one another along the elongation direction of the stretch film supply roll by the predetermined dimension or a plurality of shapes having the predetermined dimension along the elongation direction of the stretch film supply roll.

10. The method of claim 1, wherein unwrapping the first and second lengths of stretch film into the roll form includes winding the first and second lengths onto a core defining the roll form.

11. The method of claim 1, wherein forming the lap seal includes pressing, clamping, rolling, wiping and/or heating the lap seal.

12. The method of claim 1, wherein forming the lap seal includes applying an adhesive to at least one of the first and second lengths of stretch film.

13. The method of claim 1, further comprising forming, on at least one of the lap seal and an underlying layer of stretch film on the stretch film supply roll, a treated surface that reduces adherence between the lap seal and the overlapped layer.

14. The method of claim 13, wherein forming the treated surface includes abrading the treated surface.

15. The method of claim 13, wherein forming the treated surface includes powder treating the treated surface.

16. The method of claim 13, wherein forming the treated surface includes liquid treating the treated surface.

17. A method of using a stretch film supply roll, the stretch film supply roll including a plurality of lengths of stretch film wound into a roll form and a plurality of lap seals joining together adjacent lengths of stretch film from the plurality of lengths of stretch film to form a continuous web of stretch film on the roll form, the method comprising:

wrapping a first load by spirally wrapping a first portion of the continuous web of stretch film from the stretch film supply roll around the first load; and wrapping a second load by spirally wrapping a second portion of the continuous web of stretch film from the stretch film supply roll around the second load;

wherein at least one of the first and second portions of the continuous web of stretch film includes at least one lap seal and stretch film from multiple adjacent lengths of stretch film forming the continuous web of stretch film.

18. The method of claim 17, wherein first and second lengths of stretch film from the plurality of lengths of stretch film are formed of different film material.

19. The method of claim 17, wherein first and second lengths of stretch film from the plurality of lengths of stretch film are manufactured by different manufacturers.

20. The method of claim 17, wherein first and second lengths of stretch film from the plurality of lengths of stretch film have different thicknesses.

21. The method of claim 17, wherein the first portion of the continuous web of stretch film has previously been controllably elongated below a yield point of the first portion of stretch film when wrapping previous loads.

22. The method of claim 17, wherein the stretch film supply roll further includes a core about which the plurality of lengths of stretch film are wound, wherein the roll form is defined by the core.

23. The method of claim 17, wherein a first lap seal of the plurality of lap seals is a pressed, clamped, rolled, wiped, or heated lap seal.

24. The method of claim 17, wherein a first lap seal of the plurality of lap seals includes an adhesive.

25. The method of claim 17, wherein a first lap seal of the plurality of lap seals overlaps an underlying layer of stretch film on the stretch film supply roll, and the first lap seal and/or the overlapped layer includes a treated surface that reduces adherence between the first lap seal and the overlapped layer.

26. The method of claim 25, wherein the treated surface is an abraded surface.

27. The method of claim 25, wherein the treated surface is a powder treated surface or a liquid treated surface.

* * * * *